US011518482B1

(12) United States Patent
Dugger et al.

(10) Patent No.: US 11,518,482 B1
(45) **Date of Patent: *Dec. 6, 2022**

(54) WATER SPORTS BOAT WITH FOIL DISPLACEMENT SYSTEM

(71) Applicant: Malibu Boats, LLC, Loudon, TN (US)

(72) Inventors: Cory Wade Dugger, Maryville, TN (US); Rachael Marie Green, Lenoir, TN (US); Jeffrey Lee Predmore, Knoxville, TN (US); Scott Thomas Ward, Knoxville, TN (US); Matthew Welton, Sarasota, FL (US)

(73) Assignee: Malibu Boats, LLC, Loudon, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/840,226

(22) Filed: Apr. 3, 2020

Related U.S. Application Data

(60) Provisional application No. 62/830,241, filed on Apr. 5, 2019.

(51) Int. Cl.

| | |
|---|---|
| ***B63B 34/75*** | (2020.01) |
| ***B63B 1/24*** | (2020.01) |
| ***B63B 1/30*** | (2006.01) |
| ***B63B 1/26*** | (2006.01) |

(52) U.S. Cl.
CPC ..... *B63B 34/75* (2020.02); *B63B 1/248* (2013.01); *B63B 1/26* (2013.01); *B63B 1/30* (2013.01)

(58) Field of Classification Search
CPC ..... B63B 34/75; B63B 1/248; B63B 1/26; B63B 1/30
See application file for complete search history.

(56) References Cited

U.S. PATENT DOCUMENTS

| | | | |
|---|---|---|---|
| 667,482 | A | 2/1901 | Albarda |
| 704,729 | A | 7/1902 | Zerbe |
| 1,196,682 | A | 8/1916 | Harriss |

(Continued)

FOREIGN PATENT DOCUMENTS

| | | |
|---|---|---|
| CA | 2271332 | 2/2000 |
| CN | 2597328 | 1/2004 |

(Continued)

OTHER PUBLICATIONS

Ex Parte Reexamination of U.S. Appl. No. 9,25,161 (Control No. 90/013,318), filed Sep. 26, 2016, Gasper et al.

(Continued)

*Primary Examiner* — Stephen P Avila
(74) *Attorney, Agent, or Firm* — Knobbe Martens Olson & Bear, LLP

(57) ABSTRACT

A foil displacement system includes one or more foils that can be deployed and stowed. When deployed, each foil can exert downforce or uplift depending on its orientation. For example, each foil may be positioned to have an angle of attack that creates a downward force effectively transmitted to the hull to pull the hull deeper within the water to, for example, create a larger wake. Use of the foil displacement system can enhance or replace the use of a ballast tank system, can be integrated into a new boat or retrofitted to existing boats, can be electronically or manually positioned, can enhance activities such as wake surfing, wake boarding, water skiing or other similar or related water sports.

31 Claims, 59 Drawing Sheets

(56) References Cited

U.S. PATENT DOCUMENTS 1,264,320 A 4/1918 Metzler
2,081,868 A 5/1937 Hampden
2,199,333 A 4/1940 Dunklin
2,663,276 A 12/1953 Ouellet
2,807,228 A 9/1957 Vandre
2,832,304 A 4/1958 Elyosius et al.
2,890,673 A 6/1959 Chadwick, Jr.
2,994,290 A 8/1961 Merchant, Sr.
2,998,791 A 9/1961 Light
3,046,928 A 7/1962 Sherrill
3,062,167 A 11/1962 Bennett
3,079,885 A 3/1963 Cooke
3,094,960 A 6/1963 Lang
3,106,178 A 10/1963 Cale
3,111,103 A 11/1963 Bennett
3,159,134 A 12/1964 Winnen
3,200,782 A 8/1965 Walden et al.
3,247,820 A 4/1966 White
3,259,097 A 7/1966 Veldhuizen et al.
3,294,052 A 12/1966 Jones
3,327,671 A 6/1967 Comins
3,372,663 A 3/1968 Bue
3,391,667 A 7/1968 Bue
3,399,643 A 9/1968 Bennett
3,456,610 A 7/1969 Beals
3,456,611 A * 7/1969 Johnson ..... B63B 1/30 114/275
3,577,948 A 5/1971 Frey
3,628,484 A 12/1971 Banner
3,628,486 A 12/1971 Bennett
3,628,487 A 12/1971 Bennett
3,650,310 A 3/1972 Childress
3,670,685 A 6/1972 Milessa
3,695,204 A 10/1972 Bennett
3,698,343 A 10/1972 Boome
3,760,759 A 9/1973 Lang
3,763,812 A 10/1973 Rowe
3,982,493 A 9/1976 Cronin
4,178,871 A 12/1979 Hirsch
4,232,626 A 11/1980 Kern
4,237,808 A 12/1980 Doerffer
4,261,278 A 4/1981 Gaudin
4,434,738 A 3/1984 Barkemeyer
4,577,580 A 3/1986 Diffely, Sr.
4,597,742 A 7/1986 Finkl
4,644,893 A 2/1987 Zepp
4,718,872 A 1/1988 Olson et al.
4,763,219 A 8/1988 Nakamura
4,776,295 A 10/1988 Kline et al.
4,854,259 A 8/1989 Cluett
4,895,093 A 1/1990 Dalsbo
4,910,419 A 3/1990 Hayashi et al.
4,915,048 A * 4/1990 Stanford ..... B63B 1/30 114/274
4,967,682 A 11/1990 O'Donnell
5,041,040 A 8/1991 Jones et al.
5,058,520 A 10/1991 Fahrney
5,113,780 A 5/1992 Bennett et al.
5,142,473 A 8/1992 Davis
5,193,478 A 3/1993 Mardikian
5,224,436 A 7/1993 Stricker
5,235,926 A 8/1993 Jones
5,263,432 A 11/1993 Davis
5,315,951 A 5/1994 Finkl
5,359,956 A 11/1994 Lee
5,377,610 A 1/1995 Goebel
5,385,110 A 1/1995 Bennet et al.
5,445,100 A 8/1995 Finkl
5,474,012 A 12/1995 Yamada et al.
5,474,013 A 12/1995 Wittmaier
5,549,071 A 8/1996 Pigeon et al.
5,572,944 A 11/1996 Slikkers et al.
5,628,272 A 5/1997 Thomas
5,664,910 A 9/1997 Lochtefeld et al.
5,694,337 A 12/1997 Macken
5,787,835 A 8/1998 Remnant
5,860,384 A 1/1999 Castillo
5,860,766 A 1/1999 Lochtefeld et al.
5,881,666 A 3/1999 Crews, Jr.
5,911,190 A 6/1999 Lochtefeld et al.
6,006,689 A 12/1999 Olofsson
6,012,408 A * 1/2000 Castillo ..... B63B 39/061 114/274
6,026,759 A 2/2000 Hazelett et al.
6,044,788 A 4/2000 Larson et al.
6,047,657 A 4/2000 Cox
6,105,527 A 8/2000 Lochtefeld et al.
6,138,601 A 10/2000 Anderson et al.
6,148,756 A 11/2000 Pavlov et al.
6,158,375 A 12/2000 Stuart, Jr.
6,167,830 B1 1/2001 Pilger
6,213,044 B1 4/2001 Rodgers et al.
6,234,099 B1 5/2001 Jessen et al.
6,354,237 B1 3/2002 Gaynor et al.
6,415,729 B1 7/2002 Nedderman, Jr. et al.
6,427,616 B1 8/2002 Hagen
6,520,104 B1 2/2003 Svensson
6,523,489 B2 2/2003 Simard et al.
6,523,490 B1 2/2003 Watkins
6,603,402 B2 8/2003 Lentine et al.
6,606,959 B1 8/2003 Shen
6,745,715 B1 6/2004 Shen et al.
6,782,839 B1 8/2004 Nozaki
6,827,031 B2 12/2004 Aoyama
6,874,441 B2 4/2005 Pigeon
6,923,136 B1 8/2005 D'Alessandro
6,935,263 B1 8/2005 Bandyopadhyay
6,941,884 B2 9/2005 Moore
6,953,002 B2 10/2005 Jessen et al.
7,004,097 B2 2/2006 Zeromski
7,007,621 B1 3/2006 Bootes
7,018,252 B2 3/2006 Simard et al.
7,063,031 B2 6/2006 Earl, Jr. et al.
7,140,318 B1 11/2006 Gasper
7,174,843 B1 2/2007 Tossavainen
7,188,581 B1 3/2007 Davis et al.
7,201,111 B1 4/2007 Burkett
7,210,422 B1 5/2007 Hickok et al.
7,216,601 B1 5/2007 Mann
7,246,565 B2 7/2007 Snook et al.
7,252,047 B1 8/2007 Baucom, Jr.
7,252,074 B2 8/2007 Chapman et al.
7,311,058 B1 12/2007 Brooks et al.
7,318,389 B2 1/2008 Boning
7,380,514 B2 6/2008 Loui et al.
7,381,108 B1 6/2008 Salmon
7,434,531 B1 10/2008 Zsido et al.
7,467,596 B2 12/2008 Salmon
7,497,748 B2 3/2009 Salmon
7,617,026 B2 11/2009 Gee et al.
7,641,525 B2 1/2010 Morvillo
7,707,956 B2 5/2010 Moore
7,780,490 B2 8/2010 Lundgren
7,905,193 B2 3/2011 Beamer
7,958,837 B1 6/2011 Fraleigh
8,096,255 B2 1/2012 Morand et al.
8,100,079 B2 1/2012 Buzzi
8,191,493 B2 6/2012 Baywol
8,201,514 B2 6/2012 Coles
8,216,007 B2 7/2012 Moore
8,251,006 B2 8/2012 Kalil
8,261,682 B1 9/2012 DeVito
8,327,790 B2 12/2012 Snow
8,336,477 B2 12/2012 Walker
8,387,551 B2 3/2013 Muller
8,465,333 B2 6/2013 Sells
8,468,964 B2 6/2013 Hoberman et al.
8,480,445 B2 7/2013 Morvillo
8,522,706 B2 9/2013 Larson et al.
8,534,214 B1 9/2013 Gasper
8,539,897 B1 9/2013 Gasper et al.
8,578,873 B2 11/2013 Gasper et al.
8,622,012 B2 1/2014 Olofsson
8,631,753 B2 1/2014 Morvillo

(56) References Cited

U.S. PATENT DOCUMENTS

| | | | |
|---|---|---|---|
| 8,739,723 | B1 | 6/2014 | Murphy |
| 8,798,825 | B1 | 8/2014 | Hartman |
| 8,833,286 | B1 | 9/2014 | Sheedy et al. |
| 8,967,070 | B2 | 3/2015 | Kalil |
| 8,968,043 | B1 | 3/2015 | Murphy |
| 9,150,289 | B1 | 10/2015 | Brendel |
| 9,156,372 | B1 | 10/2015 | Guglielmo et al. |
| 9,199,695 | B2 | 12/2015 | Gasper et al. |
| 9,254,896 | B2 | 2/2016 | Bertalan et al. |
| 9,260,161 | B2 | 2/2016 | Gasper et al. |
| 9,272,762 | B1 | 3/2016 | Murphy |
| 9,315,235 | B1 | 4/2016 | Wood |
| 9,315,236 | B2 | 4/2016 | Gasper |
| 9,334,022 | B2 | 5/2016 | Gasper et al. |
| 9,540,074 | B1 | 1/2017 | Pigeon |
| 9,573,655 | B1 | 2/2017 | Pigeon |
| 9,580,147 | B2 | 2/2017 | Gasper et al. |
| 9,592,890 | B2 | 3/2017 | Christensen |
| D783,021 | S | 4/2017 | Peel |
| 9,611,006 | B1 | 4/2017 | Miller et al. |
| 9,669,903 | B2 | 6/2017 | Gasper et al. |
| 9,694,873 | B2 | 7/2017 | Gasper et al. |
| 9,891,620 | B2 | 2/2018 | Green et al. |
| 9,914,504 | B2 | 3/2018 | Gasper et al. |
| 9,926,043 | B1 | 3/2018 | Miller et al. |
| 10,179,628 | B2 | 1/2019 | Gasper et al. |
| 10,202,171 | B1 | 2/2019 | Miller et al. |
| 10,308,321 | B1 | 6/2019 | Miller et al. |
| 10,322,777 | B2 | 6/2019 | Gasper et al. |
| 10,386,834 | B2 | 8/2019 | Green et al. |
| 10,683,061 | B2 | 6/2020 | Gasper et al. |
| 10,858,068 | B1 | 12/2020 | Miller et al. |
| 11,370,508 | B1 | 6/2022 | Dugger et al. |
| 2004/0261684 | A1 | 12/2004 | Pigeon |
| 2005/0124234 | A1 | 7/2005 | Sells et al. |
| 2005/0155540 | A1 | 7/2005 | Moore |
| 2006/0054067 | A1 | 3/2006 | Hoberman et al. |
| 2006/0217011 | A1 | 9/2006 | Morvillo |
| 2007/0078575 | A1 | 4/2007 | Wilson et al. |
| 2007/0125287 | A1 | 6/2007 | Walker |
| 2007/0137550 | A1 | 6/2007 | Davis et al. |
| 2007/0202757 | A1 | 8/2007 | Moore |
| 2008/0257245 | A1 | 10/2008 | Stella |
| 2008/0271660 | A1 | 11/2008 | Zsido et al. |
| 2008/0281478 | A1 | 11/2008 | Gee et al. |
| 2009/0165694 | A1 | 7/2009 | Beamer |
| 2010/0101475 | A1 | 4/2010 | Mueller |
| 2010/0121493 | A1 | 5/2010 | Christensen et al. |
| 2010/0251952 | A1 | 10/2010 | Baywol |
| 2011/0017115 | A1 | 1/2011 | Olofsson |
| 2011/0126751 | A1 | 6/2011 | Muller |
| 2011/0315063 | A1* | 12/2011 | Templeman ..... B63B 1/248 114/280 |
| 2011/0320072 | A1 | 12/2011 | Morvillo |
| 2012/0079977 | A1 | 4/2012 | Gai |
| 2013/0000542 | A1 | 1/2013 | Muller |
| 2013/0145978 | A1 | 6/2013 | Viviani et al. |
| 2014/0026799 | A1 | 1/2014 | Kalil |
| 2015/0066249 | A1 | 3/2015 | Fieback et al. |
| 2016/0214681 | A1* | 7/2016 | Huyge ..... B63B 34/75 |
| 2017/0038771 | A1* | 2/2017 | Green ..... G06F 3/165 |
| 2020/0064828 | A1 | 2/2020 | Green et al. |

FOREIGN PATENT DOCUMENTS

| | | |
|---|---|---|
| DE | 26 34 573 | 2/1978 |
| DE | 101 59 040 | 9/2002 |
| EP | 1 435 325 | 7/2004 |
| EP | 1 058 645 | 10/2004 |
| FR | 2 556 312 | 6/1985 |
| GB | 332315 | 7/1930 |
| NR | 86945 | 2/1956 |
| SU | 975490 | 11/1982 |
| WO | WO 93/00258 | 1/1993 |
| WO | WO 96/20105 | 7/1996 |
| WO | WO 99/55577 | 11/1999 |
| WO | WO 2005/118384 | 12/2005 |
| WO | WO 2006/058232 | 6/2006 |
| WO | WO 2007/072185 | 6/2007 |
| WO | WO 2009/113923 | 9/2009 |
| WO | WO 2011/099931 | 8/2011 |
| WO | WO 2013/040576 | 3/2013 |
| WO | WO 2013/071148 | 5/2013 |

OTHER PUBLICATIONS

MasterCraft Surf Tab—Screenshots taken from video uploaded on May 26, 2010 at http://www.youtube.com/watch?v=b1Q_MLRO31M.

Tige Convex VX—Screenshots taken from video uploaded on Oct. 10, 2012 at http://www.youtube.com/watch?v=jx5QXC-dU9w.

Centurion Wake Plate—Website dated Aug. 27, 2011—http://www.centurionboats.com/features-and-options/adjustable-wake-plate.html.

Nautique Surf System—Released Jan. 3, 2013—Website printout from http://www.nautique.com/models/nautique-surf-system.

Letter from Edmund J. Haughey of Fitzpatrick, Celia, Harper & Scinto, dated Feb. 3, 2016.

"Debut of new Sanger Surf Series," Wake World forum having postings between Oct. 4, 2008 and Feb. 9, 2009, webpage archive of http://www.wakeworld.com/forum/showthread.php?t=632602 dated May 30, 2012, 171 pages.

Screenshots taken from video titled "Surf Sanger," uploaded on Apr. 30, 2008 at https://www.youtube.com/watch?v=WcVIZZ7QZus.

Email from Edmund J. Haughey of Fitzpatrick, Celia, Harper & Scinto, dated Feb. 11, 2016.

Humphree Operator's Manual, dated 2009.

Humphree Installation Manual, dated 2009.

"Malibu Makes Boating Easier and More Fun With MaliView," dated Sep. 4, 2008.

Ski Locker—Trim the Waves to Suit Your Personality, Trailer BOATS (as reprinted at http://www.switchbladewake.com/switchblade.pdf), Jul. 2005.

International Search Report dated Dec. 6, 2012 for PCT/US2012/055788.

International Search Report dated Jan. 25, 2013 for PCT/US2012/064504.

Volvo Penta—QL Boat Trim System Brochure—The Declaration of David Kennedy alleges that this brochure became publicly available prior to 2010.

Volvo Penta—QL Boat Trim System User & Installation Instructions—The Declaration of David Kennedy alleges that these instructions became publicly available prior to 2010.

Declaration of David Kennedy, dated Dec. 13, 2013, in *Malibu Boats, LLC* v. *Nautique Boat Co.*, Case No. 3:13-cv-00656, in the United States District Court for the Eastern District of Tennessee.

Switch Blade Wake Enhancement System, dated Apr. 10, 2006, https://switchbladewake.com/default.htm.

First Look Nautique Surf System Wakeworld in 3 pages, Author: David Williams, Jan. 16, 2013.

Lenco Marine Inc., Electric Trim Tab Kits in 2 pages, Oct. 2007.

QL—Quality Line product news: Trim system with new technology, dated Aug. 16, 2004.

Nautique Launches the Nautique Surf System—Press Release, dated Jan. 3, 2013.

Luke, Surf Expo WBM's Surf Expo-Booth View: MasterCraft, dated Sep. 10, 2009.

Luke, Wakeboarding Mastercraft X-25 2011, Wakeboard Boat Review, Feb. 16, 2011.

Luke, Wakeboarding Mastercraft X-2 2011, Wakeboard Boat Review, Feb. 16, 2011.

Luke, Wakeboarding Zane Schwenk Shreds MasterCrafts New Surf Tabs, Sep. 17, 2009.

Video titled "MasterCraft Rewind 2010—The BIG Review", allegedly uploaded on Dec. 30, 2009 at https://www.youtube.com/watch?v=85CoNjFc-wY.

(56) References Cited

OTHER PUBLICATIONS

Machine transcription (using a method from http://www.labnol.org/internet/transcribe-video-to-text/28914/) taken from a video titled "MasterCraft Rewind 2010—The BIG Review", allegedly uploaded on Dec. 30, 2009 at https://www.youtube.com/watch?v=85CoNjFc-wY.
Video titled "MasterCraft Rewind 2010—Surf Tab and Tower Camera Review", allegedly uploaded on Dec. 30, 2009 at https://www.youtube.com/watch?v=UVRra3sMV7A.
Machine transcription (using a method from http://www.labnol.org/internet/transcribe-video-to-text/28914/) taken from a video titled "MasterCraft Rewind 2010—Surf Tab and Tower Camera Review", allegedly uploaded on Dec. 30, 2009 at https://www.youtube.com/watch?v=UVRra3sMV7A.
Video titled "MasterCraft CSX 265 Review", allegedly uploaded on Nov. 11, 2009 at https://www.youtube.com/watch?v=--N30QPJtfQ.
Machine transcription (using a method from http://www.labnol.org/internet/transcribe-video-to-text/28914/) taken from a video titled "MasterCraft CSX 265 Review", allegedly uploaded on Nov. 11, 2009 at https://www.youtube.com/watch?v=--N30QPJtfQ.
Video titled "Z3 Wakesurf Side to Side in Seconds", allegedly uploaded on Jul. 8, 2012 at https://www.youtube.com/watch?v=jVJIVomFjT0.
Machine transcription (using a method from http://www.labnol.org/internet/transcribe-video-to-text/28914/) taken from a video titled "Z3 Wakesurf Side to Side in Seconds", allegedly uploaded on Jul. 8, 2012 at https://www.youtube.com/watch?v=jVJIVomFjT0.
Video titled "The All-New Nautique Surf System", allegedly uploaded on Jan. 3, 2013 at https://www.youtube.com/watch?v=gtaySYhmAdA.
Machine transcription (using a method from http://www.labnol.org/internet/transcribe-video-to-text/28914/) taken from a video titled "The All-New Nautique Surf System", allegedly uploaded on Jan. 3, 2013 at https://www.youtube.com/watch?v=gtaySYhmAdA.
Video titled "Nautique Surf System How-to-Video", allegedly uploaded on Jan. 3, 2013 at https://www.youtube.com/watch?v=GnKfEtMskao.
Machine transcription (using a method from http://www.labnol.org/internet/transcribe-video-to-text/28914/) taken from a video titled "Nautique Surf System How-to-Video", allegedly uploaded on Jan. 3, 2013 at https://www.youtube.com/watch?v=GnKfEtMskao.
MasterCraft Boat Company Recipient of NMMA Innovation Award, Feb. 2010.
MasterCraft Reveals New Innovations for 2010, Aug. 2009.
MasterCraft X-Series Models HV700 and HV450 Owner's Manual in 58 pages, Jul. 24, 2012.
Medallion Instrumentation Systems 2010 MasterCraft Viper System in 41 pages, alleged to have a date of prior to Sep. 16, 2010. (In 2 parts).
Medallion Instrumentation Systems MasterCraft University Instrumentation Training Part 1, Feb. 2012.
Nautique Surf System The new standard in Wakesurfing in 3 pages, Jan. 16, 2013.
Sanger Boats V237 2008 Wakeboarding Magazine in 4 pages, Jan. 1, 2008.
Video titled "2011 MasterCraft X-25", allegedly uploaded on Mar. 15, 2011 at https://www.youtube.com/watch?v=CpPRDrLznoQ.
Screenshot taken early in a video titled "2011 MasterCraft X-25", allegedly uploaded on Mar. 15, 2011 at https://www.youtube.com/watch?v=CpPRDrLznoQ.
Video titled "MasterCraft Rewind 2009—Day in the Life of the CSX 265", allegedly uploaded on Dec. 24, 2008 at https://www.youtube.com/watch?v=nr5xXu5fA54.
Screenshot taken early in a video titled "MasterCraft Rewind 2009—Day in the Life of the CSX 265", allegedly uploaded on Dec. 24, 2008 at https://www.youtube.com/watch?v=nr5xXu5fA54.
Video titled "The History of Wake Surfing", allegedly uploaded on Sep. 27, 2012 at https://www.youtube.com/watch?v=KWYZf3A7aas.
Screenshot taken early in a video titled "The History of Wake Surfing", allegedly uploaded on Sep. 27, 2012 at https://www.youtube.com/watch?v=KWYZf3A7aas.
Teakgate Modifications & Accessories (p. 1), TheMalibuCrew.com in 13 pages. Oct. 2012.
Teakgate Modifications & Accessories (p. 2), TheMalibuCrew.com in 11 pages. Oct. 2012.
Teakgate Modifications & Accessories (p. 3), TheMalibuCrew.com in 3 pages. Oct. 2012 to Nov. 2012.
Teakgate Modifications & Accessories (p. 4), TheMalibuCrew.com in 5 pages. Nov. 2012 to Mar. 2013.
Video titled "2008 Surfing Sanger 237 Edition", allegedly uploaded on Sep. 17, 2008 at https://www.youtube.com/watch?v=VedGGGD79bM.
Transcription taken from a video titled "2008 Surfing Sanger 237 Edition", allegedly uploaded on Sep. 17, 2008 at https://www.youtube.com/watch?v=VedGGGD79bM.
Video titled "A ride on the wakesurf board", allegedly uploaded on Oct. 15, 2012 at https://www.youtube.com/watch?v=3ru47pbUgyo.
Transcription taken from a video titled "A ride on the wakesurf board", allegedly uploaded on Oct. 15, 2012 at https://www.youtube.com/watch?v=3ru47pbUgyo.
Video titled "Malibu Sunsetter First Crossover", allegedly uploaded on Oct. 14, 2012 at https://www.youtube.com/watch?v=5Wou4sWdTXk.
Transcription taken from a video titled "Malibu Sunsetter First Crossover", allegedly uploaded on Oct. 14, 2012 at https://www.youtube.com/watch?v=5Wou4sWdTXk.
Video titled "Malibu Sunsetter with Teakgate—first water test", allegedly uploaded on Oct. 14, 2012 at https://www.youtube.com/watch?v=u3Bx5k7dOD8.
Transcription taken from a video titled "Malibu Sunsetter with Teakgate—first water test", allegedly uploaded on Oct. 14, 2012 at https://www.youtube.com/watch?v=u3Bx5k7dOD8.
Video titled "Malibu Sunsetter with 'Teakgate'", allegedly uploaded on Oct. 13, 2012 at https://www.youtube.com/watch?v=pUwoFd4wOTs.
Transcription taken from a video titled "Malibu Sunsetter with 'Teakgate'", allegedly uploaded on Oct. 13, 2012 at https://www.youtube.com/watch?v=pUwoFd4wOTs.
Video titled "MasterCraft X10 Featuring Surf Tabs", allegedly uploaded on Feb. 9, 2013 at https://www.youtube.com/watch?v=nVddaDkKR5k.
Transcription taken from a video titled "MasterCraft X10 Featuring Surf Tabs", allegedly uploaded on Feb. 9, 2013 at https://www.youtube.com/watch?v=nVddaDkKR5k.
Video titled "No need surf gates . . . Only a Mastercraft X10", allegedly uploaded on Nov. 23, 2012 at https://www.youtube.com/watch?v=oltkqqKwEes.
Transcription taken from a video titled "No need surf gates . . . Only a Mastercraft X10", allegedly uploaded on Nov. 23, 2012 at https://www.youtube.com/watch?v=oltkqqKwEes.
Video titled "Riding the Teakgate Wave", allegedly uploaded on Oct. 15, 2012 at https://www.youtube.com/watch?v=VgH-WvdWdSo.
Transcription taken from a video titled "Riding the Teakgate Wave", allegedly uploaded on Oct. 15, 2012 at https://www.youtube.com/watch?v=VgH-WvdWdSo.
Video titled "Steve wake surfing both sides of the wake", allegedly uploaded on Aug. 12, 2007 at https://www.youtube.com/watch?v=TAjUt6Kh-Xw.
Transcription taken from a video titled "Steve wake surfing both sides of the wake", allegedly uploaded on Aug. 12, 2007 at https://www.youtube.com/watch?v=TAjUt6Kh-Xw.
Video titled "Teakgate Dual Gate Test", allegedly uploaded on Nov. 12, 2012 at https://www.youtube.com/watch?v=c6nEgA099fs.
Transcription taken from a video titled "Teakgate Dual Gate Test", allegedly uploaded on Nov. 12, 2012 at https://www.youtube.com/watch?v=c6nEgA099fs.
Video titled "Teakgate Testing", allegedly uploaded on Nov. 12, 2012 at https://www.youtube.com/watch ?v=H5tOiz9SdaQ.

(56) References Cited

OTHER PUBLICATIONS

Transcription taken from a video titled "Teakgate Testing", allegedly uploaded on Nov. 12, 2012 at https://www.youtube.com/watch?v=H5tOiz9SdaQ.
Video titled "Wakesurfing the Sanger 237", allegedly uploaded on Apr. 29, 2008 at https://www.youtube.com/watch?v=nG0YH8fwCmM.
Transcription taken from a video titled "Wakesurfing the Sanger 237", allegedly uploaded on Apr. 29, 2008 at https://www.youtube.com/watch?v=nG0YH8fwCmM.
Video titled "Wakesurfing Crossover behind a 1987 Sunsetter", allegedly uploaded on Oct. 15, 2012 at https://www.youtube.com/watch?v=yCGsKoyLbYs.
Transcription taken from a video titled "Wakesurfing Crossover behind a 1987 Sunsetter", allegedly uploaded on Oct. 15, 2012 at https://www.youtube.com/watch?v=yCGsKoyLbYs.
Volvo Penta, QL Boat Trim System & Automatic Boat Trim Option in 4 pages, 2008.
Volvo Penta, QL Boat Trim System Brochure in 4 pages, 2007.
Volvo Penta, QL Boat Trim System Marine Accessories, www.qlmarine.com in 2 pages, 2004.
WakeWorld Forum Showthread, Is the Razor Blade the Switch Blade for Surfing in 14 pages, forum posts dated Feb. 8, 2008 and earlier.
WakeWorld MasterCraft Reveals New Innovations for 2010 in 3 pages, Aug. 24, 2009.
2010 Mastercraft Owner's Manual.
2011 Mastercraft Owner's Manual (Part 1—covering pages #i-#4-33).
2011 Mastercraft Owner's Manual (Part 2—covering pages #5-1-#24-4).
2012 Mastercraft Owner's Manual.
2013 Mastercraft Owner's Manual (Part 1—covering pages #i-#2-45).
2013 Mastercraft Owner's Manual (Part 2—covering pages #3-1-#6-18).
New QL Boat Trim System—Always Perfect Trim, dated Jul. 2007.
Malibu 2009 Owner's Manual.
MasterCraft Reveals 2010 Innovations, dated Sep. 3, 2009.
Machine transcription (using a method from http://www.labnol.org/internet/transcribe-video-to-text/28914/) taken from a video titled "Zane Schwenk—MasterCraft Surf Tabs", allegedly uploaded on May 26, 2010 at http://www.youtube.com/watch?v=b1Q_MLRO31M.
Videos uploaded on Dec. 13, 2016: MCFT0071469—https://youtu.be/4sJZWLWoRiM MCFT0071470—https://youtu.be/UV-_8qhQ7p0 MCFT0071471—https://youtu.be/6YcERDOWpq0 MCFT0071472—https://youtu.be/LghlFtztrpE MCFT0071473—https://youtu.be/uw7VbO_6Jjc MCF 10071474—https://youtu.be/wuG85gQBJqg MCFT0071475—https://youtu.be/3oo1JP1sZY8 MCFT0071476—https://youtu.be/O0E1yKTBABU MCFT0071477—https://youtu.be/tDSGnbMBi8E MCFT0071478—https://youtu.be/vzLNdRnzrrE MCFT0071479—https://youtu.be/-6v9ThC3bqQ MCFT0071725—https://youtu.be/wh2Qxcofft4 One or more of these videos were referenced in MasterCraft's Invalidity Contentions dated May 12, 2016 and Nov. 14, 2016.
Nautique Surf System (2 Pages), dated Jan. 3, 13, http://www.nautique.com/blog/index/nautique-surf-system.
Video titled "X-2 Surfing 2010," allegedly uploaded on Aug. 31, 2010 at https://www.youtube.com/watch?v=1FbuXfaWFwU.
Screenshot taken early in a video titled "X-2 Surfing 2010," allegedly uploaded on Aug. 31, 2010 at https://www.youtube.com/watch?v=1FbuXfaWFwU.
Castle Bravo—Power Trim Tabs, dated May 11, 2011, http://mhkaufman.blogspot.com/2011/05/power-trim-tabs.html.
Wake Plates?—Wakeboarder.com Forum, Posts dated Mar. 23, 2005 to Mar. 24, 2005, http://forums.wakeboarder.com/viewtopic.php?t=40149&sid.
Tips for Proper Boat Weighting, dated Sep. 28, 2012, https://www.wakeutah.com/2012/09/28/tips-for-proper-boat-weighting/.
Lenco Marine, Drawing 20609, 2 Pages, dated Dec. 3, 2009.
"A Simple Slip Vs. Roll Wake Enhancement Experiment," http://wakeworld.com/forum/showthread.php?t=544205, posts dated Feb. 13, 2008 and earlier.
"Weighting a Sanger 237, need help," http://www.wakeworld.com/forum/showthread.php?t=770907, posts dated Jan. 25, 2010.
"Power wedge or trim tab??," http://yamahajetboaters.com/forum/viewtopic.php?f=1&t=19792, posts dated Apr. 28, 2009 and earlier.
"Centurion Boats Enzo SV220 2008: Wakeboard Boat Review," Wakeboarding Magazine, Jan. 1, 2008, https://www.wakeboardingmag.com/blog/boats/2008/01/01/centurion-boats-enzo-sv220-2008/.
"Centurion Enzo SV 230," Nov. 10, 2008, https://www.boatingmag.com/boats/centurion-enzo-sv-230/.
"Boardstock 10," Aug. 31, 2005, http://wakeworld.com/news/latestinwake/boardstock-10.html.
Video titled "World Champion Tow Boat History—Centurion Boats," allegedly uploaded Aug. 20, 2017 at https://www.youtube.com/watch?v=uHROZgUk91Q.
Machine transcription taken from a video titled "World Champion Tow Boat History—Centurion Boats," allegedly uploaded Aug. 20, 2017 at https://www.youtube.com/watch?v=uHROZgUk91Q.
Lenco Owner's Manual, dated Jan. 26, 2010, in 24 Pages.
"Hydrofoil," *Wikipedia*, Wikimedia Foundation, available as early as Mar. 26, 2020, en.wikipedia.org/wiki/Hydrofoil.
Yun L., Bliault A., High Performance Marine Vessels, dated 2012. (In 2 parts).
Monsonnec, Fred, "The Foil Alphabet," dated Apr. 4, 2015, www.foilingweek.com/wp-content/uploads/2015/04/The-foil-alphabet-Fred-Monsonnec-04-04-2015.pdf?189db0&189db0.
Johnston, R.J., "Hydrofoils," Naval Eng. J., vol. 97 No. 2, 142-199, dated Feb. 1985.
Lei, Siyu, "A Look at the USS Aries," Columbia Missourian, dated Dec. 9, 2015, www.columbiamissourian.com/visuals/graphics/a-look-at-the-uss-aries/html_6b546320-9ed7-11e5-9427-fb3e65328a09.html.
Ac-86 Build, RC Groups, dated Aug. 21, 2013, https://www.rcgroups.com/forums/showthread.php?1887900-Ac-86-build/page5.
D'Ambrosio, Luca, "Princess R35. The Sexy Revolution by Princess Yachts," Yachting Media, The International Yachting Media, dated Nov. 20, 2018, www.yachtingmedia.com/magazine/princess-r35.html.
Meet the foiling catamaran for family sailors—the fantastic Formula Whisper, YouTube, dated Jun. 30, 2015, at 4:28, https://www.youtube.com/watch?v=opxXm8Oub0A.
Formula Whisper, the exciting new boat that anyone can learn to foil, Yachting World, dated Sep. 7, 2015, https://www.yachtingworld.com/yachts-and-gear/formula-whisper-just-how-easy-is-it-to-get-this-boat-to-foil-67280.
Meet the foiling catamaran for family sailors—the fantastic Formula Whisper, YouTube, dated Jun. 30, 2015, at 6:20, https://www.youtube.com/watch?v=opxXm8Oub0A.
Dieter Loibner, The Efficiency of a Foiling Powercat, Professional Boatbuilder, dated Mar. 13, 2020, https://www.proboat.com/2020/03/foiling-powercat/.
Frances, Guru Bikes or Our Journey Into the Frigid North, New England Bicycle Consulting, dated Nov. 19, 2009, https://nebikeconsulting.wordpress.com/2009/11/19/guru-bikes-or-our-journey-into-the-frigid-north/.
Matthew Loveridge, Have carbon bikes reached classic status yet?, bikeradar, dated Dec. 13, 2019, https://www.bikeradar.com/features/classic-carbon-road-bikes/.
Evolution of airfoil weight and strength Carbon fiber inlay weave, Microbirds: Ultralight, dated Apr. 16, 2019, https://microbirds.com/evolution-of-airfoil-weight-and-strength/.
Hydrofoil Systems, D&D Fabrication, dated 2004, http://www.ddfabrication.com/hydrofoil.htm.
Image of Transom Mounted Foil, retrieved from Internet, available as early as Mar. 26, 2020.
Image of Foil, retrieved from Internet, available as early as Mar. 26, 2020.

(56) References Cited

OTHER PUBLICATIONS

Andrew Noyce, Grismont Leads French Revolution in 3D Golf Club Design, dated Feb. 26, 2016, https://www.golfalot.com/equipment-news/grismont-driving-irons-3509.aspx.

* cited by examiner

WATER SPORTS BOAT WITH FOIL DISPLACEMENT SYSTEM

CROSS REFERENCE TO RELATED APPLICATIONS

This application claims priority to U.S. Provisional Patent Application No. 62/830,241, filed Apr. 5, 2019, which is incorporated herein by reference in its entirety. Any and all applications, if any, for which a foreign or domestic priority claim is identified in the Application Data Sheet of the present application are hereby incorporated by reference under 37 CFR 1.57. This application is related to U.S. patent application Ser. No. 16/840,224, entitled Control System for Water Sports Boat with Foil Displacement System, filed Apr. 3, 2020, which is incorporated herein by reference in its entirety.

FIELD

The present application relates generally to methods, apparatuses, and systems for displacing water with a power boat and, more particularly, to a foil displacement system that can enable a water-sports boat to displace water for boating activities, such as wake surfing, wake boarding, etc. Additionally, the foil displacement system creates down forces that may advantageously enhance or replace traditional internal and/or external ballast systems. In some embodiments, the foil displacement system creates lifting forces to stabilize the boat during rough conditions, assist in a hole shot, and/or improve fuel efficiency.

BACKGROUND

Wake surfing is a water sport in which a rider surfs the wake created behind a water-sports boat. The rider typically starts in the water and is pulled up into position on a surfboard with a tow rope. Once positioned on the wake, the rider rides the steep face below the wave's peak, similar to traditional surfing on an ocean wave.

The deeper the water-sports boat is in the water, the more water is displaced and the bigger the wake. Bigger wakes can make wake surfing more enjoyable. Water-sport boats typically use a ballast tank system to weigh down the water-sports boat deeper into the water to create bigger wakes. Ballast tanks can be filled and emptied with water to varying levels to create wakes of varying sizes and configurations. More sophisticated tanks may attempt to move water from one side to another to level or lift the boat or even balance uneven people or other ballast.

SUMMARY

The U.S., particularly Western states, have seen a rise in invasive aquatic organisms in inland bodies of water. Many state governments, administrative agencies or water control boards are seeking and have sought to enact strict laws and regulations that try to limit or slow the spread of these invasive species from one lake to another. Some of these governmental groups allege that water sports boats create a unique problem. That is, it is often very problematic to ensure that the ballast systems on water sports boats are entirely drained of water as such boats are moved from one lake to another. The governmental groups allege larva could survive in almost empty water ballast tanks, and when those tanks are reloaded and redrained at a new site, that larva can be transferred from the tanks to the new lake. Thus, such governmental groups are moving to ban water sports boats with ballast systems from certain waterways.

Various embodiments of a foil displacement system are described herein. In some embodiments, a water-sports boat (power boat, watercraft, boat) includes a foil displacement system that can enable the water-sports boat to displace water to create wakes of varying sizes and configurations. The foil displacement system can instantaneously change the effective weight of the water-sports boat to selectively displace more or less water. The foil displacement systems can be used independently from or in conjunction with a ballast tank system or other displacement system. In some embodiments, the foil displacement system can replace a ballast tank system. Additionally, ballast tanks can often take considerable time to fill, empty, and/or adjust. In some embodiments, the foil displacement systems disclosed herein can advantageously be quickly deployed, stowed, and/or adjusted to immediately shape wakes of varying sizes and configurations without needing to pump water in or out of a tank, or move water from one side tank to the other.

In some embodiments, the foil displacement system can include one or more foils that are positioned within the water and at an angle of attack that can create a downward force upon forward movement of the water-sports boat. The downward force can be sufficient to pull a hull of the water-sports boat down into the water to displace a sufficient quantity of water to create a wake suitable for wake surfing. In some embodiments, the angle of attack of the one or more foils can be adjusted to displace varying quantities of water to create wakes of varying sizes. In some embodiments, the foils can be static, move forward and aft, rotate, and/or move up and down. In some embodiments, multiple foils can be employed that can have varying angles of attack. This can advantageously enable a side of the water sports boat to be pulled downward to a depth that is deeper than an opposing side, causing the hull to lift, which can create larger wakes.

In some embodiments, the one or more foils can be deployed and stowed, which can advantageously enable the water-sports boat to be loaded onto a trailer and/or navigate shallow water. In some embodiments, the one or more foils can be deployed and stowed manually and/or automatically. In some embodiments, the one or more foils can be fixedly deployed. In some embodiments, the angle of attack of the one or more foils can be altered manually and/or automatically to create downward and/or lifting force. In some embodiments, the angle of attack of the one or more foils is fixed.

In some embodiments, the foil displacement system can be used to create wakes suitable for wake boarding, as described herein. In some embodiments, the foil displacement system can be used to minimize wakes, which can be desirable for waterskiing. In some embodiments, the foil displacement system can lift, and/or cause lifting forces or uplift on the hull to minimize hull contact to improve speed and/or fuel economy, and/or stabilize the ride in rough water or wind conditions. In some embodiments, the foil displacement system can improve stability, which can include correcting pitch, yaw, and/or roll. In some embodiments, the foil displacement system can prevent excessive bow rise, which can be problematic during acceleration. In some embodiments, the foil displacement system can prevent excessive bow fall, which can be problematic during deceleration. In some embodiments, the foil displacement system can enable the water-sports boat to quickly plane.

A water sports boat including foils configured to be deployed in water, wherein movement of the boat with respect to water causes the foils in certain positions to exert a down force transmitted to a hull, the water sports boat comprising: a cockpit portion including controls configured to provide a driver operation of the boat; a propulsion system; a hull configured to move through water propelled by the propulsion system responsive to ones of the controls operated by the driver, the hull configured to displace a quantity of water and create a wake in the water trailing the moving boat; a forward foil assembly including a forward foil and a forward spar, the forward foil assembly positioning the forward foil, when deployed, forward of a transverse axis at a center of gravity of the boat, the forward foil, when deployed at a downforce angle of attack, also configured to exert a first down force through the forward spar to the hull of the boat as the hull moves through water; a port aft foil assembly including a port aft foil and a port aft spar, the port aft foil assembly positioning the port aft foil, when deployed, port of a longitudinal axis of the boat and aft of the transverse axis, the port aft foil, when deployed at a downforce angle of attack, also configured to exert a second down force through the port aft spar to the hull of the boat as the hull moves through water; a starboard aft foil assembly including a starboard aft foil and a starboard aft spar, the starboard aft foil assembly positioning the starboard aft foil, when deployed, starboard of the longitudinal axis and aft of the transverse axis, the starboard aft foil, when deployed at a downforce angle of attack, also configured to exert a third down force through the port aft spar to the hull of the boat as the hull moves through water, wherein any individual or combination of the first, second and third down forces draw the hull of the boat down into the water to increase the quantity of water displaced and increase a size of the wake; and one or more surf flaps, said one or more surf flaps and said forward foil, said port aft foil, and said starboard aft foil, collectively shape the wake to have one smooth wave face behind and to one side of the boat suited for wake surfing and one distorted wave face behind and to an opposite side of the boat.

Wherein the forward foil includes sections port and starboard of the forward spar that are asymmetrical front to aft, said sections interacting with said water to produce said first down force.

Wherein the port aft foil assembly comprises a T shape foil assembly and wherein said port aft foil includes port aft sections port and starboard of the port aft spar that are asymmetrical front to aft, said port aft sections interacting with said water to produce said second down force, and wherein the starboard aft foil assembly comprises a T shape foil assembly and wherein said starboard aft foil includes starboard aft sections port and starboard of the starboard aft spar that are asymmetrical front to aft, said starboard aft sections interacting with said water to produce said third down force.

Wherein at least one of the forward foil, the port aft foil, and the starboard foil comprise an Eppler 420 foil.

Wherein at least one of the forward foil, the port aft foil, and the starboard foil are dihedral.

The water sports boat comprising: a forward actuator configured to position the forward foil in the deployed position or in a stowed position; a port aft actuator configured to position the port aft foil in the deployed position or in a stowed position; and a starboard aft actuator configured to position the starboard aft foil in the deployed position or in a stowed position, wherein said controls are further configured to actuate said forward actuator, said port aft actuator and said starboard actuator responsive to said driver operation.

Wherein said forward foil, said port aft foil, and said starboard aft foil, collectively shape the wake to have a smooth wave face behind and to one side of the boat and a similarly smooth wave face behind and to an opposite side of the boat, said smooth and similarly smooth wave faces suited for wakeboarding.

A water sports boat including foils configured to be deployed in water, wherein movement of the boat with respect to water causes the foils in certain positions to exert a down force transmitted to a hull, the water sports boat comprising: a cockpit portion including controls configured to provide a driver operation of the boat; a propulsion system; a hull configured to move through water propelled by the propulsion system responsive to ones of the controls operated by the driver, the hull configured to displace a quantity of water and create a wake in the water trailing the moving boat; a forward foil assembly including a forward foil and a forward spar, the forward foil assembly positioning the forward foil, when deployed, forward of a transverse axis at a center of gravity of the boat, the forward foil, when deployed at a downforce angle of attack, also configured to exert a first down force through the forward spar to the hull of the boat as the hull moves through water, wherein the forward foil includes sections port and starboard of the forward spar that are asymmetrical front to aft, said sections interacting with said water to produce said first down force; a port aft foil assembly including a port aft foil and a port aft spar, the port aft foil assembly positioning the port aft foil, when deployed, port of a longitudinal axis of the boat and aft of the transverse axis, the port aft foil, when deployed at a downforce angle of attack, also configured to exert a second down force through the port aft spar to the hull of the boat as the hull moves through water; and a starboard aft foil assembly including a starboard aft foil and a starboard aft spar, the starboard aft foil assembly positioning the starboard aft foil, when deployed, starboard of the longitudinal axis and aft of the transverse axis, the starboard aft foil, when deployed at a downforce angle of attack, also configured to exert a third down force through the port aft spar to the hull of the boat as the hull moves through water, wherein any individual or combination of the first, second and third down forces draw the hull of the boat down into the water to increase the quantity of water displaced and increase a size of the wake.

A water sports boat including foils configured to be deployed in water, wherein movement of the boat with respect to water causes the foils in certain positions to exert a down force transmitted to a hull, the water sports boat comprising: a cockpit portion including controls configured to provide a driver operation of the boat; a propulsion system; a hull configured to move through water propelled by the propulsion system responsive to ones of the controls operated by the driver, the hull configured to displace a quantity of water and create a wake in the water trailing the moving boat; a forward foil assembly including a forward foil and a forward spar, the forward foil assembly positioning the forward foil, when deployed, forward of a transverse axis at a center of gravity of the boat, the forward foil, when deployed at a downforce angle of attack, also configured to exert a first down force through the forward spar to the hull of the boat as the hull moves through water; a port aft foil assembly including a port aft foil and a port aft spar, the port aft foil assembly positioning the port aft foil, when deployed, port of a longitudinal axis of the boat and aft of the transverse axis, the port aft foil, when deployed at a downforce angle of attack, also configured to exert a second down force through the port aft spar to the hull of the boat as the hull moves through water; and a starboard aft foil assembly including a starboard aft foil and a starboard aft spar, the starboard aft foil assembly positioning the starboard aft foil, when deployed, starboard of the longitudinal axis and aft of the transverse axis, the starboard aft foil, when deployed at a downforce angle of attack, also configured to exert a third down force through the port aft spar to the hull of the boat as the hull moves through water, wherein any individual or combination of the first, second and third down forces draw the hull of the boat down into the water to increase the quantity of water displaced and increase a size of the wake; wherein at least one of the forward foil, the port aft foil, and the starboard foil are dihedral.

A water sports boat including foils configured to be deployed in water, wherein movement of the boat with respect to water causes the foils in certain positions to exert a down force transmitted to a hull, the water sports boat comprising: a cockpit portion including controls configured to provide a driver operation of the boat; a propulsion system; a hull configured to move through water propelled by the propulsion system responsive to ones of the controls operated by the driver, the hull configured to displace a quantity of water and create a wake in the water trailing the moving boat; a forward foil assembly including a forward foil and a forward spar, the forward foil assembly positioning the forward foil, when deployed, forward of a transverse axis at a center of gravity of the boat, the forward foil, when deployed at a downforce angle of attack, also configured to exert a first down force through the forward spar to the hull of the boat as the hull moves through water; a port aft foil assembly including a port aft foil and a port aft spar, the port aft foil assembly positioning the port aft foil, when deployed, port of a longitudinal axis of the boat and aft of the transverse axis, the port aft foil, when deployed at a downforce angle of attack, also configured to exert a second down force through the port aft spar to the hull of the boat as the hull moves through water; a starboard aft foil assembly including a starboard aft foil and a starboard aft spar, the starboard aft foil assembly positioning the starboard aft foil, when deployed, starboard of the longitudinal axis and aft of the transverse axis, the starboard aft foil, when deployed at a downforce angle of attack, also configured to exert a third down force through the port aft spar to the hull of the boat as the hull moves through water, wherein any individual or combination of the first, second and third down forces draw the hull of the boat down into the water to increase the quantity of water displaced and increase a size of the wake; a forward actuator configured to position the forward foil in the deployed position or in a stowed position; a port aft actuator configured to position the port aft foil in the deployed position or in a stowed position; and a starboard aft actuator configured to position the starboard aft foil in the deployed position or in a stowed position, wherein said controls are further configured to actuate said forward actuator, said port aft actuator and said starboard actuator responsive to said driver operation.

Wherein the forward foil includes sections port and starboard of the forward spar that are asymmetrical front to aft, said sections interacting with said water to produce said first down force.

Wherein the port aft foil assembly comprises a T shape foil assembly and wherein said port aft foil includes port aft sections port and starboard of the port aft spar that are asymmetrical front to aft, said port aft sections interacting with said water to produce said second down force, and wherein the starboard aft foil assembly comprises a T shape foil assembly and wherein said starboard aft foil includes starboard aft sections port and starboard of the starboard aft spar that are asymmetrical front to aft, said starboard aft sections interacting with said water to produce said third down force.

Wherein at least one of the forward foil, the port aft foil, and the starboard foil comprise an Eppler 420 foil.

Wherein at least one of the forward foil, the port aft foil, and the starboard foil are dihedral.

Wherein said forward foil, said port aft foil, and said starboard aft foil, collectively shape the wake to have a smooth wave face behind and to one side of the boat and a similarly smooth wave face behind and to an opposite side of the boat, said smooth and similarly smooth wave faces suited for wakeboarding.

The water sports boat comprising one or more surf flaps, said one or more surf flaps and said forward foil, said port aft foil, and said starboard aft foil, collectively shape the wake to have one smooth wave face behind and to one side of the boat suited for wake surfing and one distorted wave face behind and to an opposite side of the boat.

Wherein the forward actuator is configured to change a forward angle of attack of said forward foil, the port aft actuator is configured to change a port aft angle of attack of said port aft foil, and the starboard aft actuator is configured to change a starboard aft angle of attack of said starboard aft foil.

Wherein said port aft angle of attack is different from said starboard aft angle of attack. Wherein said forward angle of attack is between about -25 degrees and about 5 degrees.

Wherein said port aft angle of attack is between about -20 and about 10 degrees, and said starboard angle of attack is between about -20 and about 10 degrees.

Wherein said forward angle of attack, said port aft angle of attack, and said starboard aft angle of attack, collectively produce a collective neutral down force.

The water sports boat comprising a deck above the hull, wherein the stowed position of the forward foil comprises the forward foil vertically maneuvered toward the deck, the stowed position of the port aft foil comprises the port aft foil vertically maneuvered toward the deck, and the stowed position of the starboard aft foil comprises the starboard aft foil vertically maneuvered toward the deck.

Wherein the stowed position of the forward foil comprises at least a portion of the forward foil vertically maneuvered above the hull and below the deck, the stowed position of the port aft foil comprises at least a portion of the port aft foil vertically maneuvered above the hull and below the deck, and the stowed position of the starboard aft foil comprises at least a portion of the starboard aft foil vertically maneuvered above the hull and below the deck.

The water sports boat comprising one or more surf flaps, said one or more surf flaps and said forward foil, said port aft foil, and said starboard aft foil, collectively shape the wake to have one smooth wave face behind and to one side of the boat suited for wake surfing and one distorted wave face behind and to an opposite side of the boat.

Wherein said forward foil, said port aft foil, and said starboard aft foil, collectively shape the wake to have a smooth wave face behind and to one side of the boat and a similarly smooth wave face behind and to an opposite side of the boat, said smooth and similarly smooth wave faces suited for wakeboarding.

BRIEF DESCRIPTION OF THE DRAWINGS

Various embodiments are depicted in the accompanying drawings for illustrative purposes and may not be drawn to scale, and should in no way be interpreted as limiting the scope of the embodiments. In addition, various features of different disclosed embodiments can be combined to form additional embodiments, which are part of this disclosure.

FIG. 42EE shows a black and white photograph of the subject matter of FIG. 42E.

DETAILED DESCRIPTION

Although certain embodiments and examples are described below, this disclosure extends beyond the specifically disclosed embodiments and/or uses and obvious modifications and equivalents thereof. Thus, it is intended that the scope of this disclosure should not be limited by any particular embodiments described below.

Figure 1A:
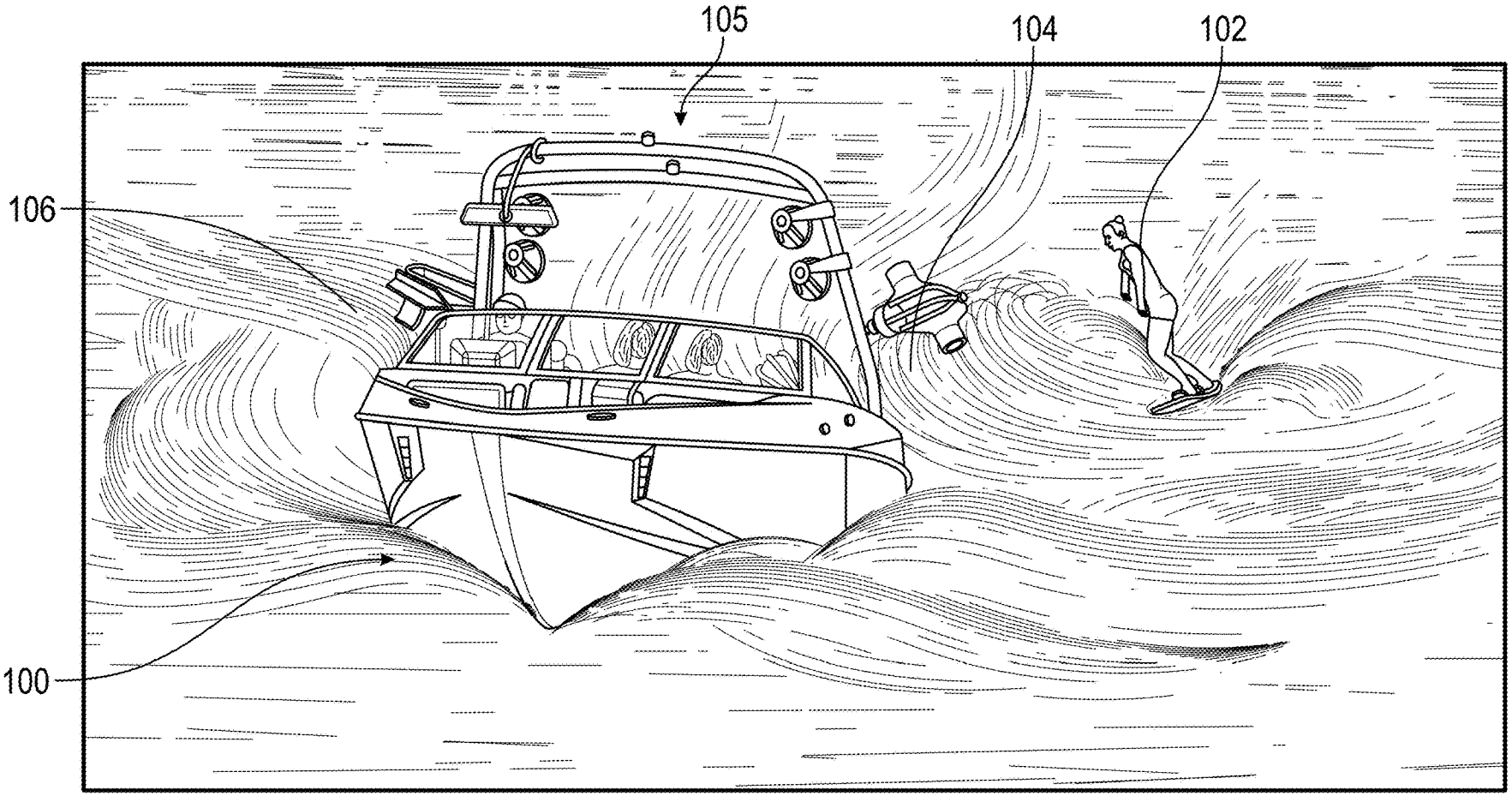
FIGS. 1A, 1B, and 1C illustrate an example water-sports boat with a rider wake surfing.
Figure 1B:
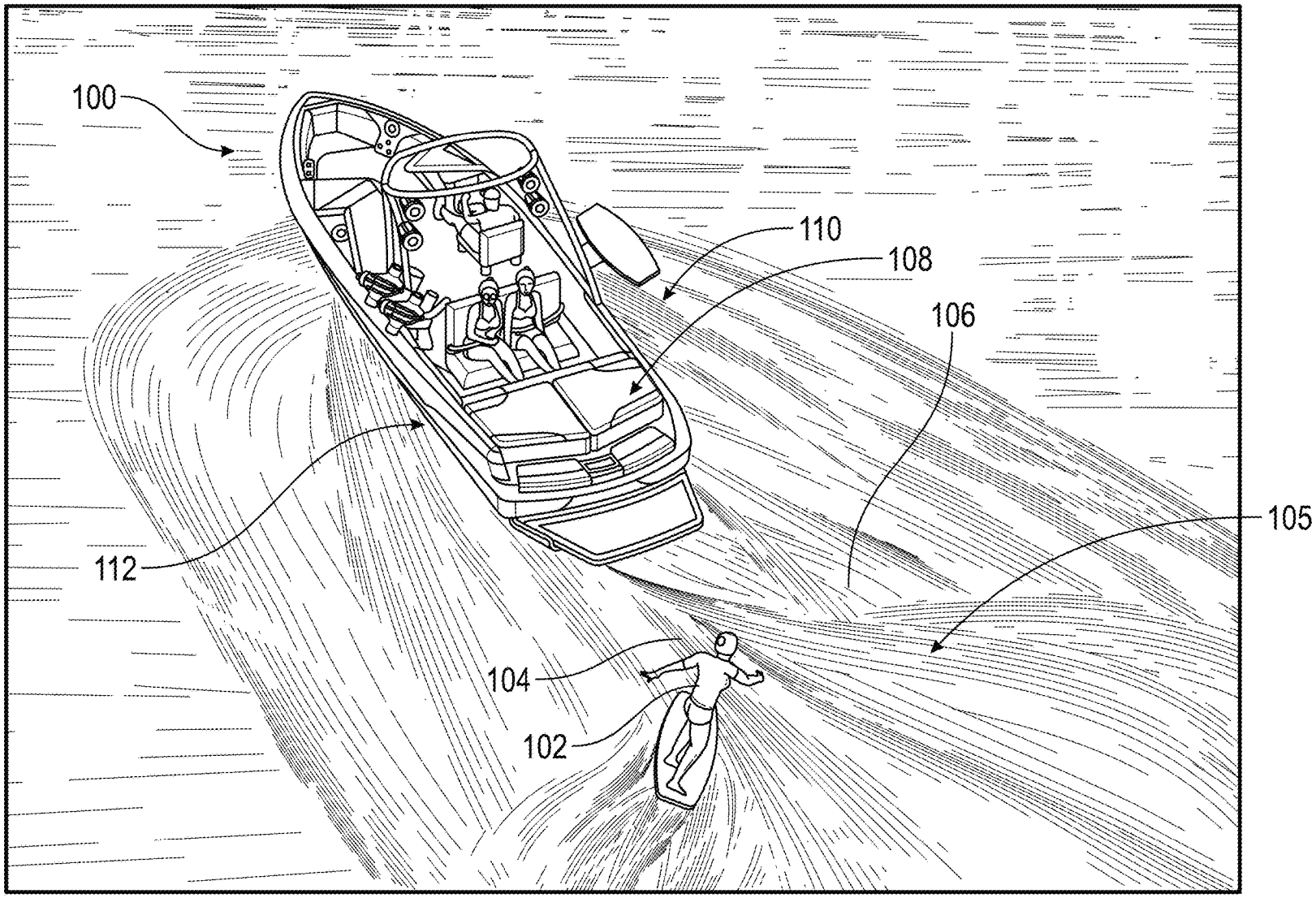
Figure 1C:
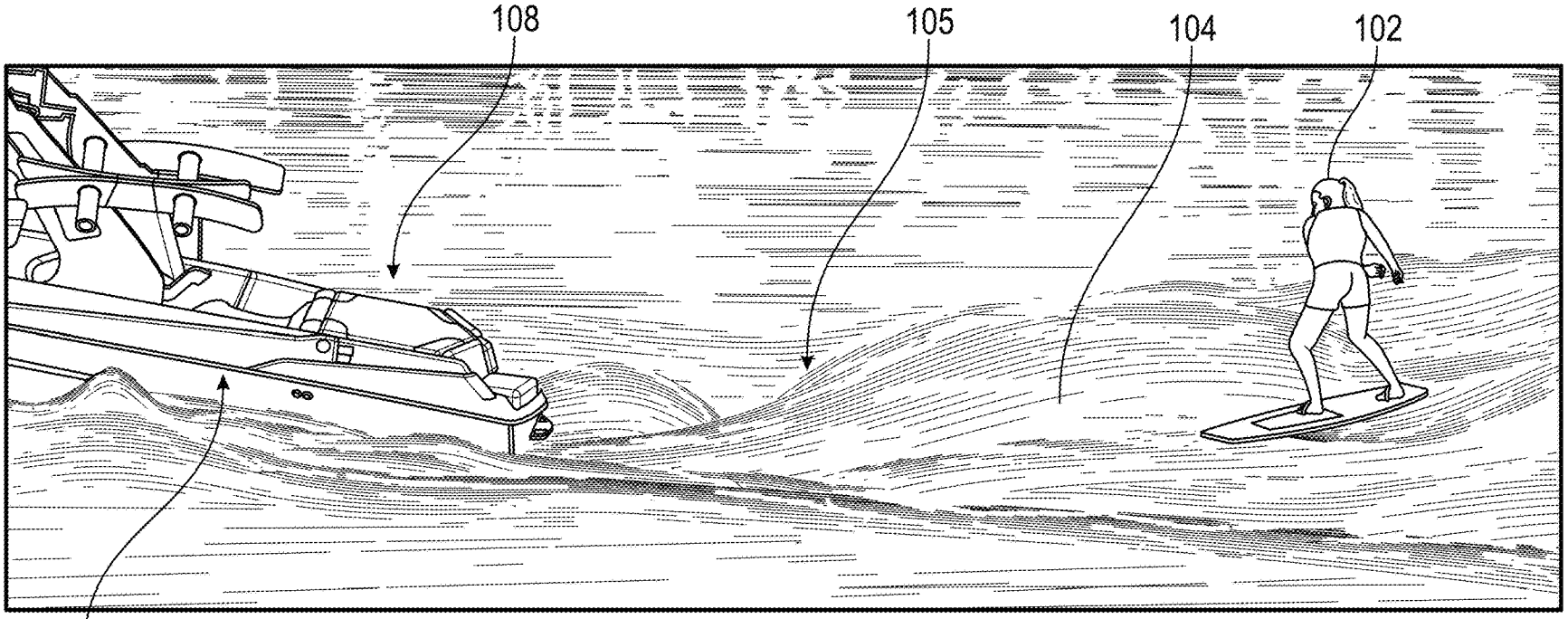

FIGS. 1A-1C illustrate an example water-sports boat (e.g., power boat, watercraft, boat) 100 in use. The water-sports boat 100, as illustrated, is being used to create a wake 105 that can be surfed by the rider 102 without the continued assistance of a tow rope. As the water-sports boat 100 travels through water, the water-sports boat 100 displaces water and thus generates waves including a bow wave and diverging stern waves on both sides of the water-sports boat 100. Due to pressure differences, these waves generally converge in the hollow formed behind the traveling water-sports boat 100 to form the wake 105. The wake 105 can be formed away from the stern 108 of the water-sports boat 100 to distance the rider 102 from the water-sports boat 100 while surfing.

The wake 105 is typically asymmetrical for wake surfing. Preferably, one side of the water-sports boat 100, a port side 112 or starboard side 110, is lower in the water to form a suitable wave form for surfing in the wake 105. For example, as illustrated in FIG. 1B, the port side 112 is deeper in the water than the starboard side 110, forming a port-side portion 104 of the wake 105 into a steep wave that can be surfed. Lowering the port side 112 of the water-sports boat 100, especially at the stern 108, displaces more water on the port side 112 to form a larger and/or smoother wave for surfing on the port-side portion 104 of the wake 105. This is illustrated in FIG. 1B with the port-side portion 104 of the wake 105 being larger and smoother (e.g., more preferable for surfing) than the smaller and turbulent starboard-side portion 106. The lowered side of the water-sports boat 100 can be switched, such that starboard side 110 is lower in the water than the port side 112 to form a suitable wave form on the starboard-side portion 106 of the wake 105.

Figure 2A:
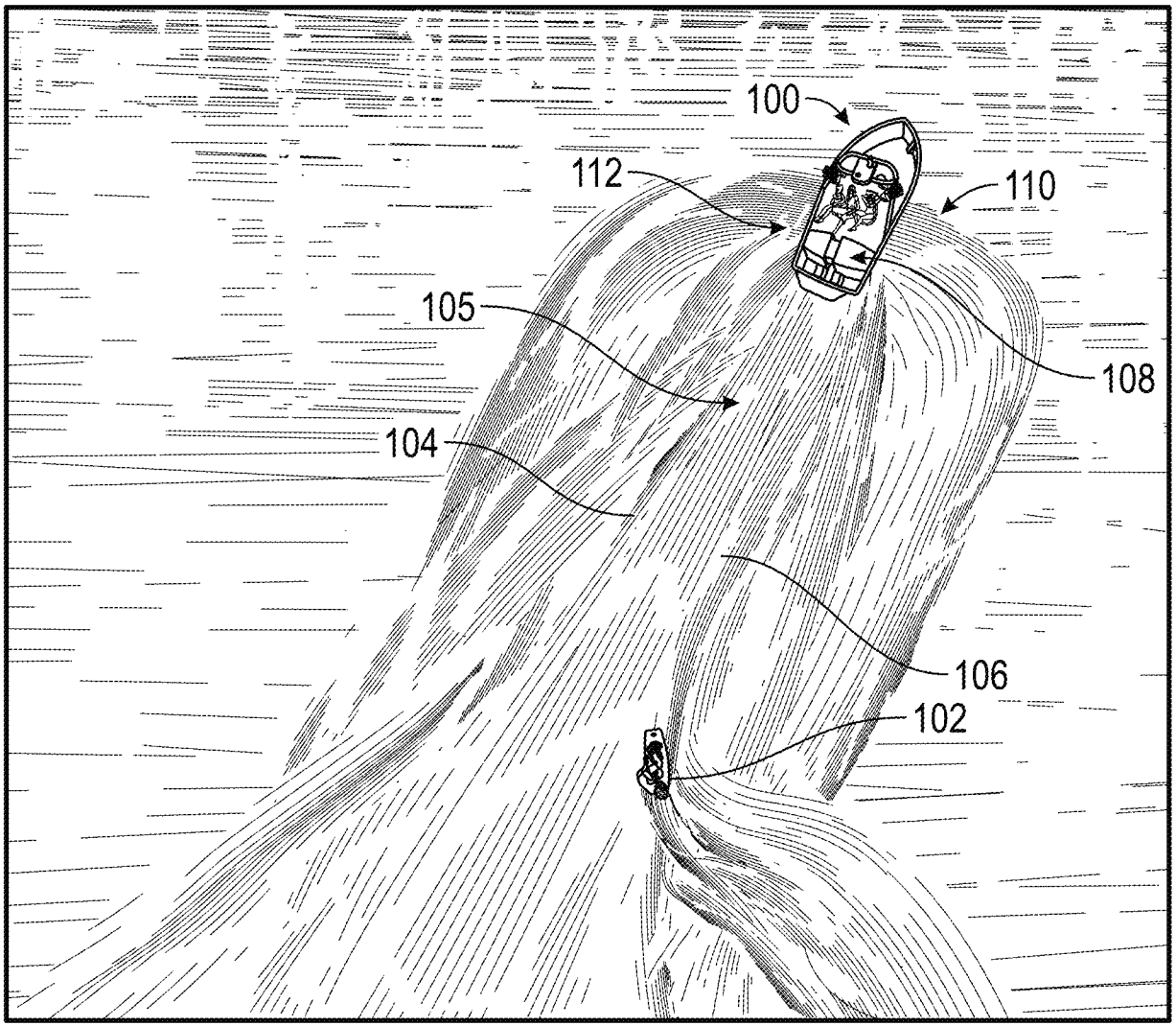
FIGS. 2A, 2B, and 2C illustrate an example water-sports boat with a rider wake boarding.
Figure 2B:
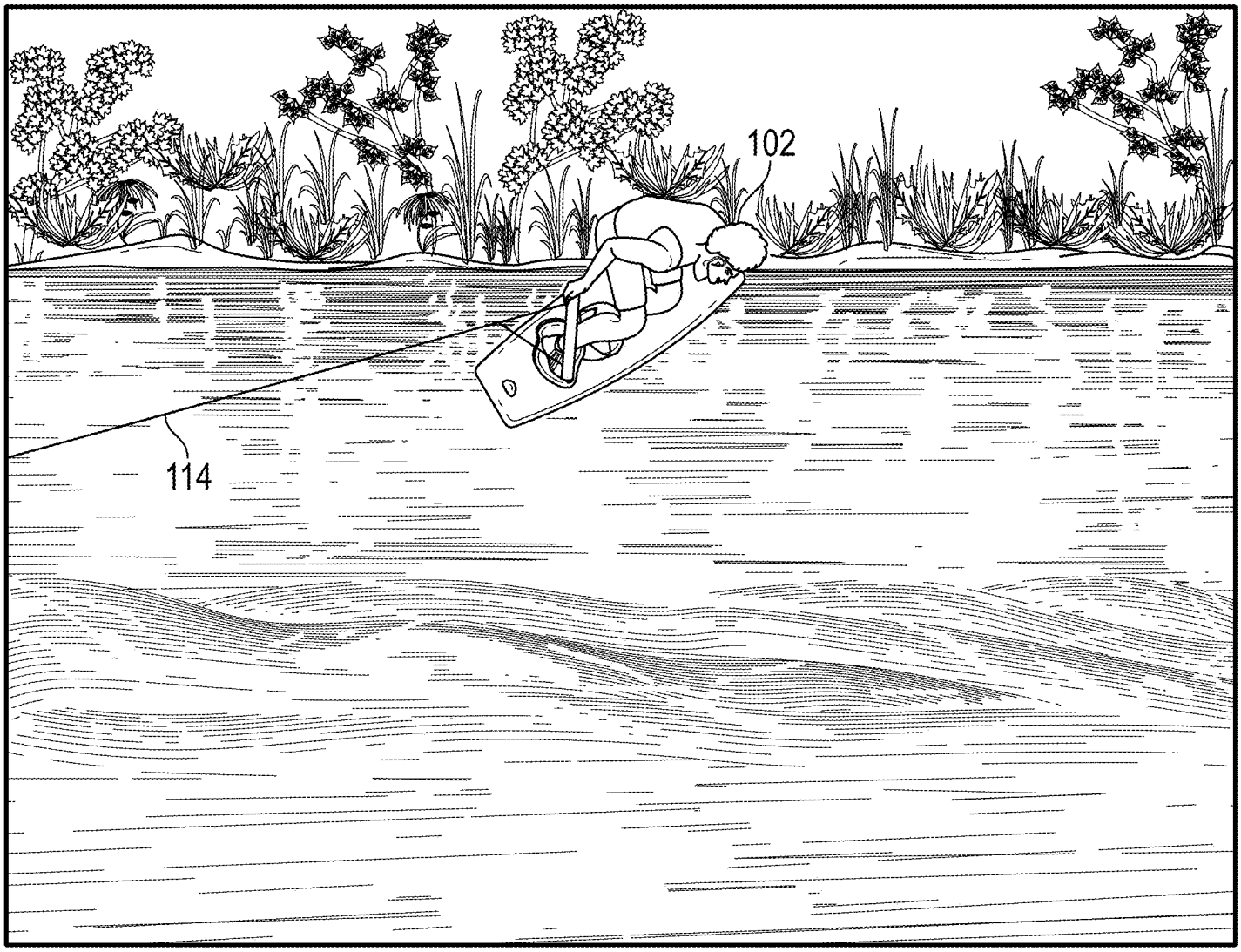
Figure 2C:
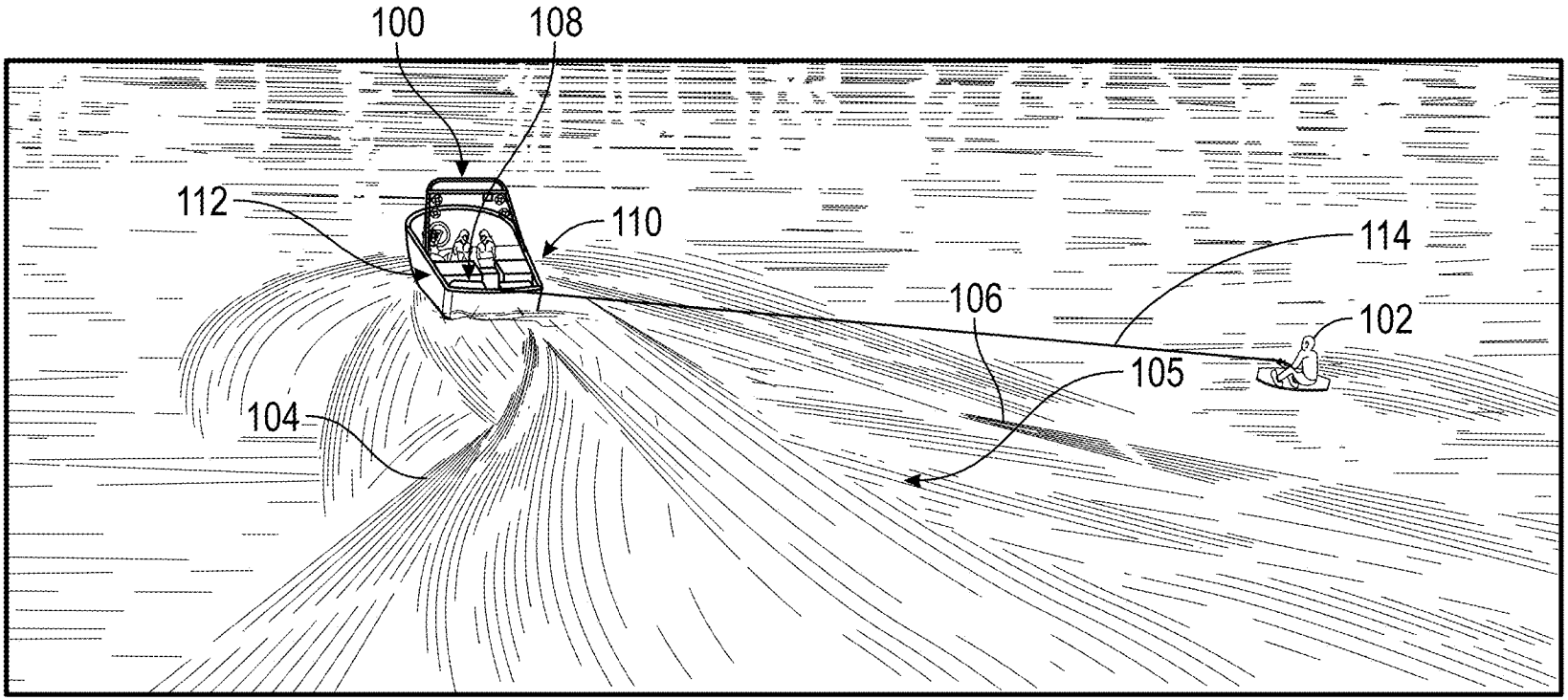

FIGS. 2A-2C illustrate the water-sports boat 100 being used to tow the rider 102 while wake boarding. The water-sports boat 100 typically travels at a faster speed for wake boarding compared to wake surfing. In contrast to wake surfing, the rider 102 is continuously pulled by a tow rope 114 that is coupled to the water-sports boat 100.

Different wake configurations are typically desired for wake boarding compared to wake surfing. The wake 105, as illustrated in FIGS. 2A and 2C is generally symmetrical, such that the port-side portion 104 and the starboard-side portion 106 are similarly shaped and sized as the water-sports boat 100 moves forward in a straight line but other configurations are possible depending on rider preference. The port side 112 and starboard side 110 of the stern 108, as illustrated, are equally deep within the water, such that generally equal quantities of water are displaced on the port side 112 and the starboard side 110. The stern 108 can be lowered or raised depending on the desired size of the wake 105—a lower stern 108 creating a larger wake 105 and a higher stern 108 creating a smaller wake 105.

In general, the wake 105 is less steep for wake boarding than for wake surfing, which can be suitable for crossing the wake 105 and/or jumping as described below. The wake 105 can be generally smaller for wake boarding than wake surfing (e.g., having a lower peak height) to enable the rider 102 to more easily cross the wake 105 from the port side 104 to the starboard side 106. Often, a front face of a wake for a wakeboarder can be shaped to range from a somewhat linear to a steep exponential ramp. The rider 102 can even use the wake 105 to jump into the air when crossing from one side to the other. For example, as illustrated in FIG. 2C, the rider 102 can start on one side of the wake 105, such as the starboard side 110, and ride toward the starboard portion 106 of the wake 105. The rider 102 can use the starboard-side portion 106 of the wake 105 as a ramp to leap into the air, as shown in FIG. 2B. The rider 102 can use the port-side portion 104 of the wake 105 as a landing ramp when leaping from the starboard-side portion 106.

Different wake configurations can be desired for other water sports or activities, such as water skiing, towing inflatables, etc. Different wakes can also be desired based on rider preferences. Accordingly, adjusting the quantity and location of water displaced by the water-sports boat 100 can be important for enjoying a variety of water sports or activities.

Figure 3:
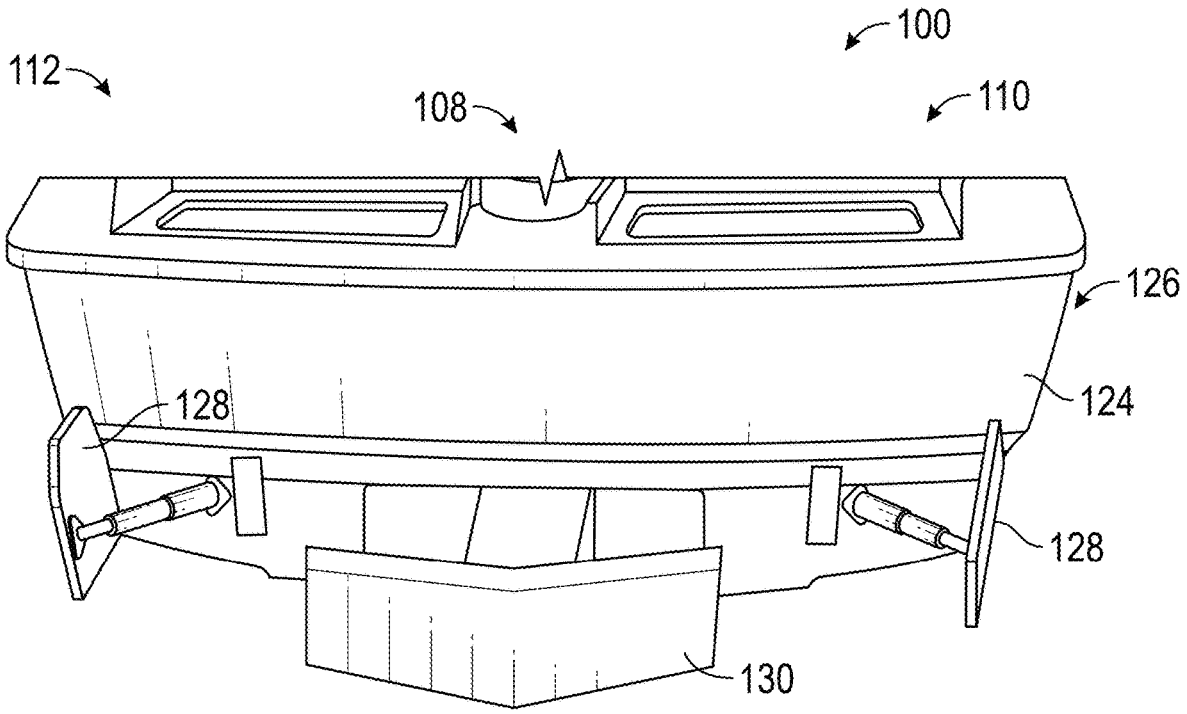
FIG. 3 illustrates a wedge and wake shaping apparatuses on a water-sports boat.

The water-sport boats 100 can include one or more wake modify features, as illustrated in FIG. 3. The water-sports boat 100 can include a surf wake system 126 for modifying the wake 105 formed by the water-sports boat 100 travelling through water. The surf wake system 126 can include one or more water diverters (wake/wave shaper(s), flap(s), tab(s)) 128 that can be mounted, which can include adjustably mounted, to the water-sports boat 100 for deflecting water travelling past the transom 124 of the water-sports boat 100 to shape a wake for surfing. One such device is commercially available from Malibu Boats, LLC of Louden, Tenn., under the product name "SURF GATE®," which is similar to those flaps described in U.S. Pat. No. 9,260,161, the entire content of which is incorporated herein. Other commercially available surf shapers include tabs or blades manually operated, electronically controlled, suction or bolt-on adherement devices, and the like.

The water-sports boat 100 can include a wake-modifying device (wedge) 130 to enhance the overall size of the wake formed by the watercraft. One such device is commercially available from Malibu Boats, under the product name, "Power Wedge," which is similar to that described in U.S. Pat. No. 7,140,318, the entire content of which is incorporated herein for all purposes by this reference. Another such device may incorporate pivotal centerline fins of the type developed by Malibu Boats and described in U.S. Pat. No. 8,534,214, the entire content of which is also incorporated herein for all purposes by this reference.

Figure 4:
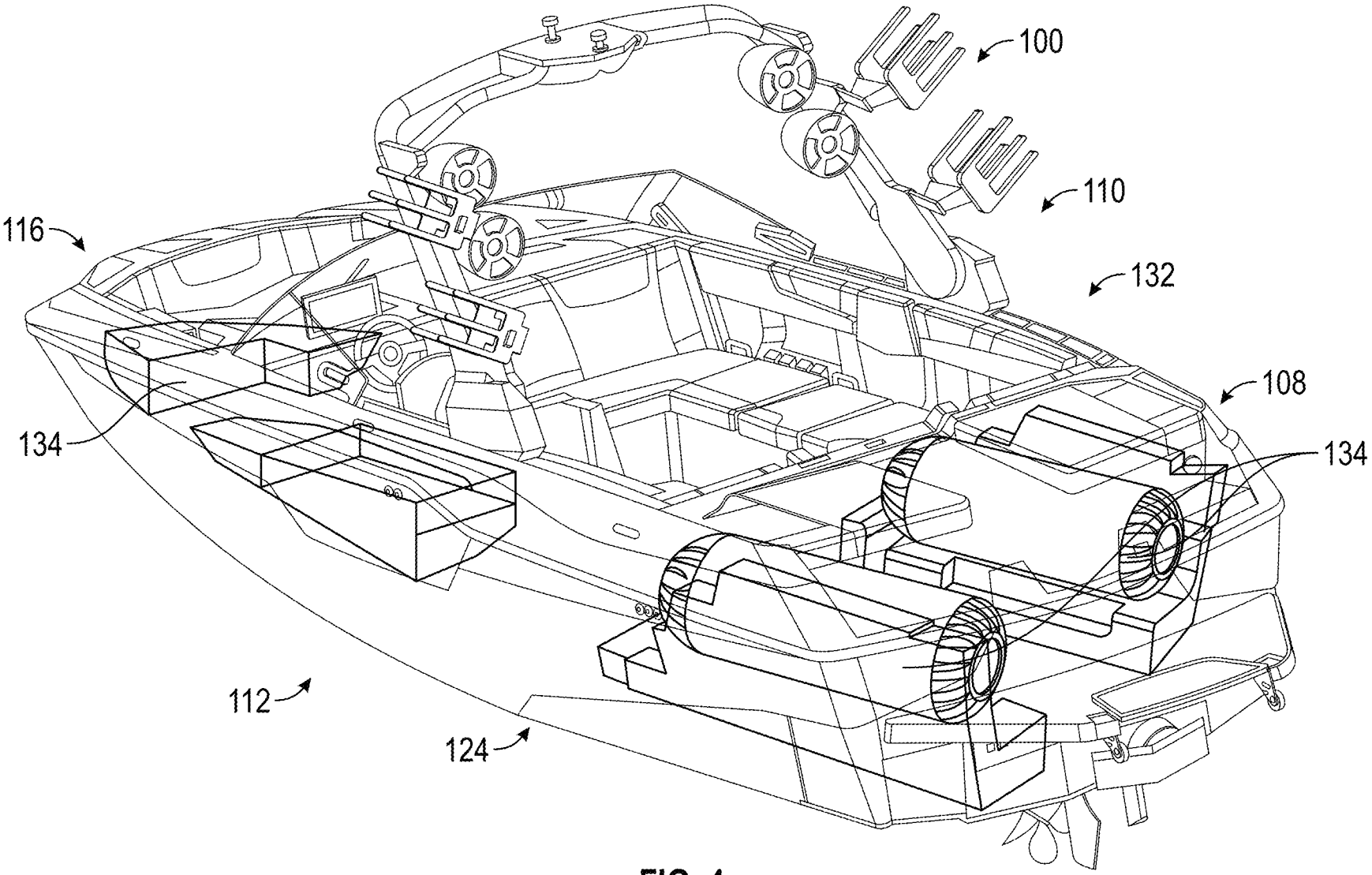
FIG. 4 illustrates an example ballast tank system.

The one or more water diverters 128 and wake-modifying device 130 can modify the configuration of a wake, such as the shape and/or size. However, the one or more water diverters 128 and wake modifying device 130 are often used with a ballast tank system to produce wakes of a greater size. As described above, ballast tank systems utilize tanks that can fill and empty to selectively increase the weight of the water-sports boat 100 to produce wakes of greater size and/or different configurations. As illustrated in FIG. 4, a ballast tank system 132 can include one or more tanks 134 of varying sizes and locations. For example, the ballast tank system 132 can include one or more tanks 134 positioned proximate the bow 116, which can be used to lower the hull 124 and/or lower the bow 116. The ballast tank system 132 can include one or more starboard tanks 134 positioned proximate the stern 108 and on the starboard side 110 and one or more tanks port tanks 134 positioned proximate the stern 108 and on the port side 112. In addition to typical internal tanks, one or more positionable bags, plug-and-play ballast systems, or other weighting devices may be used. The starboard tank 134 and port tank 134 can be filled with different quantities of water to weigh down the port side 112 and/or starboard side 110 to produce larger waves on the port side 112 and/or starboard side 110. In some embodiments, water can be pumped between the port side 112 and/or starboard side 110 to selectively weigh down the port side 112 and/or starboard side 110. As described above, filling and emptying the tank(s) 134 can be problematic due to the invasive species concerns above. Filing, emptying, and distributing water between tanks 134 can also be a slow process, often 2-10 mins. or more, wasting active time on the water.

Figure 5:
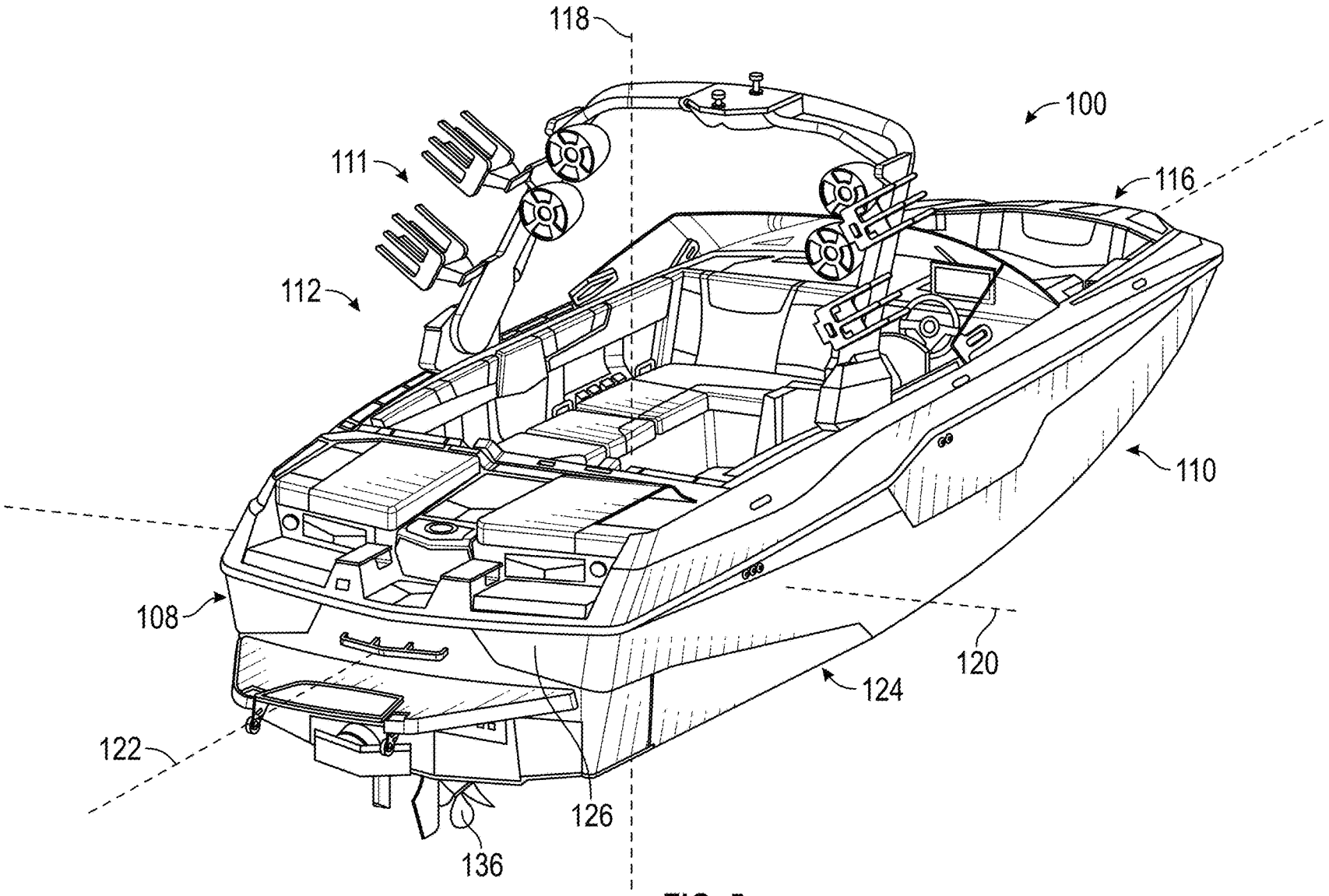
FIG. 5 illustrates a water-sports boat with reference features identified.

FIG. 5 illustrates an enlarged view of a water-sports boat 100 that details various reference points that will be used throughout this disclosure. The water-sports boat 100 includes a bow 116 at the front and a stern 108 at the rear. The direction toward the stern 108 being aft, and the direction toward the bow 116 being forward. The water-sports boat 100 includes a starboard side 110 and port side 112. The water-sports boat 100 includes a hull 124. The water-sports boat 100 includes a transom 126 that forms the termination of the stern 108. The water-sports boat 100 can include a propeller 136. The water-sports boat 100 includes a vertical axis (z axis, yaw axis) 118 that extends through the center of gravity of the water-sports boat 100. Rotation of the water-sports boat 100 about the vertical axis 118 is a yaw motion. Linear movement of the water-sports boat 100 along the vertical axis 118 is a heave motion. The water-sport boat 100 includes a transverse axis (y axis, pitch axis) 120 that extends through the center of gravity of the water-sports boat 100. Rotation of the water-sports boat 100 about the transverse axis 120 is a pitch motion. The water-sports boat 100 includes a longitudinal axis (x axis, roll axis) 122 that extends through the center of gravity of the water-sports boat 100. Rotation of the water-sports boat 100 about the longitudinal axis 122 is a roll motion. The water-sports boat 100 can include a midship 111, being the middle portion of the water-sports boat 100 between the bow 116 and the stern 108.

FIGS. 6A-6D illustrates a water-sports boat 100 with a foil displacement system 138. The foil displacement system 138 can function with or independently from a ballast tank system and/or wake shaping systems, such as those described herein. In some embodiments, the foil displacement system 138 can replace a ballast tank system and/or wake shaping systems.

The foil displacement system 138 can include one or more foils (e.g., hydrofoils) that can create a downward force (e.g., downward suction) upon movement of the water-sports boat 100 through water such that the hull 124 is lowered to displace more water to create a larger wake 105. The foil displacement system 138 can quickly (instantaneously) increase the effective weight of the water-sports boat 100 upon movement thereof. In some embodiments, the one or more foils can create a lifting force upon movement of the water-sports boat 100 through the water such that the hull 124 is raised to displace less water, reduce contact with the water, and/or reduce the size of the wake 105. In some embodiments, the one or more foils can lower the port side 112 or starboard side 110. In some embodiments, the one or more foils can lower and/or raise the bow 116 and/or stern 108. In some embodiments, an angle of attack of the one or more foils can be adjusted to create a downward or lifting force. The foil displacement system 138 can include one, two, three, four, five, or six or more foils.

Figure 6A:
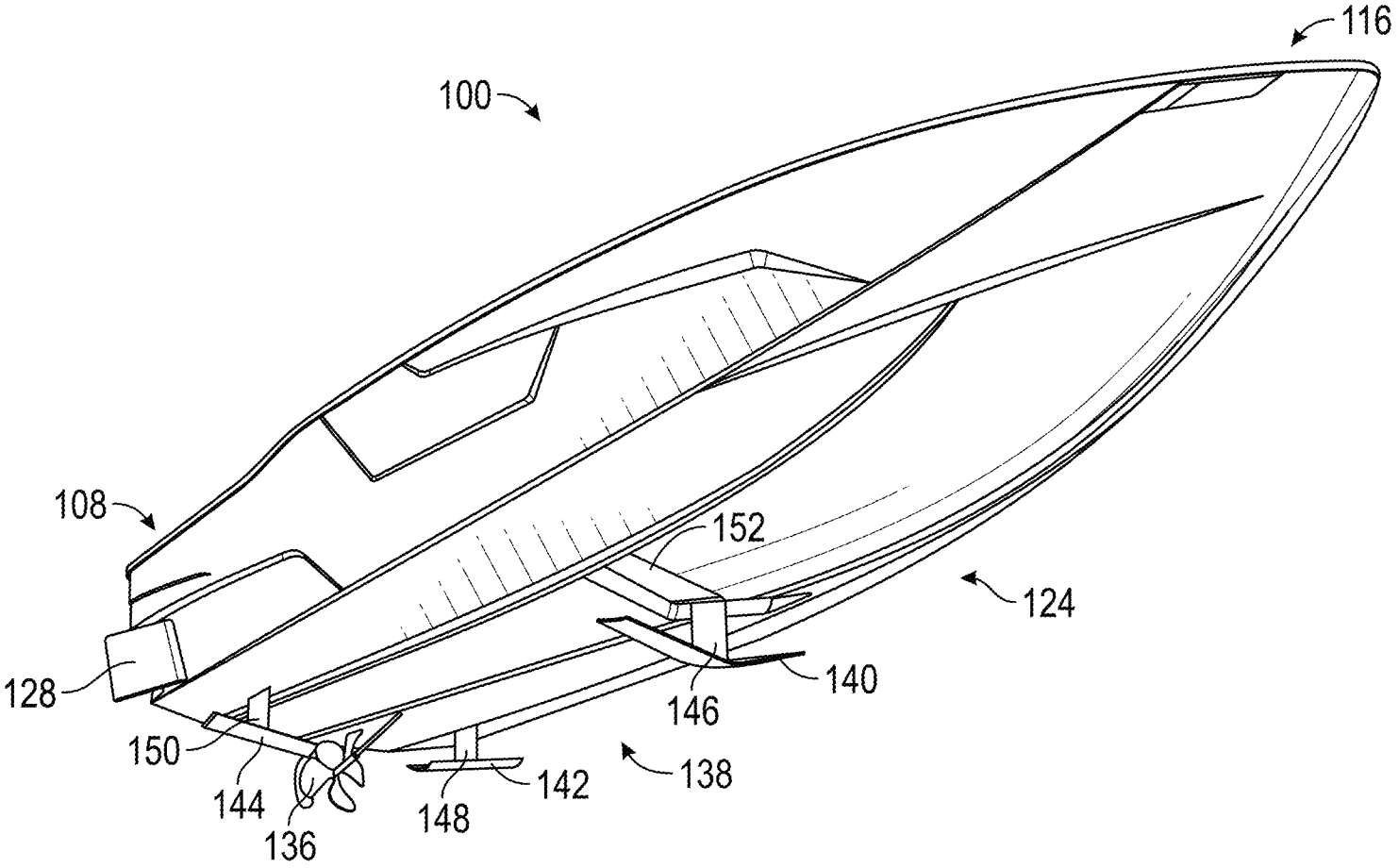
FIGS. 6A-6C illustrate various views of an example water-sports boat.
Figure 6B:
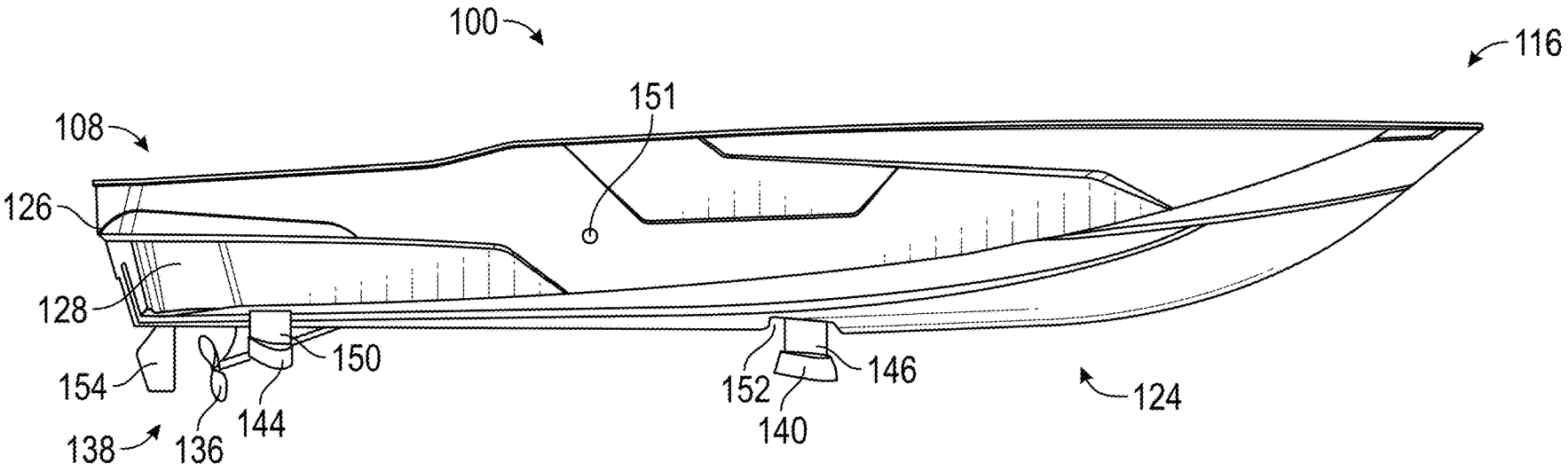
Figure 6C:
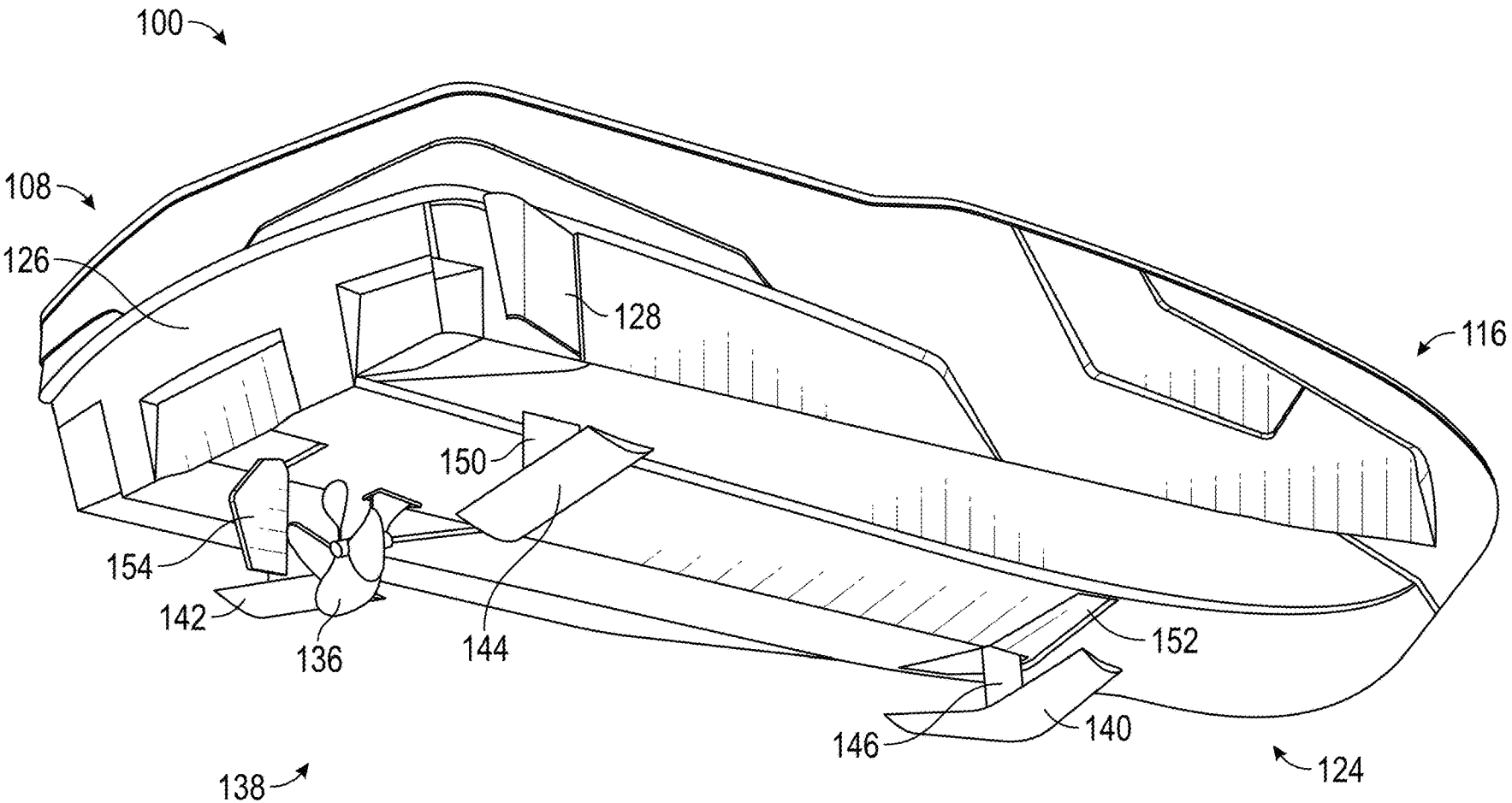

The foil displacement system 138 can include a forward foil (hydrofoil) 140. In some embodiments, the forward foil 140 can be optimized and/or configured for creating downward force. In some embodiments, the forward foil 140 can create a lifting force upon changing an angle of attack. FIGS. 6A-6C illustrate a forward foil 140 that is a National Advisory Committee for Aeronautics (NACA) 4418 foil that is inverted to better facilitate creating a downforce rather than a lift force. In some embodiments, the forward foil 140 can be a modified Eppler 420 foil that is inverted or another foil referenced herein.

As illustrated, the forward foil 140 is in a dihedral configuration. A dihedral configuration can produce a natural roll moment that can be advantageous. The dihedral configuration can provide increased stability. In some embodiments, the dihedral angle of the forward foil 140 can match the local deadrise of the hull 124. Stated differently, the top surface of the forward foil 140 can be parallel with the proximate portion of the hull 124. Matching the dihedral angle of the forward foil 140 with the local deadrise of the hull 124 can enable the forward foil 140 to be positioned within a recess 152 of the hull 124, a bottom surface of the forward foil 140 to be coplanar with the surrounding portion of the hull 124, and/or the forward foil 140 to positioned more proximate the hull 124 without effecting performance of the forward foil 140.

The forward foil 140 is asymmetric front to back and symmetric side to side. The foreword foil 140 and the spar 146 are in a T foil configuration. In some embodiments, the forward edge (leading edge) of the forward foil 140 is swept while the aft edge (trailing edge) is straight. In some embodiments, the chord of the forward foil 140 is tapered, which can reduce vortices that can negatively impact performance of the forward foil 140. In some embodiments, the chord of the foreword foil 140 is smaller in the direction of the starboard side 110 and port side 112. In some embodiments, the forward foil 140 is not tapered, such as when the forward foil 140 is a modified Eppler 420 foil because the modified Eppler 420 foil can be configured to reduce vortices without tapering. It can be desirable to avoid vortices to reduce noise, vibrations, and diminished force production. The forward foil 140 is larger the aft foils 142, 144, described in more detail below. In some embodiments, the forward foil 140 is the same or a smaller size than the aft foils 142, 144. As will be appreciated, many different foil types/shapes can be chosen for the forward foil 140 depending on hull configuration, loading requirements, desired boat speed, desired performance, etc., which can at least include the foils detailed elsewhere herein.

Figure 6D:
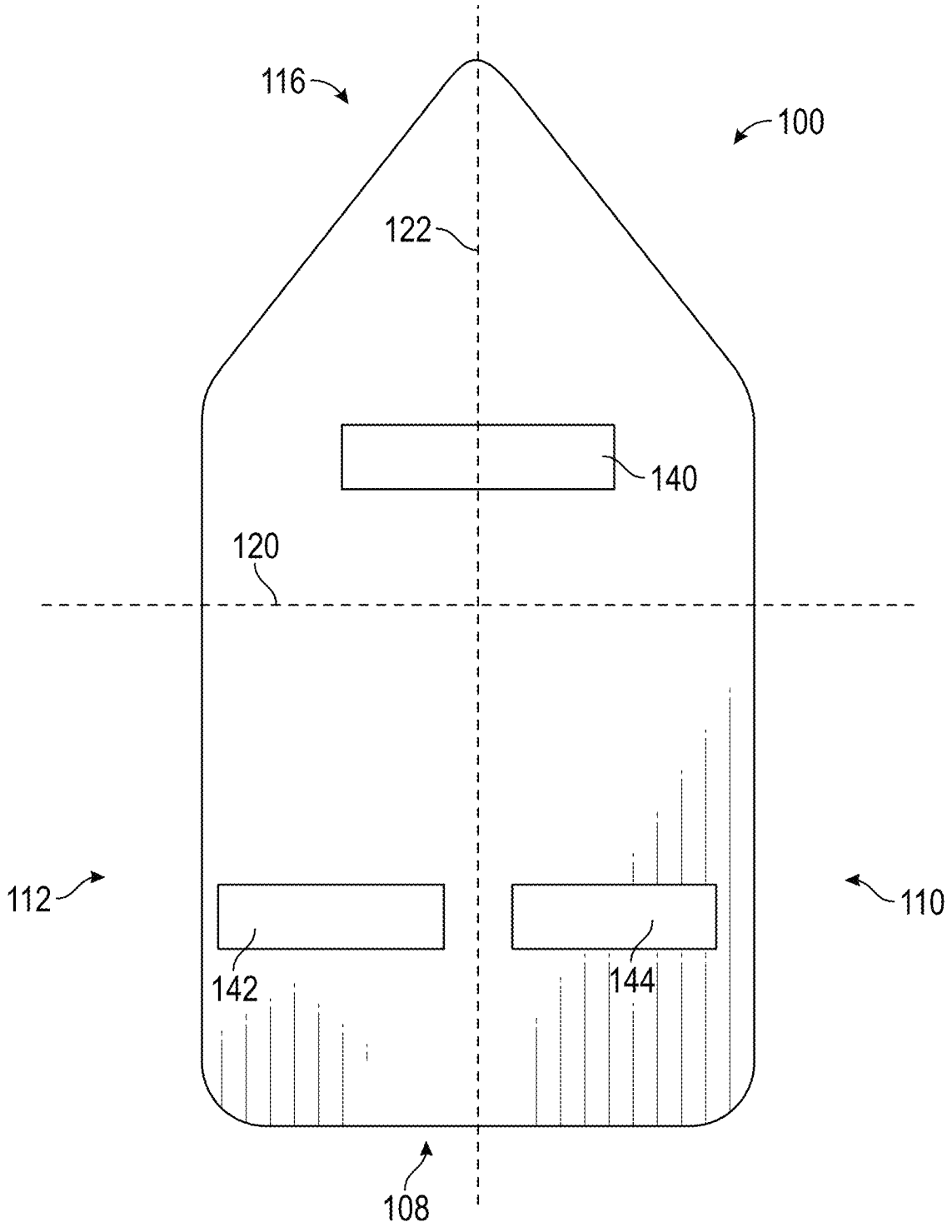
FIG. 6D illustrates various views of an example foil layout.

The forward foil 140 can be centered along the longitudinal axis 122 of the water-sports boat 100, as illustrated in FIG. 6D. Half the forward foil 140 can be disposed on the starboard side 110 of the water-sports boat 100 and the other half of the forward foil 140 can be disposed on the port side 112 of the water-sports boat 100. The forward foil 140 can be positioned forward of the transverse axis 120. The forward foil 140 can provide a downward force (e.g., downward suction force) as the water-sports boat 100 moves through the water, which can lower the hull 124 (e.g., bow 116) deeper into the water. The forward foil 140 can lower the bow 118 to prevent bow rise during acceleration. The forward foil 140 can raise the bow 118 to prevent bow fall during deceleration. In some embodiments, more than one forward foils is used, which can include one, two, three, or four or more foils. When more than one forward foil is used, the forward foils can be evenly distributed relative to the longitudinal axis 122 to balance the water-sports boat 100 for rolling. In some embodiments, however, unequal balancing may be desired and the multiple forward foils are not evenly distributed relative to the longitudinal axis 122. In some embodiments, some forward foils can be configured to provide a lift force while others can be configured to provide a downward force, which can control rolling of the water-sports boat 100 and/or increase a portside portion 104 or starboard side portion 106 of the wake 105.

The forward foil 140 can be a variety of sizes. The size of the forward foil 140 can be influenced by the size, expected travel speed, and/or desired performance of the water-sports boat 100 and/or desired wake 405 configuration. For example, in some embodiments, the forward foil 140 may be 36-40 inches wide (the length in the starboard-to-port direction) for a 20-23 foot length hull. In some embodiments, the forward foil 140 may be less than 33, 33, 34, 35, 36, 37, 38, 39, 40, 41, 42, 43, 44, 45, 46, 47, 48, 49, or 50 or more inches wide or any width between the foregoing values for a 20-23 foot length hull. In some embodiments, the forward foil 140 may be 48-56 inches wide for a hull over 23 feet in length. In some embodiments, the forward foil 140 may be less than 46, 47, 48, 49, 50, 51, 52, 53, 54, 55, 56, 57, 58, 59, 60, 61, 62 or more inches wide or any width between the foregoing values for a hull over 23 feet in length. In some embodiments, the forward foil 140 may be less than 25, 26, 27, 28, 29, 30, 33, 33, 34, or 35 or more inches wide or any width between the foregoing values for a hull length that is less than 20 feet. The size of the forward foil 140 can be influenced by balancing the forces created by the forward and aft foils to prevent and/or reduce porpoising or other dynamic instabilities. In some embodiments, the forward foil 140 is equal or similar to the combined width of the aft foils 142, 144. In some embodiments, the forward foil 140 is less than 75%, 80%, 85%, 90%, 95%, 100%, or greater than 100% of the combined width of the aft foils 142, 144. The size of the forward foil 140 can be influenced by the type or shape of foil used. For example, a more symmetrical foil would need to be larger than an optimized a-symmetrical foil to produce the same force.

The forward foil 140 can be connected, which can include coupled, to a spar (support, rod, pole, leg) 146. The spar 146 can distance the forward foil 140 away from the hull 124. In some embodiments, the forward foil 140 is removably coupled to the spar 146, which can include being bolted together. In some embodiments, the forward foil 140 and the spar 146 are fixedly connected, which can include being welded or adhered together. In some embodiments, the forward foil 140 and the spar 146 are monolithically formed. In some embodiments, more than one spar 146 distances the forward foil 140 away from the hull 124.

The spar 146 can have a uniform cross-section or a variable cross-section. In some embodiments, the portion of the spar 146 that contacts water can have a uniform cross-section. The spar 146 can have a cross-section that this tapered in the forward-to-aft direction. The spar 146 can have a cross-section that is a tear drop shape or elongate tear drop shape. The spar 146 can have a cross-section that is oblong, oval, circular, polygonal, irregular, a tube, box tube, and/or other shapes. In some embodiments, the spar 146 can have a cross section that is narrower in the forward and aft directions relative to a central portion. The forward edge of the spar 146 can be rounded, pointed, and/or other configurations. The aft edge of the spar 146 can be rounded, pointed, and/or other configurations. In some embodiments, the distance between the forward and aft edge of the spar 146 can be the same as or similar to the chord length of the forward foil 140. In some embodiments, it is desirable to minimize or reduce the distance between the forward and aft edge of the spar 146 to lessen the impact on the performance of a rudder 154. In some embodiments, the rudder 154 is enlarged to accommodate for the use of foil(s) and spar(s). In some embodiments, the spar can be positioned and or shaped to reduce drag and/or turbulence and/or its affect on the associated or other foils.

The length of the spar 146 can vary depending on a variety of factors. The length of the spar 146 can be such that the forward foil 140 is at a sufficient depth of water to best perform. The length of the spar 146 can be such that the forward foil 140 remains submerged under normal operating conditions during use. The length of the spar 146 can be such that the forward foil 140 can be positioned at least half the chord length of the forward foil 140 away from the hull 124, which can be advantageous in a T foil configuration. In some embodiments, the length of the spar 146 can position the forward foil 140 less than 6, 7, 8, 9, 10, 11, 12, 13, 14, 15, 16, 17, 18, 19, 20, 21, 22, 23, 24, 25, 26, 27, 28, 29, 30, 31, or 32 or more inches away from the hull 124. In some embodiments, the length of the spar 146 can be short enough such that the spar 146 can be retracted within the hull 124 but remain inside the envelope of the available deck height. Specifically, many boats include a deck above a hull creating in many places a cavity between the deck and the hull. The cavity often includes wiring, plumbing, ballast tanks, storage, etc. In some embodiments, the spar 146 can extend above the deck height if retracted. In some embodiments, it is desirable to minimize or reduce the length of the spar 146 (e.g., the length of the spar 146 that contacts the water) to lessen the impact on the performance of the rudder 154. The combination of a foil and spar throughout can be referred to as a foil assembly (e.g. forward foil assembly, port aft foil assembly, starboard aft foil assembly). In some embodiments, the combination of a foil, spar, vertical actuator, and/or angle of attack actuator can be referred to as a foil assembly.

The foil displacement system 138 can include a starboard aft foil 144 and/or a port aft foil 142. In some embodiments, one, two, three, or four or more aft foil(s) are included. In some embodiments, the starboard aft foil 144 and/or a port aft foil 142 can be optimized and/or configured for creating downward force. In some embodiments, the starboard aft foil 144 and/or a port aft foil 142 can create a lifting force upon changing an angle of attack. FIGS. 6A-6C illustrate a starboard aft foil 144 and a port aft foil 142 that are both modified Eppler 420 foils that are inverted to better facilitate creating a downward force rather than a lift force. The starboard aft foil 144 and port aft foil 142 are asymmetric front to back and symmetric side to side. The starboard aft foil 144 and port aft foil 142 can be dihedral. In some embodiments, the dihedral angle of the starboard aft foil 144 and port aft foil 142 can match the local deadrise of the hull 124. Stated differently, the top surfaces of the starboard aft foil 144 and port aft foil 142 can be parallel with the proximate portion of the hull 124. Matching the dihedral angle of the starboard aft foil 144 and port aft foil 142 with the local deadrise of the hull 124 can enable the starboard aft foil 144 and port aft foil 142 to be positioned within a recess of the hull 124, bottom surfaces of the starboard aft foil 144 and port aft foil 142 to be coplanar with the surrounding portion of the hull 124, and/or the starboard aft foil 144 and port aft foil 142 to positioned more proximate the hull 124 without effecting performance of the starboard aft foil 144 and port aft foil 142. The deadrise of the hull 124 can be the angle between the bottom of the hull 124 and a horizontal plane that is parallel with the transverse axis 120, perpendicular to the vertical axis 118, and tangential to a lowest point of the hull 124. The local deadrise can be the deadrise of the hull 124 that is proximate the respective foil.

The starboard aft foil 144 and a spar 150 are in a T foil configuration. The port aft foil 142 and spar 148 are in a T foil configuration. The starboard aft foil 144 and spar 150 can be the same as the port aft foil 142 and spar 148, being in mirrored configurations relative to a central plane extending through the vertical axis 118 and longitudinal axis 122. In some embodiments, the starboard aft foil 144 and spar 150 are not the same as the port aft foil 142 and spar 148. The chords of the starboard aft foil 144 and port aft foil 142 can be consistent across the width (length in starboard to port direction) of the starboard aft foil 144 and port aft foil 142, respectively. Stated differently, the chords of the of the starboard aft foil 144 and port aft foil 14, in some embodiments, are not tapered. In some embodiments, the chords of the starboard aft foil 144 and port aft foil 142 can be inconsistent across the width of the starboard aft foil 144 and port aft foil 142, respectively (e.g., tapered).

The starboard aft foil 144 and port aft foil 142 are smaller than the forward foil 140. In some embodiments, the starboard aft foil 144 and/or port aft foil 142 are the same size or bigger than the forward foil 140. As will be appreciated, however, many different foil types/shapes can be chosen depending on hull configuration, loading requirements, desired boat speed, desired performance, available control systems, etc., which can at least include the foils detailed elsewhere herein.

The starboard aft foil 144 and port aft foil 142 can be equally spaced away from the longitudinal axis 122 of the water-sports boat 100, as illustrated in FIG. 6D. The starboard aft foil 144 can be disposed on the starboard side 110 of the water-sports boat 100 and the port aft foil 142 can be disposed on the port side 112 of the water-sports boat 100. The starboard aft foil 144 and port aft foil 142 can be positioned aft of the transverse axis 120. Positioning at least one foil forward of the transverse axis 120 and at least one foil aft of the transverse axis 120 can enable the foil system 138 to control pitch and heave. The starboard aft foil 144 and/or port aft foil 142 can provide a downward force as the water-sports boat 100 moves through the water, which can lower the hull 124 deeper into the water. The starboard aft foil 144 and/or port aft foil 142 can, in some embodiments, primarily lower or lift the stern 108 into and/or out of the water, but in some instances, the starboard aft foil 144 and/or port aft foil 142 can lower the bow 116. In some embodiments, one of the starboard aft foil 144 or port aft foil 142 can provide a greater downward force or lift force than the other, which can raise or lower the starboard side 110 or port side 112 of the water-sports boat 100 relative to the water and/or be used to control roll. For example, the starboard aft foil 144 can provide a greater downward force than the port aft foil 142 to increase the starboard-side portion 106 of the wake 105. In some embodiments, the starboard aft foil 144 or port aft foil 142 can both provide a downward force or lift force that are generally equal subject to normal variance.

The starboard aft foil 144 and port aft foil 142 can be a variety of sizes. The sizes of the starboard aft foil 144 and port aft foil 142 can be influenced by the size, expected travel speed, and/or desired performance of the water-sports boat 100 and/or desired wake 405 configuration. As described above, the starboard aft foil 144 and port aft foil 142 can be the same size or, in some embodiments, different sizes. In some embodiments, the starboard aft foil 144 and/or port aft foil 142 may be 18-20 inches wide (the length in the starboard-to-port direction) for a 20-23 foot length hull. In some embodiments, the starboard aft foil 144 and/or port aft foil 142 may be less than 16, 17, 18, 19, 20, 21, 22, 23, or 24 or more inches wide or any width between the foregoing values for a 20-23 foot length hull. In some embodiments, starboard aft foil 144 and/or port aft foil 142 may be 24-28 inches wide for a hull over 23 feet in length. In some embodiments, the starboard aft foil 144 and port aft foil 142 may be less than 22, 23, 24, 25, 26, 27, 28, 29, 30, or 31 or more inches wide or any width between the foregoing values for a hull over 23 feet in length. In some embodiments, the starboard aft foil 144 and port aft foil 142 may be less than 12, 13, 14, 15, 16, 17, 18, 19 or more inches wide or any width between the foregoing values for a hull length that is less than 20 feet The size of the starboard aft foil 144 and/or port aft foil 142 can be influenced by balancing the forces created by the forward and aft foils to prevent and/or reduce porpoising or other dynamic instabilities. For example, in some embodiments, the foils can balance the hull 124 to reduce high pressure zones which can cause dynamic instabilities. In some embodiments, the foil displacement system 138 can the balance the water-sports boat 100 via positioning of the foils in reference to the center of gravity and/or balancing the forces created by the foils (e.g. prevent excessive imbalances). In some embodiments, the starboard aft foil 144 and port aft foil 142 can, together or individually, be equal or similar to the width of the forward foil 140 and/or combined width of forward foil(s) 140. In some embodiments, the starboard aft foil 144 and port aft foil 142, together or individually, are less than 50%, 55%, 60%, 65%, 70%, 75%, 80%, 85%, 90%, 95%, 100%, or greater than 100% of the width of the forward foil 140 and/or combined width of forward foil(s) 140. The size of the starboard aft foil 144 and port aft foil 142 can be influenced by the type or shape of foil used. For example, a more symmetrical foil would need to be larger than an optimized a-symmetrical foil to produce the same force.

The starboard aft foil 144 and port aft foil 142 can each be connected, which can include coupled, to a spar. The starboard aft foil 144 can be connected to the spar 150. The port aft foil 142 can be connected to the spar 148. The spars 148, 150 can respectively space the port aft foil 142 and starboard aft foil 144 away from the hull 124. In some embodiments, the spars 148, 150 can be connected. In some embodiments, the port aft foil 142 and starboard aft foil 144 are each respectively removably coupled to the spars 148, 150, which can include being bolted together. In some embodiments, the port aft foil 142 and starboard aft foil 144 are each respectively fixedly connected to the spars 148, 150, which can include being welded or adhered together. In some embodiments, the starboard aft foil 144 and the spar 150 are monolithically formed. In some embodiments, the port aft foil 142 and the spar 148 are monolithically formed. In some embodiments, more than one spar 148, 150 respectively distances the port aft foil 142 and starboard aft foil 144 away from the hull 124.

The spars 148, 150 can be the same or different. The spars 148, 150 can have a uniform cross-section or a variable cross-section. In some embodiments, the portion of the spars 148, 148 that contacts the water can have a uniform cross-section. The spars 148, 150 can have a cross-section that is tapered in the forward to-aft direction. The spars 148, 150 can have a cross-section that is a tear drop shape or elongate tear drop shape. The spars 148, 150 can have a cross-section that is oblong, oval, circular, polygonal, irregular, and/or other shapes. In some embodiments, the spars 148, 150 can have a cross section that is narrower in the forward and aft directions relative to a central portion. The forward edge of the spars 148, 150 can be rounded, pointed, and/or other configurations. The aft edge of the spars 148, 150 can be rounded, pointed, and/or other configurations. In some embodiments, the distance between the forward and aft edges of the spars 148, 150 can be the same as or similar to the chord length of the respective port aft foil 142 and starboard aft foil 144 to which the spar is connected. In some embodiments, it is desirable to minimize or reduce the distance between the forward and aft edge of spars 148, 150 to lessen the impact on the performance of the rudder 154.

The length of the spars 148, 150 can vary depending on a variety of factors. The length of the spars 148, 150 can be the same or different. The length of the spars 148, 150 can be such that the port aft foil 142 and starboard aft foil 144 are at a sufficient depth of water to best perform. The length of the spars 148, 150 can be such that the port aft foil 142 and starboard aft foil 144 remain submerged under normal operating conditions during use. The length of the spars 148, 150 can be such that the port aft foil 142 and starboard aft foil 144 are each positioned at least half the chord length of the port aft foil 142 and starboard aft foil 144, respectively, which can be advantageous in a T foil configuration. In some embodiments, the length of the spars 148, 150 can, respectively, position the port aft foil 142 and starboard aft foil 144 less than 6, 7, 8, 9, 10, 11, 12, 13, 14, 15, 16, 17, 18, 19, 20, 21, 22, 23, 24, 25, 26, 27, 28, 29, 30, 31, or 32 or more inches away from the hull 124 or any length between the foregoing values. In some embodiments, the length of the spars 148, 150 can be short enough such that the spars 148, 150 can be retracted within the hull 124 but remain inside the envelope of the available deck height. In some embodiments, the spars 148, 150 can extend above the deck height if retracted. In some embodiments, it is desirable to minimize or reduce the length of the spars 148, 150 (e.g., the length of the spars 148, 150 that contacts the water) to lessen the impact on the performance of the rudder 154. The spars 146, 148, 150 can be the same, similar, or different. Additionally, at a stowed position, the foil may advantageously be sufficiently close to the hull to reduce or minimize its interaction with passing water. In some embodiments, the spar and the foil retract into an accommodating space in the hull. The disclosed foils (e.g., forward foil 140, port aft foil 142, and/or starboard aft foil 144) can include sections port and starboard of the attached spare that are symmetrical front to aft, which can produce a downward force. The disclosed foils (e.g., forward foil 140, port aft foil 142, and/or starboard aft foil 144) can have a mirrored configuration relative to the spar to which the foil is attached. For example, the forward foil 140 can be mirrored with respect to the spar 148. Stated differently, the section of the forward foil 140 port of the spar 146 can be in a mirrored configuration relative to the section of the forward foil 140 starboard of the spar 146.

The forward foil 140, port aft foil 142, and/or starboard aft foil 144 can, in some embodiments, be moved between a deployed and stowed position. The deployed position can one in which the foil is spaced away from the hull 124 a predetermined distance. The stowed position can one in which the foil is proximate the hull 124 and/or within a recess in the hull 124. The deployed position can be one in which the deployed foil will generate a downward or lifting force. The stowed position can be one in which the stowed foil will not generate or substantially not generate a downward or lifting force.

The forward foil 140, port aft foil 142, and starboard aft foil 144 are in a deployed position as illustrated in FIGS. 6A-6C with the forward foil 140, port aft foil 142, and starboard aft foil 144 spaced away from the hull 124. In some embodiments, the forward foil 140, port aft foil 142, and/or starboard aft foil 144 are fixedly deployed, not having a stowed position. In some embodiments, the forward foil 140, port aft foil 142, and/or starboard aft foil 144 can be deployed to one of a plurality of deployed positions or along a continuum of deployed positions. As explained in more detail elsewhere herein, the spars 146, 148, and/or 150 can be extended and retracted from within the hull 124 to move the forward foil 140, port aft foil 142, and starboard aft foil 144 between stowed and deployed positions. The spars 146, 148 and/or 150 can be automatically extended or retracted. The spars 146, 148, and/or 150 can be automatically actuated with an electric, pneumatic, hydraulic, and/or other suitable actuator. In some embodiments, the actuator can be released to allow for manual maneuvering.

In some embodiments, the spars 146, 148 and/or 150 can be manually extended, retracted, tilted, and/or rotated. In some embodiments, the spars 146, 148, and/or 150 can be manually extended, retracted, rotated, tilted and/or held in position with a screw, jack screw, rack and pinion, lever, pin(s) removably inserted into positioning holes along a portion of a spar, cable system, gear assembly, clamps that can selectively release and hold a spar, rollers, lockable rollers, pulley system, suction attachments, mechanical mating systems, and/or other suitable apparatuses or systems.

The forward foil 140 can be retracted into a recess (depression, indentation, gap, groove, opening) 152 in the hull 124 to be stowed. The recess 152 can be sized and shaped to receive the forward foil 140. The retraction of the forward foil 140 into the hull 124 can enable the water-sports boat 100 to be maneuvered without or substantially without the forward foil 140 creating a lifting or downward force. In some embodiments, the retraction of the forward foil 140 into the hull 124 can enable the water-sports boat 100 to be safely loaded onto a trailer. In some embodiments, the forward foil 140, in the stowed position, has a bottom surface that is flush or coplanar with a surrounding surface of the hull 124, extends out of the recess 152, or is within the recess 152. In some embodiments, the forward foil 140 is retracted to be proximate the hull 124 when in the stowed position.

The port aft foil 142 and starboard aft foil 144 can be retracted to be proximate the hull 124 to be stowed. In some embodiments, the port aft foil 142 and starboard aft foil 144 can be retracted into a recess in the hull 124 that is similar to the recess 152. In some embodiments, the port aft foil 142 and starboard aft foil 144 are fixedly deployed. In some embodiments, the port aft foil 142 and starboard aft foil 144 are positioned sufficiently aft to be in a deployed when loaded onto a trailer.

Figure 7A:
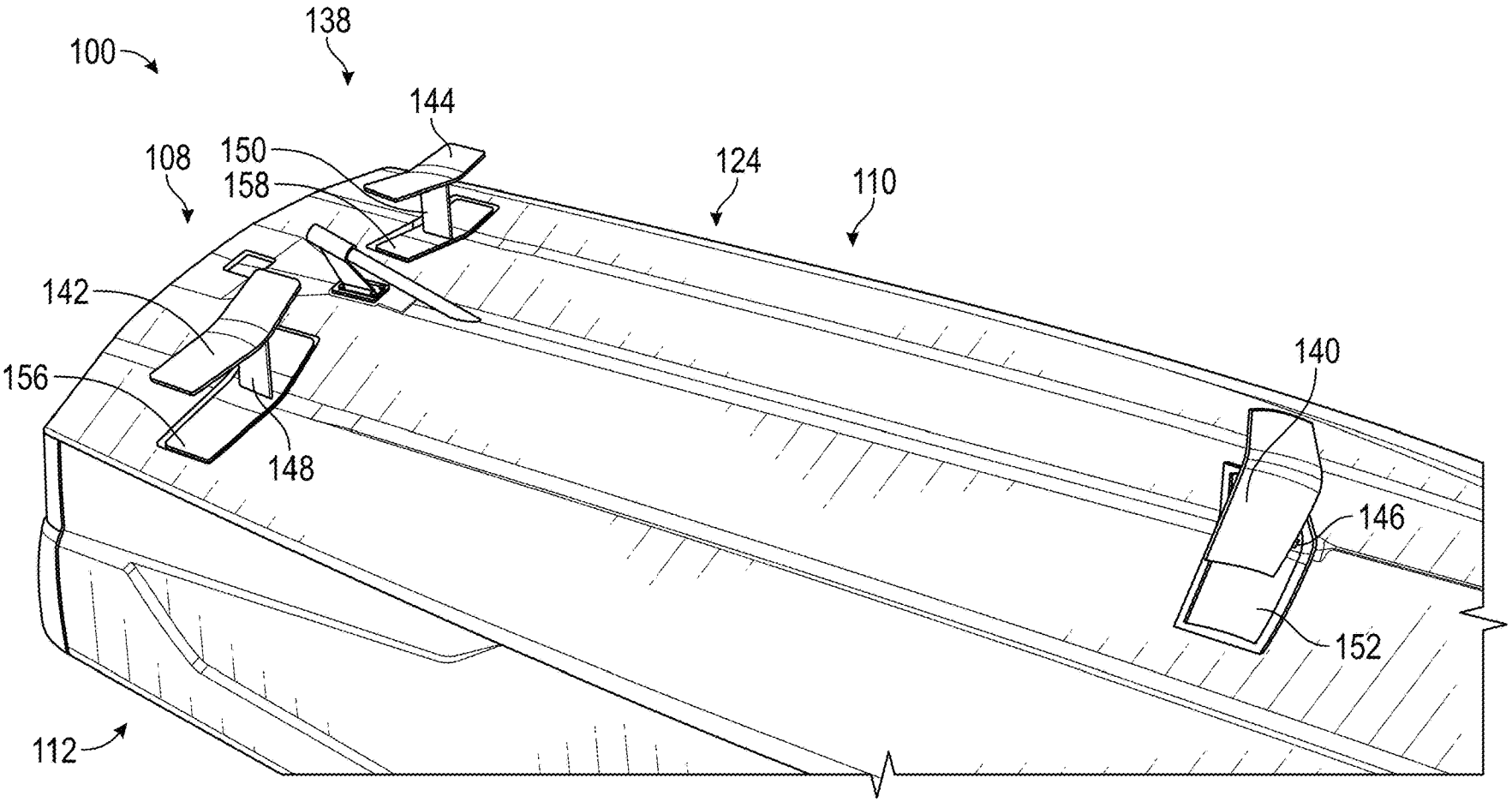
FIG. 7A illustrates an example water-sports boat with foils deployed.
Figure 7B:
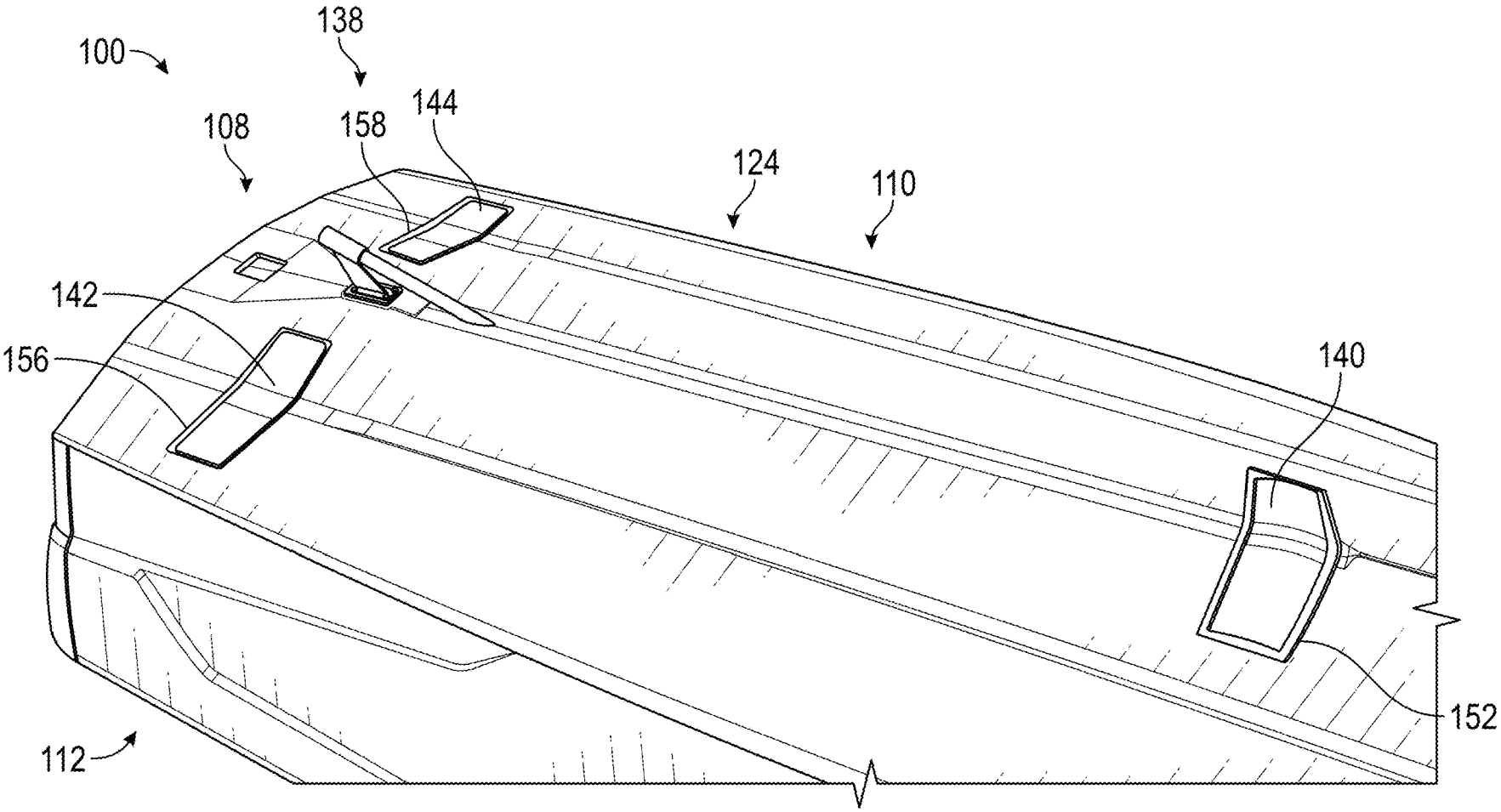
FIG. 7B illustrates the water-sports boat in FIG. 7A with foils stowed.

FIGS. 7A and 7B illustrate another embodiment of a foil displacement system 138, which is the same as or similar to the foil displacement system 138 described in reference to FIGS. 6A-6D, aside from the illustrated and described differences. In contrast to the aft foils 142, 144 described in reference to FIGS. 6A-6D, the aft foils 142, 144 illustrated in FIGS. 7A and 7B are in a swept configuration. In contrast to the aft foils 142, 144 described in reference to FIGS. 6A-6D, the aft foils 142, 144 illustrated in FIGS. 7A and 7B are in an anhedral configuration. The port aft foil 142 can be retracted into a recess (depression, indentation, gap, groove, opening) 156 in the hull 124 to be stowed. The starboard aft foil 144 can be retracted into the recess (depression, indentation, gap, groove, opening) 158 in the hull 124 to be stowed. The recesses 156, 158 can be sized and shaped to receive the port aft foil 142 and starboard aft foil 144, respectively. For example, FIG. 7B illustrates the port aft foil 142 retracted into the recess 156, the starboard aft foil 144 retracted into the recess 158, and the forward foil 140 retracted into the recess 152. Stated differently, FIG. 7B illustrates the port aft foil 142, the starboard aft foil 144, and the forward foil 140 in stowed configurations. As described elsewhere herein, the bottom surfaces of the port aft foil 142, the starboard aft foil 144, and the forward foil 140 can be flush or coplanar with a surrounding surface of the hull 124, extend out of the respective recess 152, 156, or 158, or be positioned entirely within the respective recess 152, 156, or 158.

The foils referenced herein can at least be straight, polyhedral, dihedral, anhedral, or gull wing. The foils can be inverted or not inverted. The foils can be surface-piercing hydrofoils or fully submerged hydrofoils. The foils can be a ladder foil, river hydrofoil double, river hydrofoil single, E foil, V foil, T foil, Y foil, L foil, U foil, O foil, C foil, J foil, S foil, Z foil, or other suitable foil. The foils can be symmetrical or asymmetrical. The foils can be straight, swept, forward swept, and/or include other configurations. The foils can be low, moderate, and/or high aspect ratio. The chords of the foils can be constant, tapered, reverse tapered, compound tapered, and/or other configurations. The foils can include a tapered chord length in the center-to-starboard direction and/or center-to-port direction. The foils can be elliptical or semi-elliptical. The foils can be in a delta configuration. The foils can include winglets, which can help to eliminate vortices. The foils can be positioned at any position between the bow and stern of a boat.

The foil(s) of the foil displacement system 138 can be arranged in a variety of configurations and/or include one, two, three, four, five, or six or more foil(s). The foil displacement systems 138 described above are in a split canard arrangement with two aft foils 142, 144 and one forward foil 140. In some embodiments, a split canard arrangement is desirable for its stabilizing capability for both pitch and heave motions. A split canard arrangement can also allow for transverse adjustment of downforce—e.g., a port or starboard side aft foil can create a larger downward force on one of the port or starboard sides, which can facilitate creating a suitable wake surfing wave. The split canard arrangement can also enable the foil displacement system 138 to be conveniently packaged. For example, the aft foils 142, 144 and the associated spars 148, 150 can be retracted and have sufficient storage inside the envelope of the available deck height near the stern. The forward foil 140 and associated spar 146 can be retracted and have sufficient storage inside the envelope of the available deck height due to the alignment of the forward foil 140 relative to the longitudinal axis 122, which positions the spar 146 away from the steeper surfaces of the hull 124 in the starboard side 110 and port side 112 directions. The forward foil 140 forward of and positioned between the two aft foils 142, 144, which can reduce the risk that fluid flowing around the forward foil 140 will negatively impact the performance of the aft foils 142, 144. Having two aft foils 142, 144 can advantageously provide greater control over the stern 108, which can be beneficial when creating wakes of difference configurations.

Figure 7C:
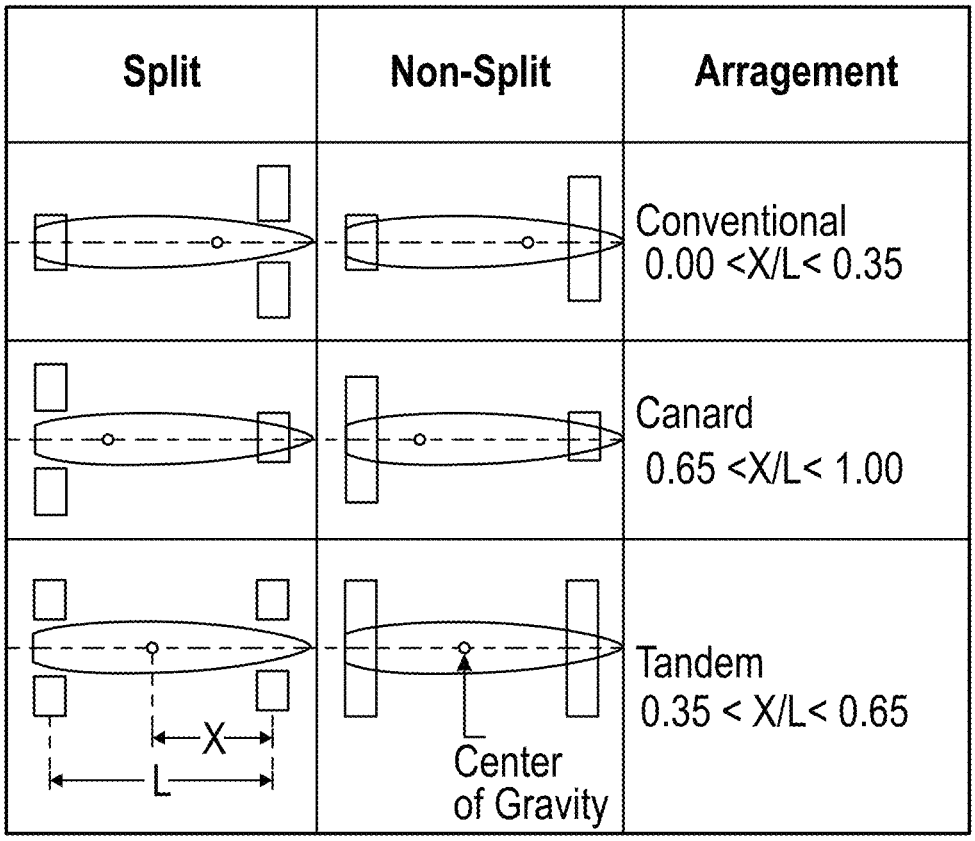
FIG. 7C illustrates example water-sport boat layouts.

The positioning of the forward foil 140 and the aft foils 142, 144 can be varied while still being in a suitable canard arrangement. The canard arrangement, as shown in FIG. 7C, is maintained when the longitudinal distance X between the bow 116 and the center of gravity of the water-sports boat 100 over the longitudinal distance L between the stern 108 and the bow 116 is between 0.65 and 1.00. The placement of the forward foil 140 and the aft-foils 142, 144 can be based on balancing the pitch and/or roll of the water-sports boat 100. As the forward foil 140 and/or aft foils 142, 144 move closer to the center of gravity, a smaller moment may be produced by the forward foil 140 and/or aft foils 142, 144, which can hamper performance.

In some embodiments, the centers of the aft foils 142, 144 and/or aft spars 148, 150 can be positioned between about 20%-40% of the length of the water-sports boat 100 away from the longitudinal center of gravity (LCG) 151 (illustrated in FIG. 6B) and/or center of gravity (COG) in the aft direction, which can include being positioned on the transom 126. In some embodiments, the centers of the aft foils 142, 144 and/or aft spars 148, 150 can be positioned between about 20%-40% of the length of the water-sports boat 100 along the longitudinal axis 112 away from the LCG 151 and/or COG in the aft direction. In some embodiments, the centers of the aft foils 142, 144 and/or aft spars 148, 150 can be positioned less than 40, 50, 60, 70, 80, 90, 100, 110, 120, or 130 or more inches away from the LCG 151 and/or COG in the aft direction or any value in between the foregoing values, which can be for water-sports boats with a hull length of less than 20, 20-23, or greater than 23 feet length.

In some embodiments, the forward foil 140 and/or spar 146 can be positioned between about 15-20% of the length of the water-sports boat 100 away from the LCG 151 and/or center of gravity (COG) in the forward direction. In some embodiments, the forward foil 140 and/or spar 146 can be positioned between about 15%-20% of the length of the water-sports boat 100 along the longitudinal axis 112 away from the LCG 151 and/or COG in the forward direction. In some embodiments, the centers of the forward foil 140 and/or spar 146 can be positioned less than 30, 40, 50, 60, 70, 80, 90, or 100 or more inches away from the LCG 151 and/or COG in the aft direction. In some embodiments, the aft foils 142, 144 may be a non-split arrangement using a single aft foil, as illustrated in FIG. 7C.

Other arrangements are also shown in FIG. 7C. For example, the foils of the foil displacement system 138 can be arranged in a split conventional arrangement. The split conventional arrangement can have two forward foils and one aft foil. The positioning of foils can be varied while still being in a suitable conventional arrangement by maintaining a conventional ratio. The conventional ratio is maintained when the longitudinal distance X between the bow 116 and the center of gravity of the waters-sports boat 100 over the longitudinal distance L between the stern 108 and the bow 116 is between 0.00 and 0.35. In some embodiments, the forward foils may be a non-split arrangement using a single forward foil, as illustrated in FIG. 7C.

The foils of the foil displacement system 138 can be arranged in a split tandem arrangement. The split tandem arrangement can have two forward foils and two aft foils. The positioning of the foils can be varied while still being in a suitable tandem arrangement by maintaining a tandem ratio. The tandem ratio is maintained when the longitudinal distance X between the bow 116 and the center of gravity of the water-sports boat 100 over the longitudinal distance L between the stern 108 and the bow 116 is between 0.35 and 0.65. In some embodiments, the aft and forward foils may be in a non-split arrangement using a single aft foil and single forward foil, as illustrated in FIG. 7C.

Figure 8A:
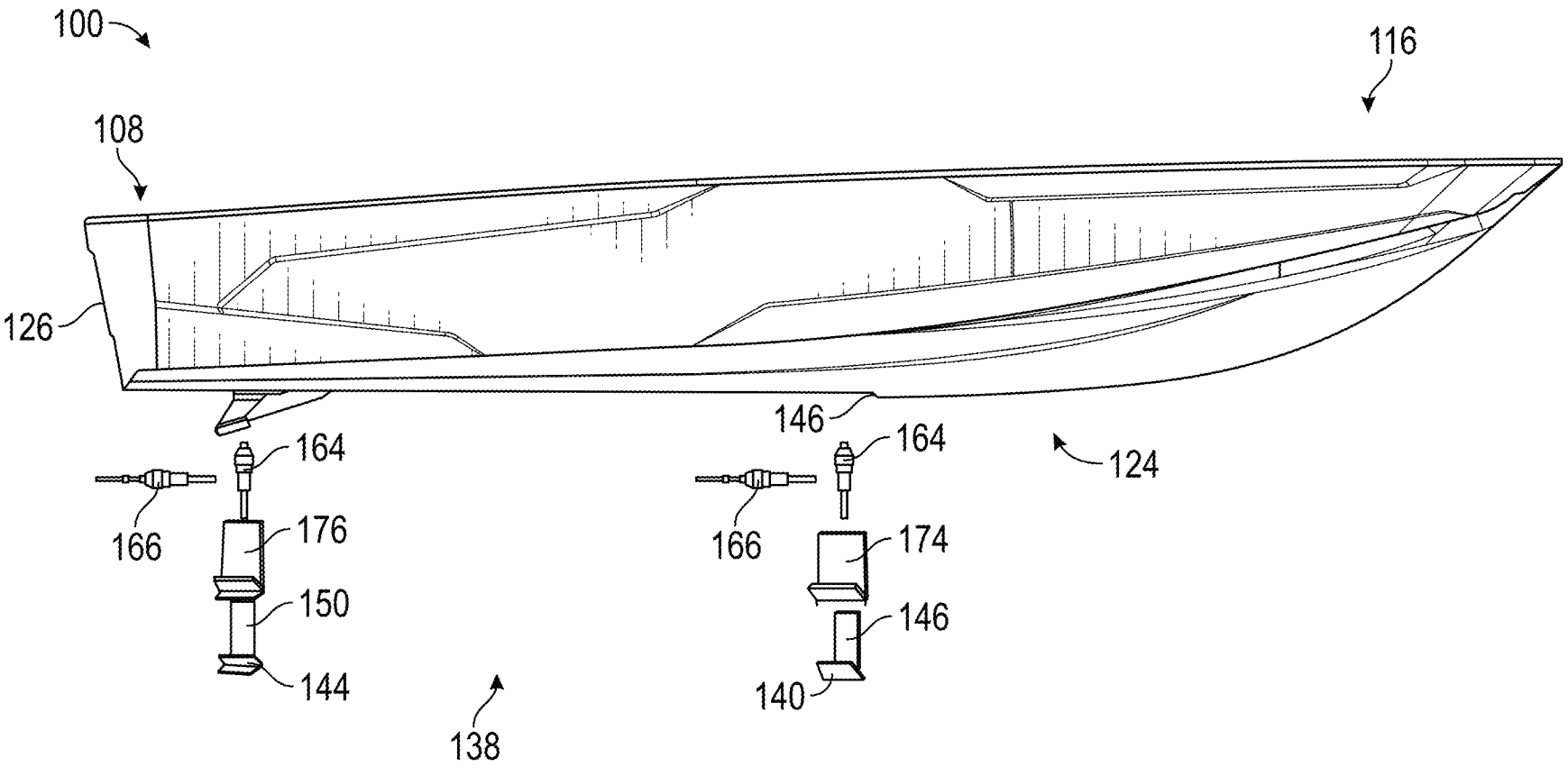
FIG. 8A illustrates a partially exploded view of an example water sports boat.

FIG. 8A illustrates the water-sports boat 100 with actuators that can change the angle of attack of and/or vertically maneuver the foils of the foil displacement system 138. The foil displacement system 138 can include vertical actuator(s) 164 (e.g., an electric, pneumatic, hydraulic, and/or other suitable actuator) that can vertically maneuver the foils of the foil displacement system between deployed and stowed positions. In some embodiments, the vertical actuator 164 can maneuver the foils between discrete positions and/or along a continuum of positions. In some embodiments, each of the forward foil 140, port aft foil 142, and/or the starboard aft foil 144 can be actuated by a separate vertical actuator 164. In some embodiments, a hull recess insert 174 and/or aft hull recess inserts 176 can receive (house, store) the spars 146, 148, 150; forward foil 140; and aft foils 142, 144, respectively, in the stowed position. The hull recess insert 174 and/or aft hull recess inserts 176 can be positioned within the hull 124. In some embodiments, the hull recess insert 174 and/or aft hull recess inserts 176 can enable the vertical actuator(s) 164 and angle of attack actuators 166 to operate in a dry environment. In some embodiments, the vertical actuator 164 and angle of attack actuator 166 can be sealed within a dry environment and/or operate in a wet environment. One or more mechanical linkages may advantageously allow for a sealed environment for some or all of non-spar moving pieces.

The foil displacement system 138 can include angle of attack (rotation, pivot, canting) actuators 166 (e.g., an electric, pneumatic, hydraulic, and/or other suitable actuator). The angle of attack actuator(s) 166 can alter the angles of attack of the foils of the foil displacement system, as described in more detail below. In some embodiments, the angle of attack actuator(s) can maneuver the foils between discrete positions or angles of attack and/or along a continuum of positions. In some embodiments, each of the forward foil 140, port aft foil 142, and/or the starboard aft foil 144 can be actuated by a separate angle of attack actuator 166. In some embodiments, the vertical actuator 164 will stow and/or actuate a foil of the foil displacement system 138 if the foil and/or spar is in a neutral configuration. The angle of attack of the foils of the displacement system 138 can govern whether the foil is creating a lifting or downward force. The angle of attack of the foils of the displacement system 138 can govern or contribute to the magnitude of the lifting or downward force generated. In some embodiments, the foil displacement system 138 can be turned off and/or locked out to prevent use. In some embodiments, mechanical stops can prevent overtravel when actuating the foil(s) to create lifting forces or downward forces. In some embodiments, an actuator can facilitate vertical actuation and angle of attack actuation.

Figure 8C:
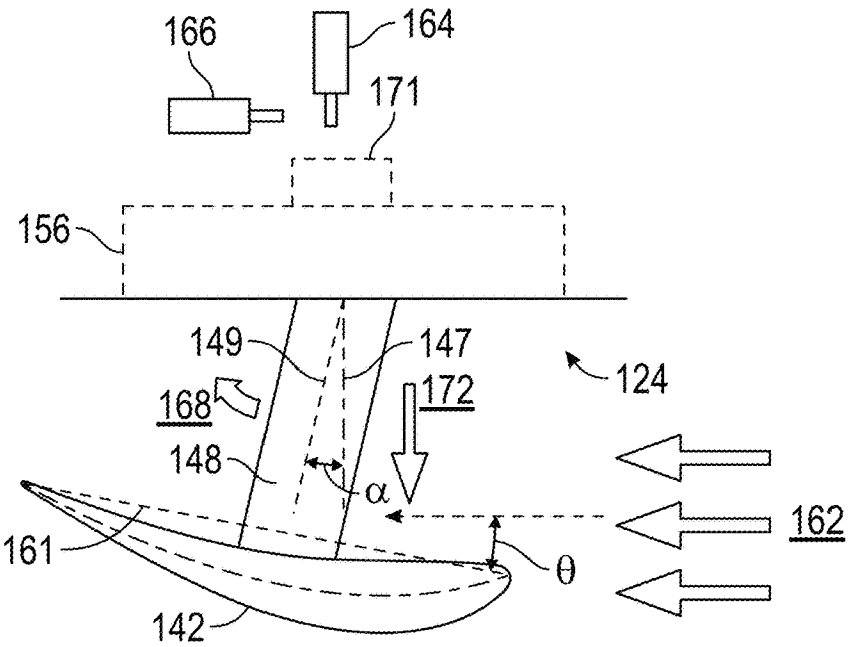
FIG. 8C schematically illustrates a foil at a negative angle of attack.
Figure 8B:
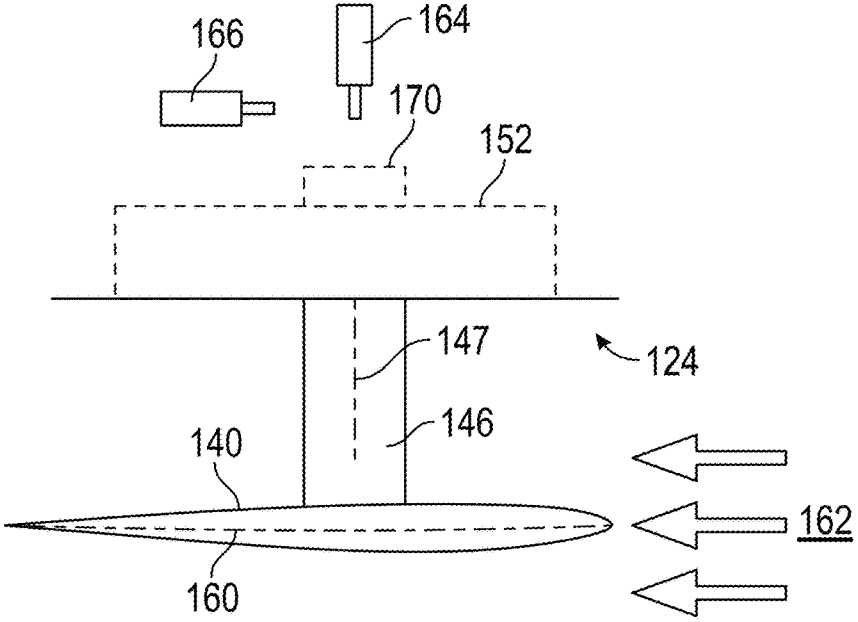
FIG. 8B schematically illustrates a foil at a neutral position.

FIG. 8B illustrates a schematic of the forward foil 140 in a configuration that can be actuated between different positions. The cross-section of the forward foil 140 as an inverted NACA 4418 foil is shown, but as explained elsewhere herein, other foil types can be used, such as an inverted Eppler 420 foil. The forward foil 140 is illustrated at a neutral angle of attack. The angle of attack θ can be defined as the angle between a chord 160 of the forward foil 140 and the direction 162 of the surrounding undisturbed flow of water. For example, the angle of attack θ in FIG. 8B is zero because the chord 160 is aligned with the direction 162 of the surrounding undisturbed flow of water. In some embodiments, the forward foil 140 generates a downward force or lift force at a neutral angle of attack. The forward foil 140 can be actuated by the vertical actuator 164 to vertically maneuver the forward foil 140. For example, the vertical actuator 164 can deploy and stow the forward foil 140. The vertical actuator 164 can retract the spar 146 into a cavity 170 within the hull 124 such that the forward foil 140 is positioned within the recess 152 and/or proximate the hull 124.

The forward foil 140 can be actuated by the angle of attack (rotation, pivot) actuator 166. The angle of attack actuator 166 can alter the angle of attack of the forward foil 140. In some embodiments, as described in reference to FIG. 8C, spar 146 can be rotated in an aft and/or forward direction to change the angle of attack θ of the forward foil 140. For example, in some embodiments, the spar 146 can be rotated to one of a plurality of pivot angles or along a continuum of pivot angles. The pivot angle α can be described relative to a neutral position 147 of a longitudinal axis 149 of the spar 146, as illustrated in FIG. 8B, with rotation in the forward direction being positive and rotation in the aft direction being negative. In some embodiments, the spar 146 is moved to an unrotated position before being vertically maneuvered and/or stowed by the vertical actuator 164. In some embodiments, as described in reference to FIG. 8D, spar 146 can remain unrotated and the angle of attack actuator 166 can rotate (pivot) the forward foil 140 relative to the spar 146 to change the angle of attack θ.

FIG. 8C illustrates a schematic of the port aft foil 142 in a configuration that can be actuated between different positions. The port aft foil 142 is illustrated at a negative angle of attack θ (e.g., the angle θ between the chord 161 of the port aft foil 142 and the direction 162 of the surrounding undisturbed flow of water) to create a downward force 172 upon forward movement of the water-sports boat 100. The port aft foil 142 can be actuated by the vertical actuator 164 to vertically maneuver the port aft foil 142. In some embodiments, vertical actuator 164 can deploy and stow the port aft foil 142. In some embodiments, the vertical actuator 164 actuates if the spar 148 is not rotated. For example, in some embodiments, the vertical actuator 164 does not actuate if the spar 148 is rotated as shown in FIG. 8C. In some embodiments, the vertical actuator 164 can deploy and stow the port aft foil 142. In some embodiments, the vertical actuator 164 can retract the spar 146 into a cavity 171 within the hull 124 such that the port aft foil 142 is positioned within the recess 156 and/or proximate the hull 124. The port aft foil 142 can be actuated by the angle of attack actuator 166. The angle of attack actuator 166 can rotate the spar 148 in the direction 168 to enable the port aft foil 142 to create downward force and/or rotate the spar 148 in an opposite direction to enable the port aft foil 142 to create lift.

The spar 146 can rotate to one or more discrete pivot angles α and/or along a continuum of suitable pivot angles α and/or orient the port aft foil 142 within a suitable range of angles of attack θ. The suitable range of pivot angles α and/or angles of attack θ can be a function of the stall characteristics of the port aft foil 142. For example, the suitable range of pivot angles α and/or range of angles of attack θ can avoid positions in which the foil will or is likely to stall. In some embodiments, the spar 146 can rotate more aft than forward because the port aft foil 142 can withstand more negative (down) angle and/or downward force than positive (upward) angle and/or lift before stalling.

In some embodiments, the maximum positive pivot angle α is positive 15 degrees. In some embodiments, the maximum negative pivot angle α is negative 15 degrees. In some embodiments, the maximum positive pivot angle α is 0, 1, 2, 3, 4, 5, 6, 7, 8, 9, 10, 11, 12, 13, 14, 15, 16, 17, 18, 19, 20, 21, 22, 23, 24, or 25 or more degrees or any angle between the foregoing values. In some embodiments, the maximum negative pivot angle α is 0 or negative 1, 2, 3, 4, 5, 6, 7, 8, 9, 10, 11, 12, 13, 14, 15, 16, 17, 18, 19, 20, 21, 22, 23, 24, or 25 or more degrees or any angle between the foregoing values. In some embodiments, the range of angles of attack θ for the forward foil 140 is −25 to 5 degrees. In some embodiments, the maximum negative angle of attack θ for the forward foil 140 is less than −15, −20, −25, −30, or −35 or more degrees or any angle of attack θ between the foregoing values. In some embodiments, the maximum positive angle of attack θ for the forward foil 140 is less than 1, 2, 3, 4, 5, 6, 7, 8, 9, or 10 or more degrees or any angle of attack θ between the foregoing values. In some embodiments, the range of angles of attack θ for the aft foils 142, 144 foils is −20 to 10 degrees. In some embodiments, the maximum negative angle of attack θ for the aft foils 142, 144 is less than negative 10, 15, 20, 25, or 30 or more degrees or any angle of attack θ between the foregoing values. In some embodiments, the maximum positive angle of attack θ for the aft foils 142, 144 is less than 1, 2, 3, 4, 5, 6, 7, 8, 9, 10, 11, 12, 13, 14, or 15 or more degrees or any angle of attack θ between the foregoing values.

Figure 8D:
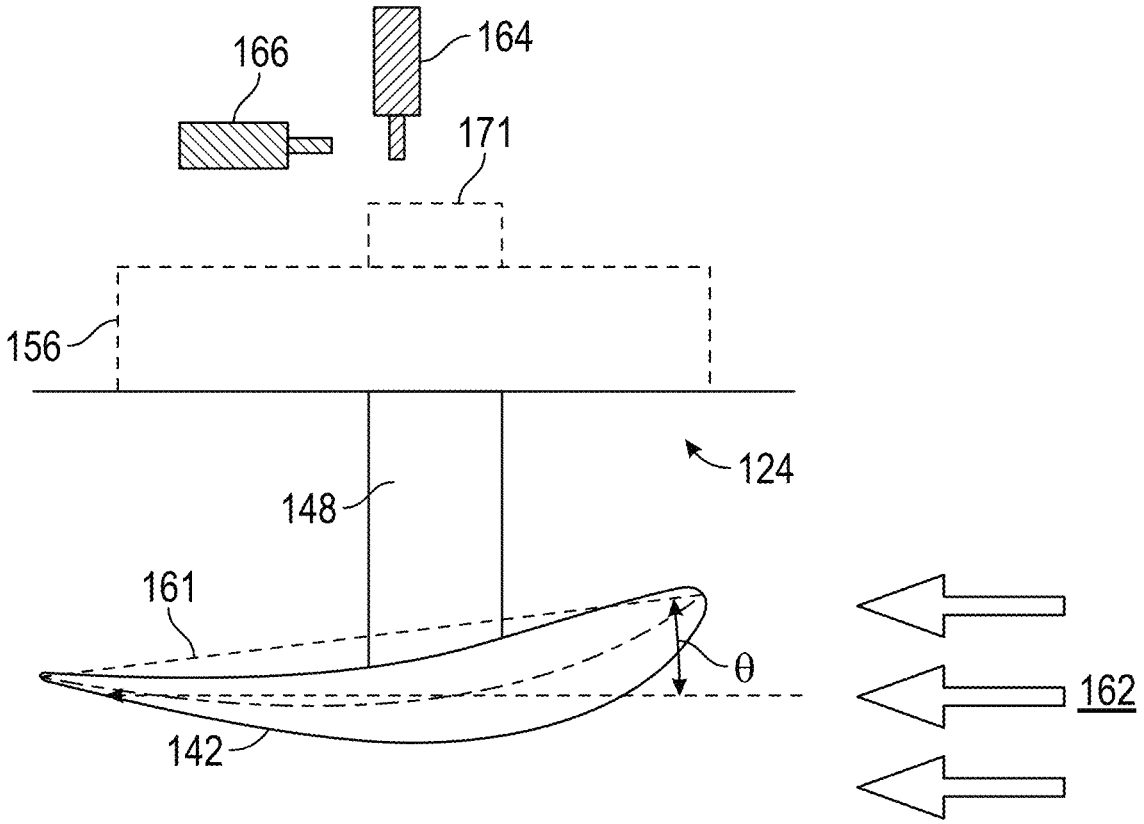
FIG. 8D schematically illustrates a foil at a positioned angle of attack.

FIG. 8D illustrates a schematic of the port aft foil 142 in a configuration in which the port aft foil 142 can rotate and/or pivot relative to the spar 148 to provide different angles of attack. In some embodiments, the spar 148 does not rotate. In some embodiments, the spar 148 does rotate. In some embodiments, the port aft foil 142 can be rotated by the angle of attack actuator 166 to one of a plurality of positions or along a continuum of positions. The port aft foil 142 can rotate to the angles of attack as described in reference to FIG. 8C. In some embodiments, the vertical actuator 164 will not vertically maneuver the port aft foil 142 unless the port aft foil 142 is at a neutral position (e.g. at an angle of attack of zero).

The actuation and movement described in FIGS. 8A-8D can be used with any foil described herein. For example, the forward foil 140, port aft foil 142, and/or starboard aft foil 144 can, in some embodiments, be actuated, deployed, stowed, oriented, and/or maneuvered as described in reference to any of FIGS. 8A-8D. In some embodiments, the foils (e.g., forward foil 140, port aft foil 142, and/or starboard aft foil 144) of the foil displacement system 138 can have a fixed angle of attack. In some embodiments, the angle of attack θ of each of the foils of the foil displacement system 138 can be the same or different. In some embodiments, the angle of attack θ and/or vertical actuation of each of the foils of the foil displacement system 138 can be independently controlled or controlled together. In some embodiments, the angle of attack θ and/or vertical actuation of some of the foils of the foil displacement system 138 can be controlled together.

In some embodiments, a foil and/or spar can be mounted to the hull side or top of the gunwale. To deploy the spar and/or foil, the operator can release a pin or latch to lower the foil and/or spar into water. The pin or latch can be used as a shear point or breakaway point of an object strikes the spar and/or foil. The angle of attack can be controlled by a hull side or gunwale mounted pivot, which can incorporate a pulley, rope, and/or cable system.

In some embodiments, a foil and/or spar can be mounted to the hull side or top of the gunwale. The foil and/or spar can have an axis of rotation that is parallel to the longitudinal axis of the boat. The foil and/or spar can be rotated down into water by rotating about the axis of rotation. The angle of attack can be controlled by a hull side or gunwale mounted pivot that is coupled to the foil and/or spar, which can incorporate a pulley, rope, and/or cable system.

In some embodiments, a foil and/or spar can be mounted via a plate or bracket onto the transom. The operator can deploy the foil and/or spar by releasing a latch or pin to allow the foil and/or spar to rotate into place. The pin or latch can be used as a shear point or breakaway point if an object strikes the foil and/or spar while underway. The angle of attack of the foil can be controlled by the hull side or gunwale mounted pivot, which can incorporate a pulley/rope/cable.

In some embodiments, a foil and/or spar can be mounted onto the port side 112 or starboard side 110 of the watersports boat. In some embodiments, a foil and/or spar can be attached to the gunwale(s) of a boat, which can include being positioned in a gap of the gunwale and pivoted with respect to the gunwale. In some embodiments, the foils disclosed herein can have an aileron that can be actuated to provide different lift or downward forces. In some embodiments, the aileron is on the aft edge of the foil. In some embodiments, the aileron can be actuated with a screw or other mechanism. In some embodiments, a foil and/or spar can be mounted onto the transom and manually slid within a slot of a bracket, or otherwise maneuvered, to change the depth of the foil. In some embodiments, a foil and/or spar can be mounted on the transom using existing swim board bracket landings and a mechanism that can allow the foil to manually drop into the water (such as with a release pin or latch) or automated with an actuator or screw.

Figure 9A:
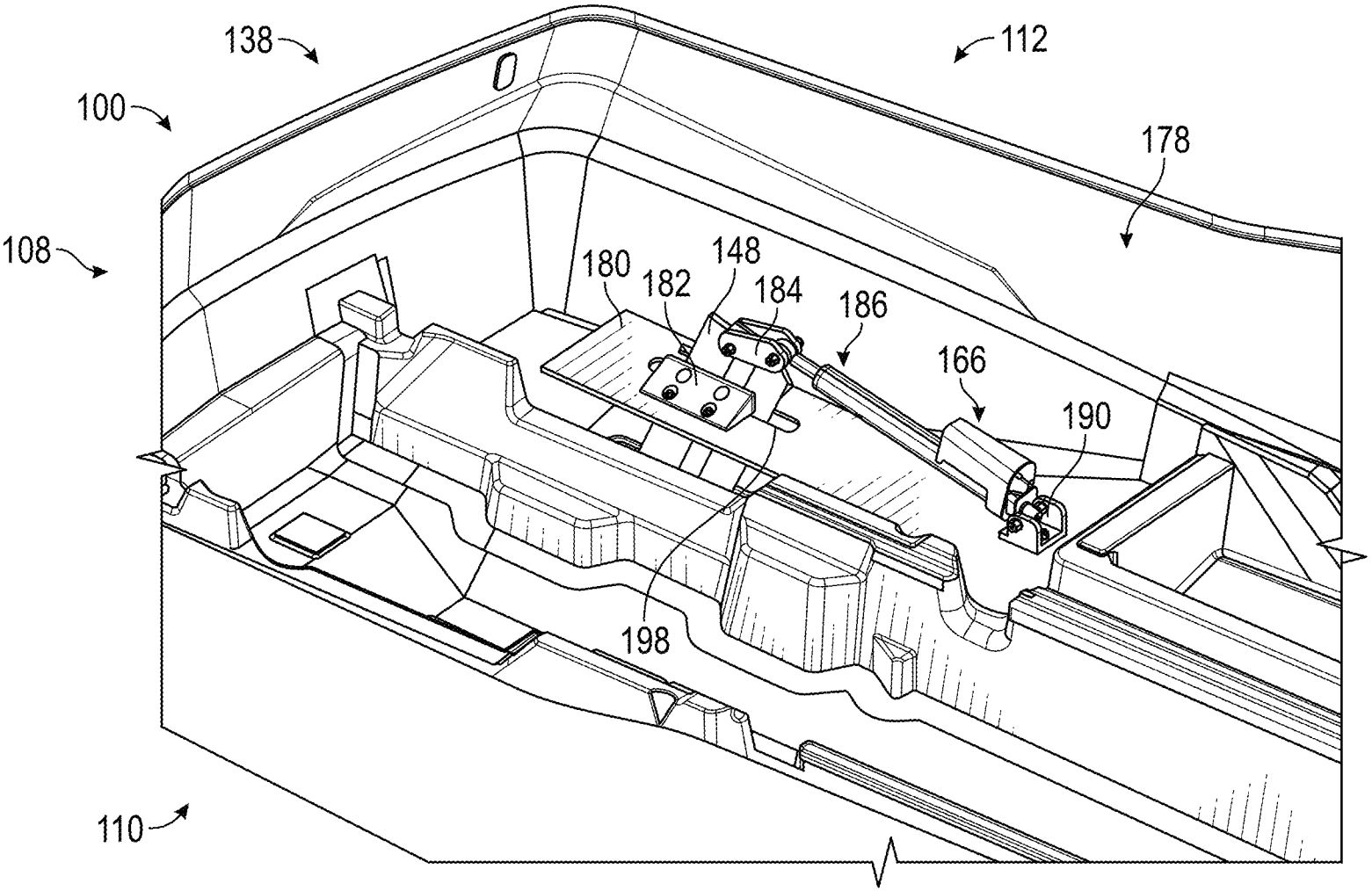
FIGS. 9A-9C illustrate various views of an example foil displacement system.
Figure 9B:
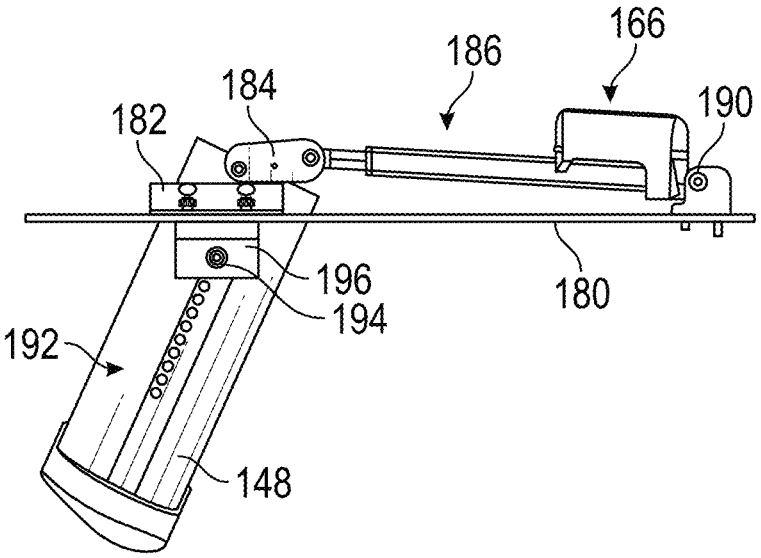
Figure 9C:
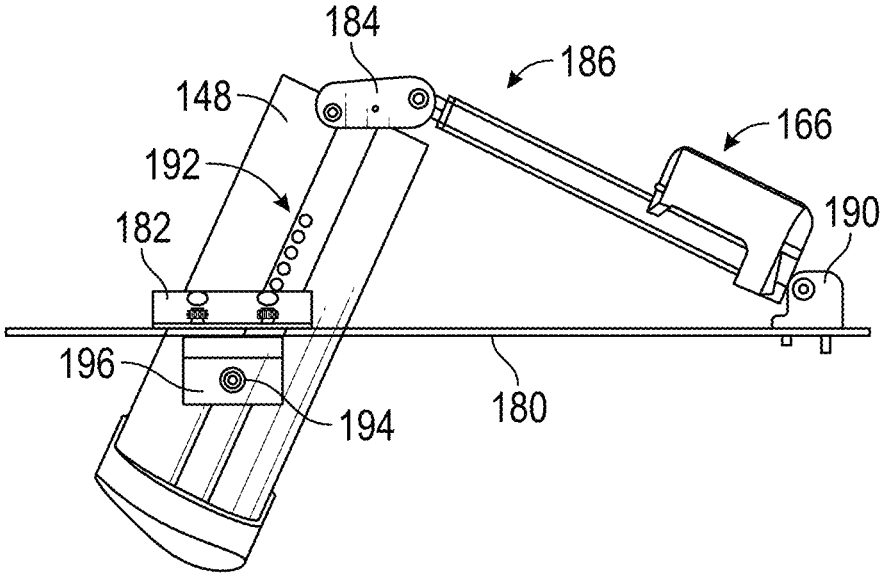

FIGS. 9A-9C illustrate a foil displacement system 138. The foil displacement system 138 includes a spar 148 attached to a foil. The spar 148 can be rotated such that the foil is oriented at different angles of attack. The spar 148 can extend through an opening (hole, slot, opening, longitudinal opening) 198 of a mounting plate (panel) 180 to couple to a coupler 184. The spar 148 can rotate with respect to the coupler 184. The coupler 184 can be connected to the shaft (arm, extender) 186 of an actuator 166. The coupler 184 can rotate with respect to the shaft 186. The shaft 186 can be extended or retracted to rotate the spar 148 in the forward or aft directions to change the angle of attack of the foil. The actuator 166 can be mounted to the mounting plate 180 and/or a portion of the water-sports boat 100 at the actuator mount 190. The actuator 166 can rotate relative to the actuator mount 190 to facilitate actuation of the shaft 186. In some embodiments, the rotation of the spar 148 can be manually performed.

The foil displacement system 138 can include a spar support(s) (guide) 182 that restrains or impedes transverse movement (movement in the starboard 110 or port 112 directions) of the spar 148. The spar supports 182 can be positioned on opposing sides (e.g., starboard side 110 and port side 112) of the opening 198 of the mounting plate 180. The spar supports 182 can have a surface that faces and is configured to engage the spar 148 to prevent transverse movement of the spar 148. The spar support(s) can be positioned on an upper surface of the mounting plate 180.

The spar 148 can have a plurality of vertical (height, depth) adjustment holes 192 that can enable the spar 148 to be selectively positioned at varying heights (elevations), as shown in FIGS. 9B and 9C. The plurality of vertical adjustment holes 192 can be distributed in the longitudinal direction of the spar 148. One or more fasteners (bolt, rod, pin) 194 can extend through a pivot mount 196 coupled to the mounting plate 180 (e.g., a lower surface of the mounting plate 180) and one of the plurality of vertical adjustment holes 192 to enable the spar 148 to rotate about the fastener 194 upon actuation of the actuator 166. The fastener 194 can be removed and reinserted through the pivot mount 196 and another one of the plurality of vertical adjustment holes 192 to move the spar 148 up and down, which can position the foil attached to the spar 148 at varying distances away from the hull 124 and/or depth within the water. For example, FIG. 9B illustrates the fastener 194 through one of the plurality of vertical adjustment holes 192 proximate a top end of the spar 148, which can position the foil a larger distance away from the hull 124 and/or deeper compared to the configuration illustrated in FIG. 9C. FIG. 9C illustrates the fastener 194 through one of the plurality of vertical adjustment holes 192 that is closer to a bottom end of the spar 148, which can position the foil a smaller distance away from the hull 124 and/or shallower compared to the configuration illustrated in FIG. 9B. In some embodiments, the vertical movement of the spar 148 can be actuated automatically.

In some embodiments, the fastener 196 and/or another component of the foil displacement system 138 can be a shear point. In some embodiments, the fastener 196 will shear if the foil or spar 148 is impacted with sufficient force (e.g., hits ground, an object, etc.) to prevent or reduce damage to the foil, spar 148, hull 124, and/or other feature of the water-sports boat 100. Other embodiments described elsewhere herein can incorporate shear points, which can be on a foil, spar, and/or another feature. In some embodiments a resettable breakaway prior to shear failure can be incorporated. In some embodiments, the spar or foil can pivot (rotate) to a resettable breakaway shear point upon impacting an object with a high force, which can be reset, such that the spar or foil do not need to be replaced. The various features of the foil displacement system 138 (e.g., the mounting plate 180, pivot mount 196, spar support 182, coupler 184, shaft 186, actuator 166, actuator mount 190, and/or other features) can be housed within the envelope 178 of the available deck height, as illustrated in FIG. 9A. In some embodiments, various features of the foil displacement system 168 can extend out of the envelop 178 of the available deck height.

Figure 10:
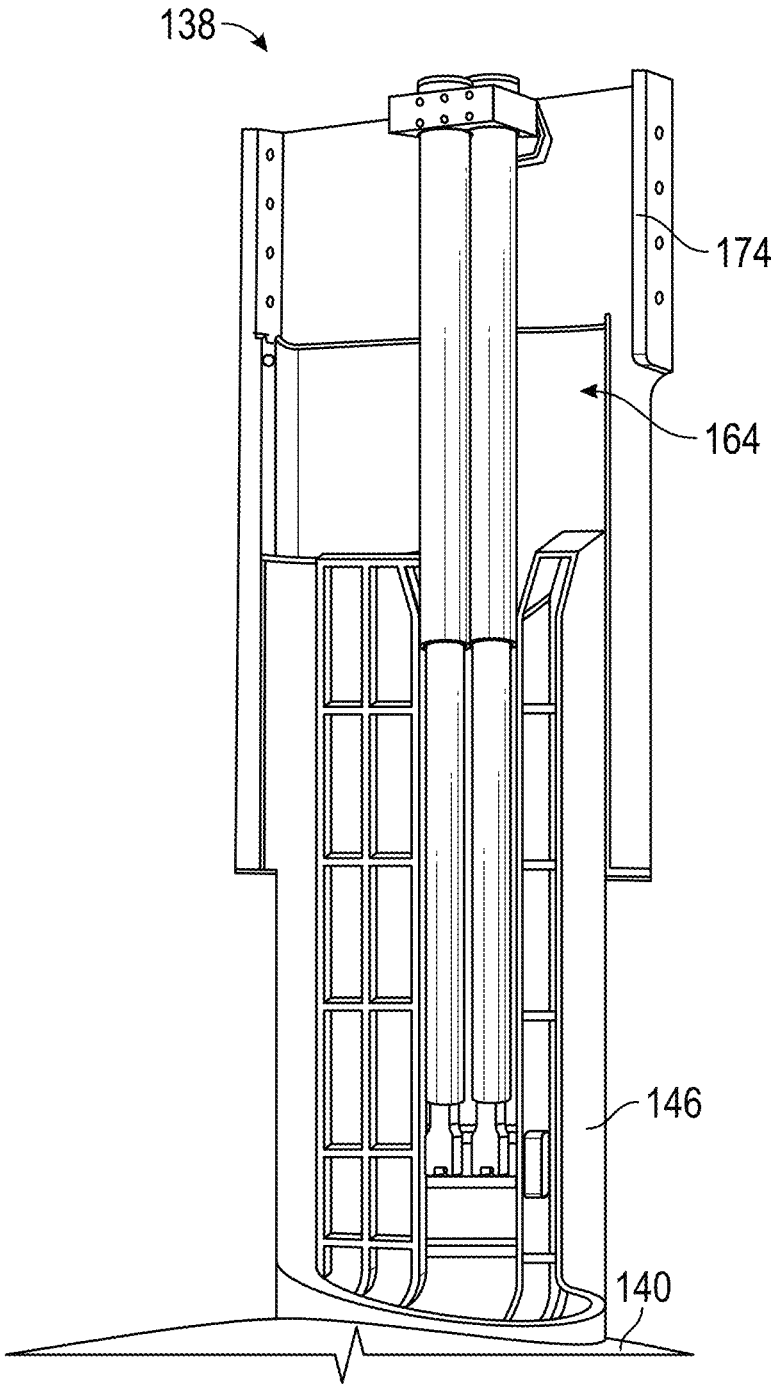
FIG. 10 illustrates an example vertical actuator.

FIG. 10 illustrates a vertical hydraulic actuator 164. The vertical hydraulic actuator 164 can vertically maneuver the spar 146 up and down. The spar 146 can be retracted and extended from a housing (insert, casing, receiver) 164 that is configured to house the spar 146 and/or forward foil 140. The housing 164 can be positioned within the hull 124 and/or extend out of the hull 124. In the stowed position, the spar 146 can be retracted by the vertical hydraulic actuator 164 into the housing 164 such that the forward foil 140 is in the stowed position. The spar 146 can be extended out of the housing 164 such that the forward foil 140 is in a deployed positon that is spaced away from the hull 124. The features described in reference to FIG. 10 can at least be used with any of the foils disclosed herein.

Figure 11B:
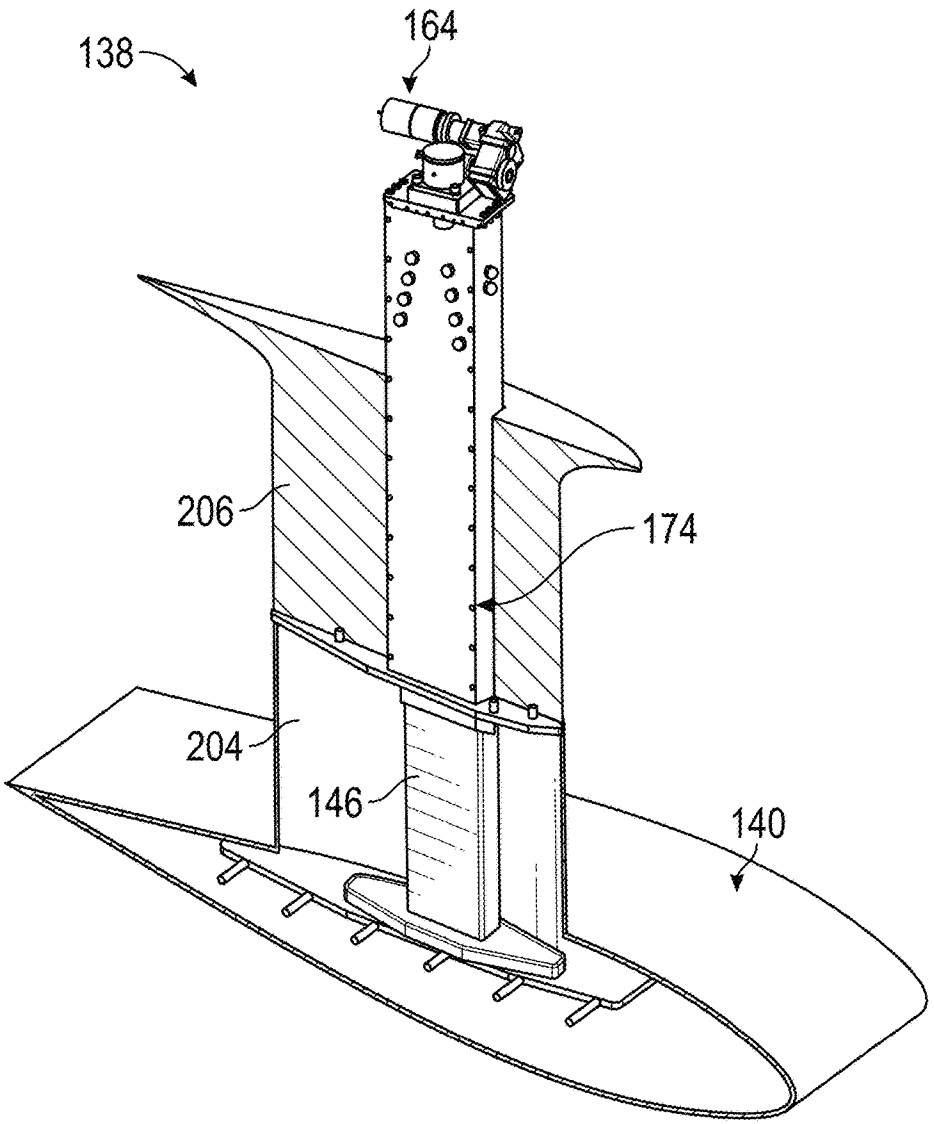
FIGS. 11A-11D illustrate various views of an example vertical actuator.
Figure 11A:
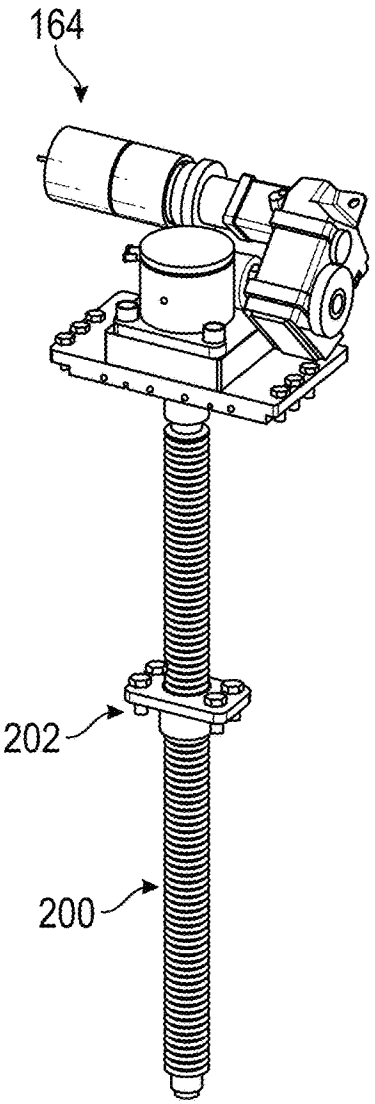
Figure 11D:
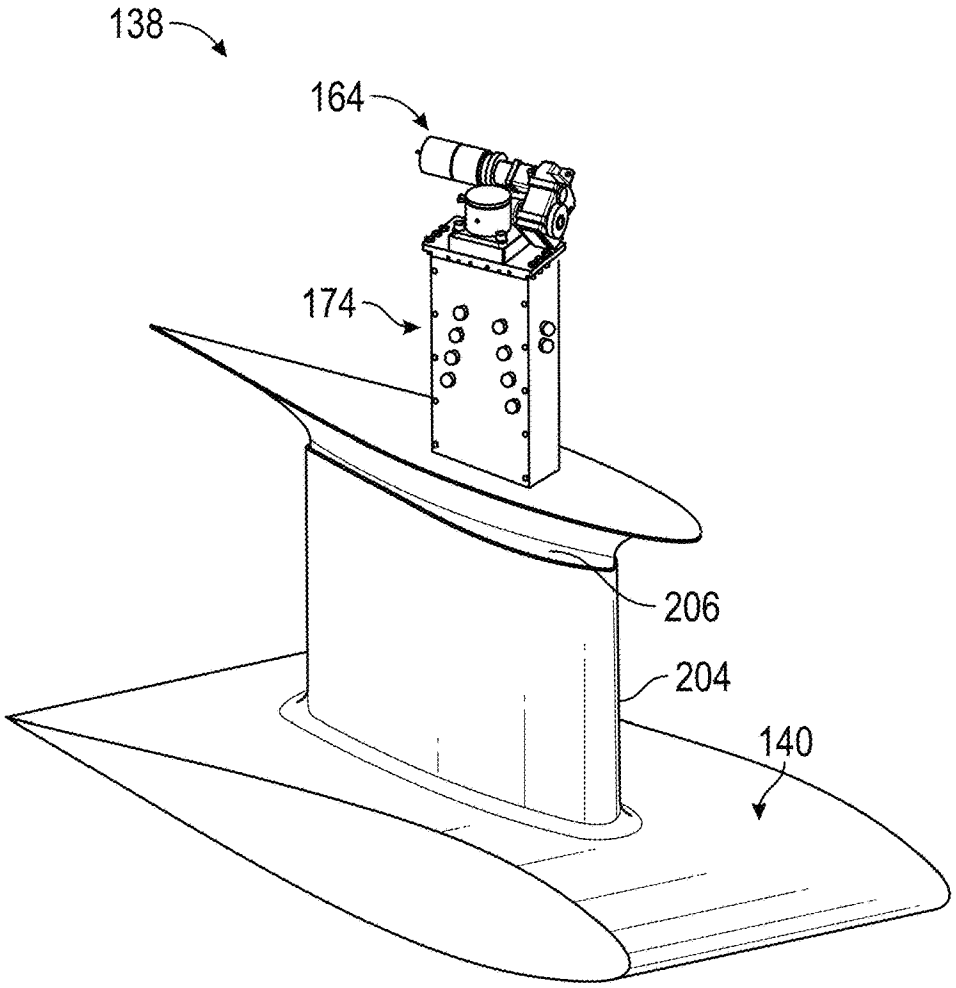
Figure 11C:
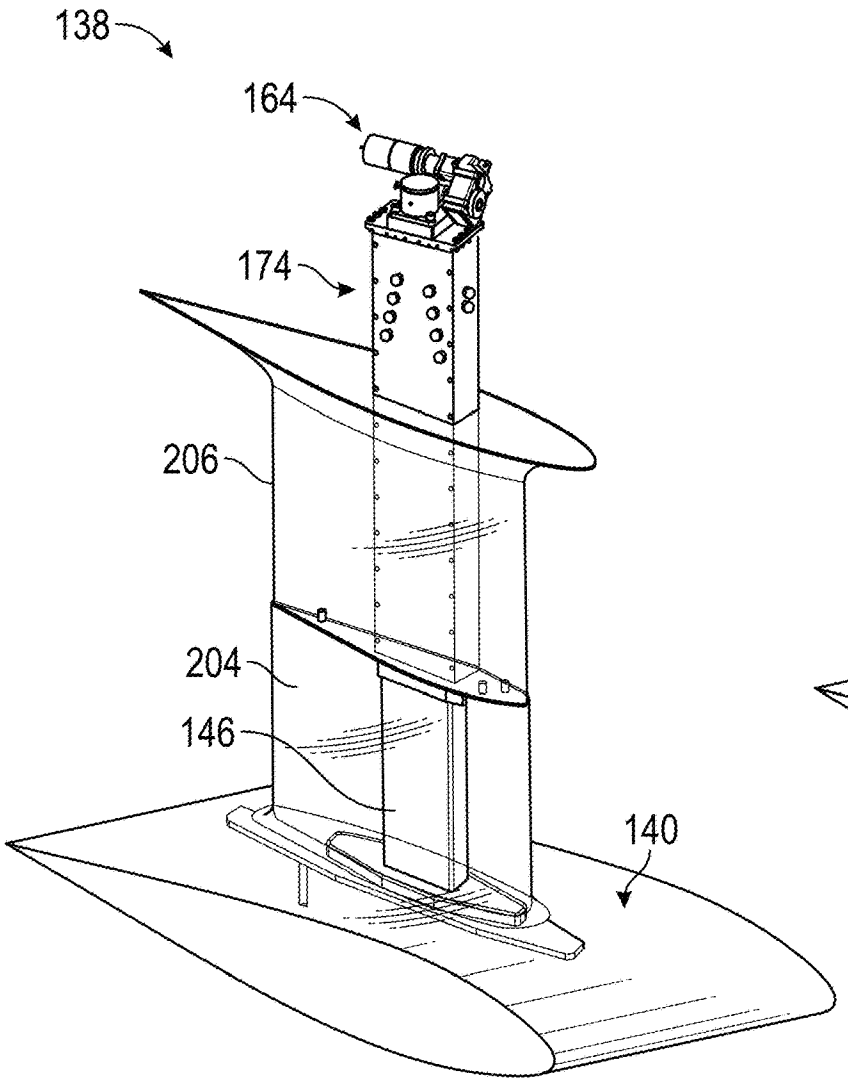

FIGS. 11A-11D illustrate a vertical jack screw actuator 164 that can retract and extend a spar to maneuver a foil. As shown in FIG. 11A, the vertical jack screw actuator 164 can include a screw (threaded shaft) 200. The vertical jack screw actuator 164 can rotate the screw 200 to maneuver the threaded connector (connecting nut, plate) 202 up and down. The threaded connector 202 can connect to the spar 146, illustrated in FIGS. 11B and 11C. The spar 146 can be retracted and extended from a housing 174 (e.g. telescope) that encloses the screw 200 and connecting nut 202 of the jack screw actuator 164. A fixed enclosure (casing) 206 can enclose the housing 174, which can provide less drag. A moveable enclosure (casing) 204 can enclose the spar 146 and connect to the foil 140. As shown in FIG. 11D, the moveable enclosure 204 can be vertically maneuvered relative to the fixed enclosure 206 and/or enclose the fixed enclosure 206. The features described in reference to FIGS. 11A-11D can at least be used with any foil described herein.

Figure 12:
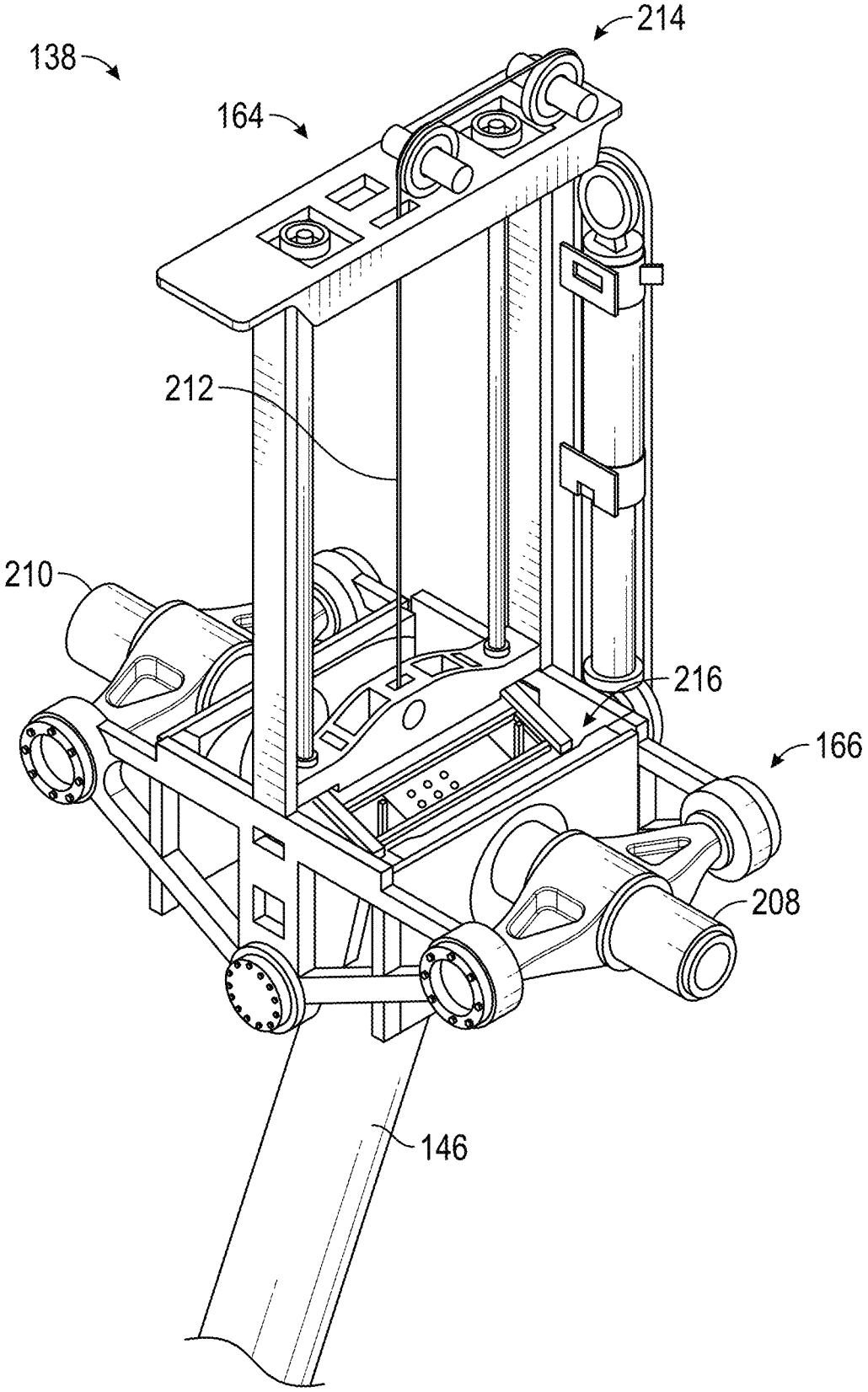
FIG. 12 illustrates an example vertical actuator and angle of attach actuator.

FIG. 12 illustrates a foil displacement system 138 that can vertical maneuver and pivot a foil. The foil displacement system 138 can include a vertical cable actuator 164 that can retract and extend a spar to maneuver a foil. The vertical cable actuator 164 can have a pulley system 214 that withdraws and releases a cable 212. The cable 212 can be coupled to a coupler 216 that can selectively couple to the spar 146. For example, the coupler 216 can release the spar 146 when the spar 146 is pivoted to orient the foil to an angle of attack. The coupler 216 can couple to the spar 146 to vertically maneuver the spar 146, which, in some embodiments, can occur when the spar 146 is not pivoted. The pulley system 214 can withdraw the cable 212 to retract the spar 146, bringing the foil closer to the hull, and release the cable 212 to extend the spar 146. The foil displacement system 138 can have a pivot actuator (canting system, canting actuator, angle of attack actuator) 166 that can pivot the spar 146 to change the angle of attack of the foil. The pivot actuator 166 can include a first actuator 208 and/or second actuator 210 that can pivot the spar 146 in the forward and aft directions to orient the foil at different angles of attack to create different lifting or downward forces. The vertical cable actuator 164 and/or pivot actuator 166 can be hydraulic, electric, pneumatic, and/or other suitable configurations. The features described in reference to FIG. 12 can at least be used with any of the foils described herein.

Figure 13B:
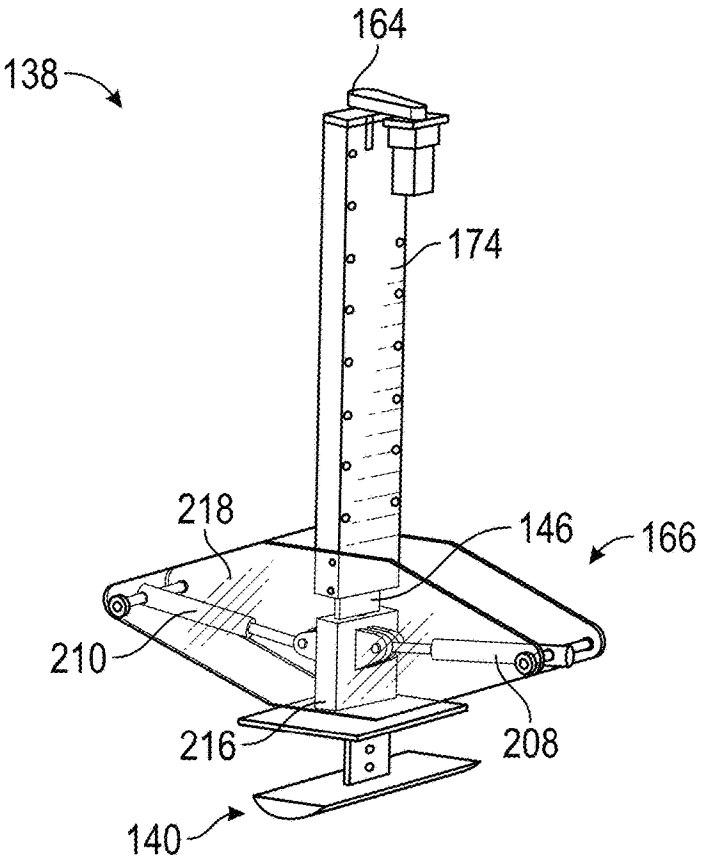
FIGS. 13A-13D illustrate various views of an example vertical actuator and angle of attack actuator.
Figure 13A:
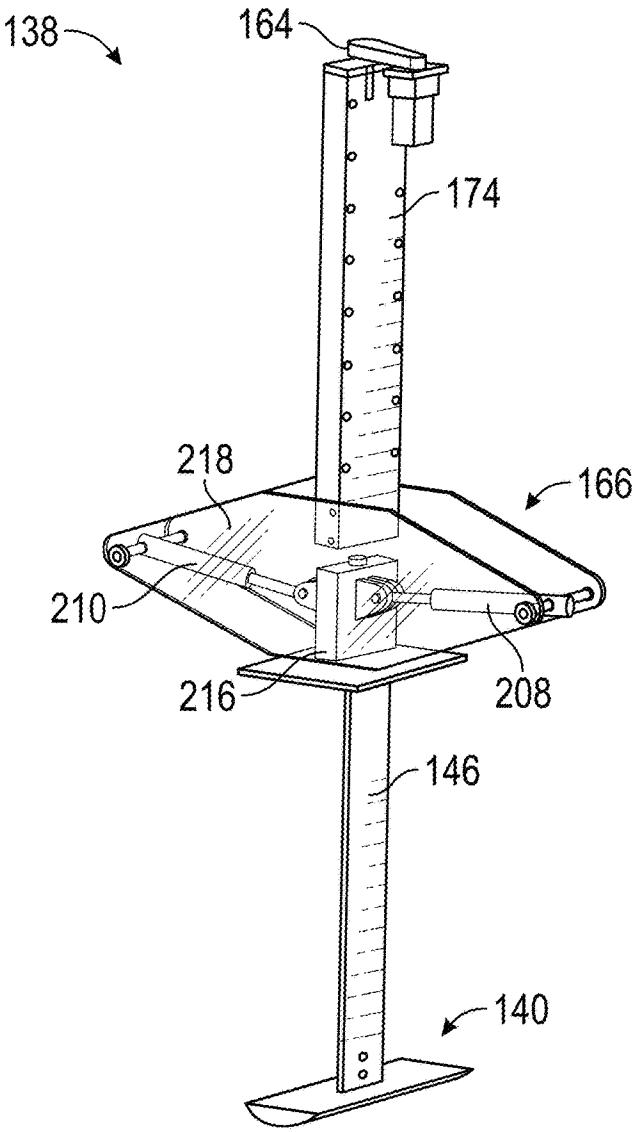

FIGS. 13A-13D illustrates a foil displacement system 138 that can vertically maneuver and pivot a foil. The foil displacement system 138 can include a vertical jack screw actuator 164 that can retract and extend the spar 146 from inside a housing (enclosure, slot, casing) 174 as shown in FIGS. 13A and 13B. The housing 174 can be positioned, which can include partially positioned, within the hull 124 of a water-sports boat 100. The vertical jack screw actuator 164 can be selectively coupled with the spar 146 at the coupler 216. In some embodiments, the coupler 216 decouples the vertical jack screw actuator 164 from the spar 146 after full deployment of the spar 146.

Figure 13D:
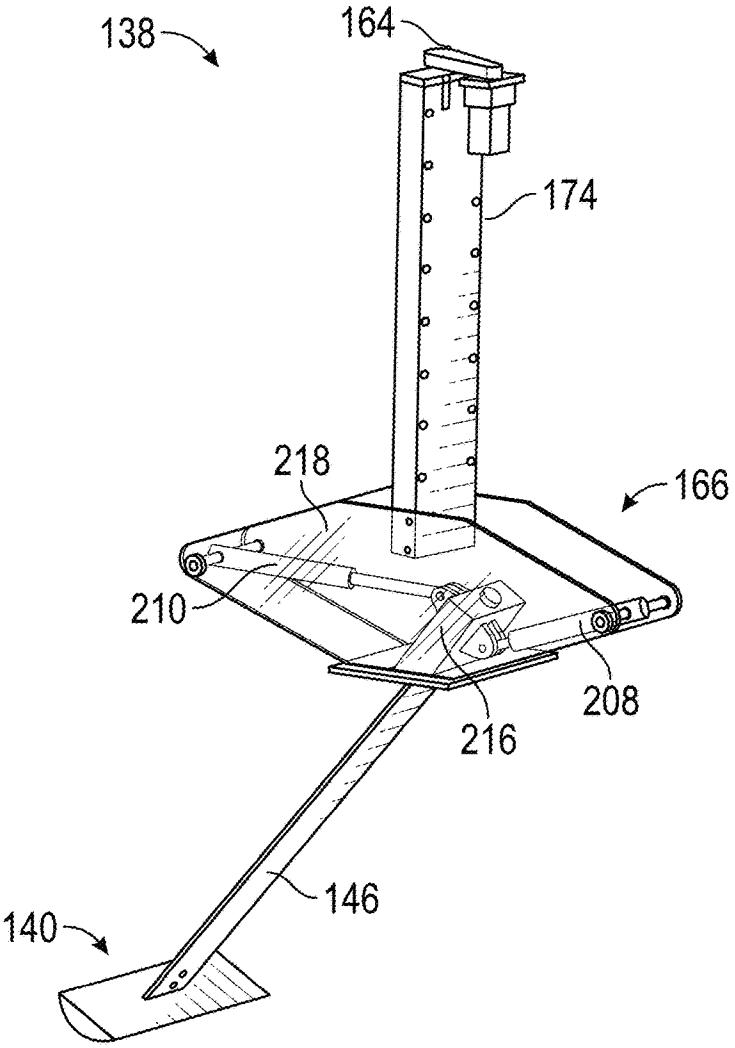
Figure 13C:
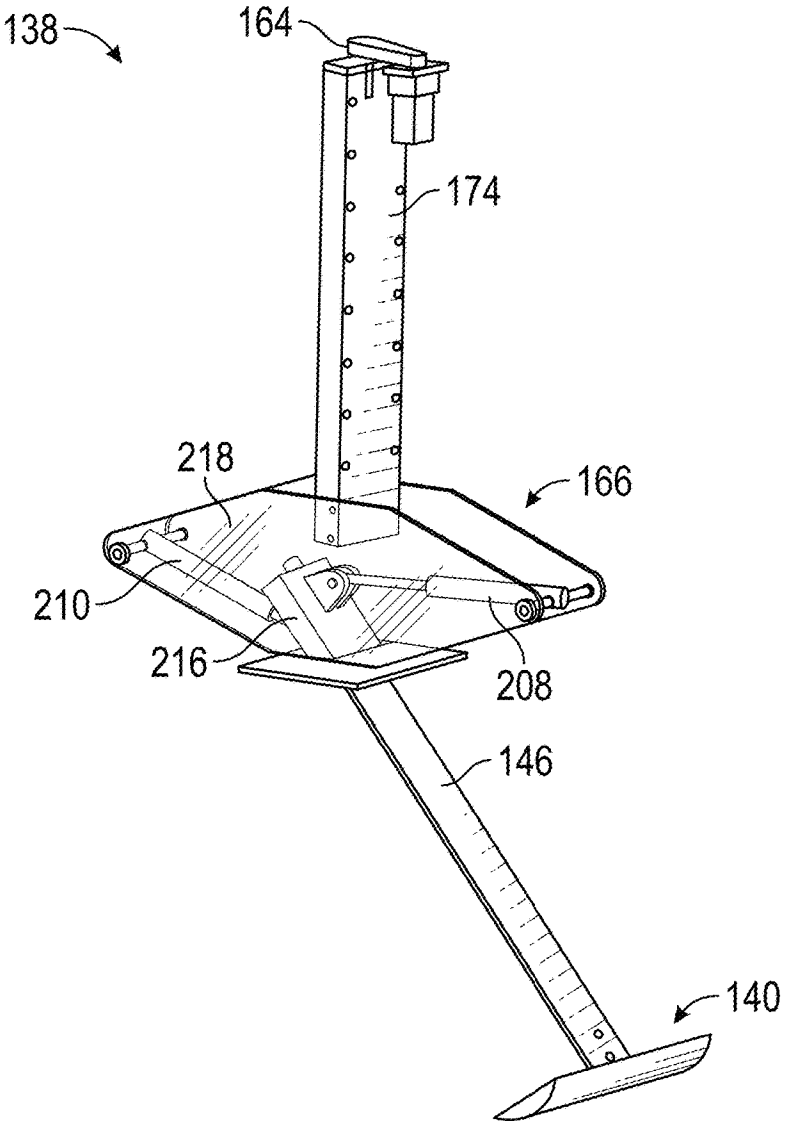

The foil displacement system 138 can include a pivot actuator (canting system, canting actuator, angle of attack actuator) 166 that can pivot the spar 146 to change the angle of attack of the foil 140. The pivot actuator 166 can include a first actuator 208 and/or second actuator 210 that can pivot the spar 146 in the forward and aft directions to orient the foil at different angles of attack to create different lifting or downward forces. For example, as shown in FIG. 13C, the first actuator 208 can extend and/or the second actuator 210 retract to pivot the spar 146 in the forward direction to create lifting forces. As shown in FIG. 13D, the first actuator 208 can retract and/or second actuator 210 extend in the aft direction to create downward forces. The first actuator 208 and/or second actuator 210 can be coupled and pivot relative to the coupler 216. The first actuator 208 and/or second actuator 210 can be coupled and pivot relative to a housing (casing, enclosure) 210 that surrounds the pivot actuator 166, coupler 216, and/or a portion of the housing 174. The housing 210 can be positioned or at least partially positioned within the hull 124. The spar 146 can decouple from the vertical jack screw actuator 164 to allow the spar 146 to pivot. In some embodiments, the first actuator 208 or second actuator 210 is used. The features described in reference to FIG. 13A-13D can at least be used with any of the foils described herein.

Figure 14:
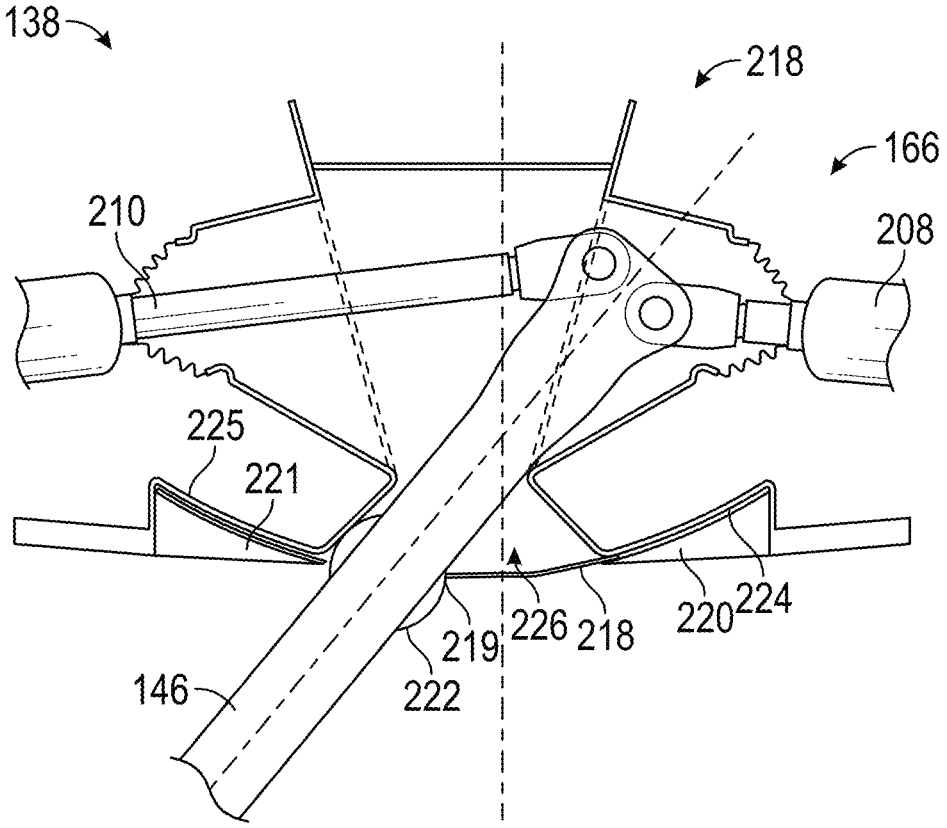
FIG. 14 illustrates an example angle of attack actuator.

FIG. 14 illustrate a foil displacement system 138 that can pivot a spar. The foil displacement system 138 can include a pivot actuator (canting system, canting actuator, angle of attack actuator) 166 that can pivot the spar 146 to change the angle of attack of the foil. The pivot actuator 166 can include a first actuator 208 and/or second actuator 210 that can pivot the spar 146 in the forward and aft directions to orient a foil at different angles of attack to create different lifting or downward forces. The pivot actuator 166 can be enclosed within a housing 218. The pivot actuator 166 can operate in a dry environment. The spar 146 can extend into the housing 218 via an opening 226 to couple to the first actuator 208 and/or second actuator 210. The spar 146 can pivot with respect to the first actuator 208 and/or second actuator 210. A sliding plate (sealing plate) 218 can impede water from entering the housing 218 via the opening 226. The spar 146 can extend through an opening 219 of the sliding plate 218 to couple to the first actuator 208 and/or second actuator 210. The portion of the spar 146 that extends through the opening 226 can have rounded surface(s) 222 that create a substantially water tight interface with the periphery of the sliding plate 218 that defines the opening 226. The rounded surface(s) 222 can continuously contact the periphery of the sliding plate 218 that defines the opening 226 when the spar 146 pivots. The pivoting of the spar 146 can slide the sliding plate 218 within slots (gaps, cavities) 224, 225 between fairing wedges 220, 221 and the housing 218 to block water from entering the housing 218 via the opening 226 during canting of the spar 146. In some embodiments, the pivot actuator 166 operates in a wet environment.

FIGS. 15A-16C illustrate the results of a computational fluid dynamics (CFD) analysis of a configuration of the water-sports boat 100 in use. The water-sports boat 100 in the analysis was configured as shown in FIGS. 6A-C. The water-sports boat 100 had a longitudinal center of gravity positioned sixteen feet aft of the bow 116 (e.g., sixteen feet aft of the forward perpendicular), draft of 1 foot and 6⅝ inches, and hull displacement of 8,532 pounds. The water-sports boat 100, in the CFD analysis, was 25 feet from bow to stern. The water-sports boat 100, in the CFD analysis, was 256.02 inches in length at the water line. The water-sports boat 100, in the CFD analysis, had a hull of the Malibu 25 LSV boat model. The hull, in the CFD analysis, was a traditional bow monohull water-sports boat. The water-sports boat 100 had an inverted NACA 4418 forward foil and two aft inverted Eppler 420 foils. The aft foils were positioned with the center of the support spars at 68.55 inches aft of the LCG. The forward foil was positioned with the center of the support spar at 45.56 inches forward of the LCG.

Figure 15A:
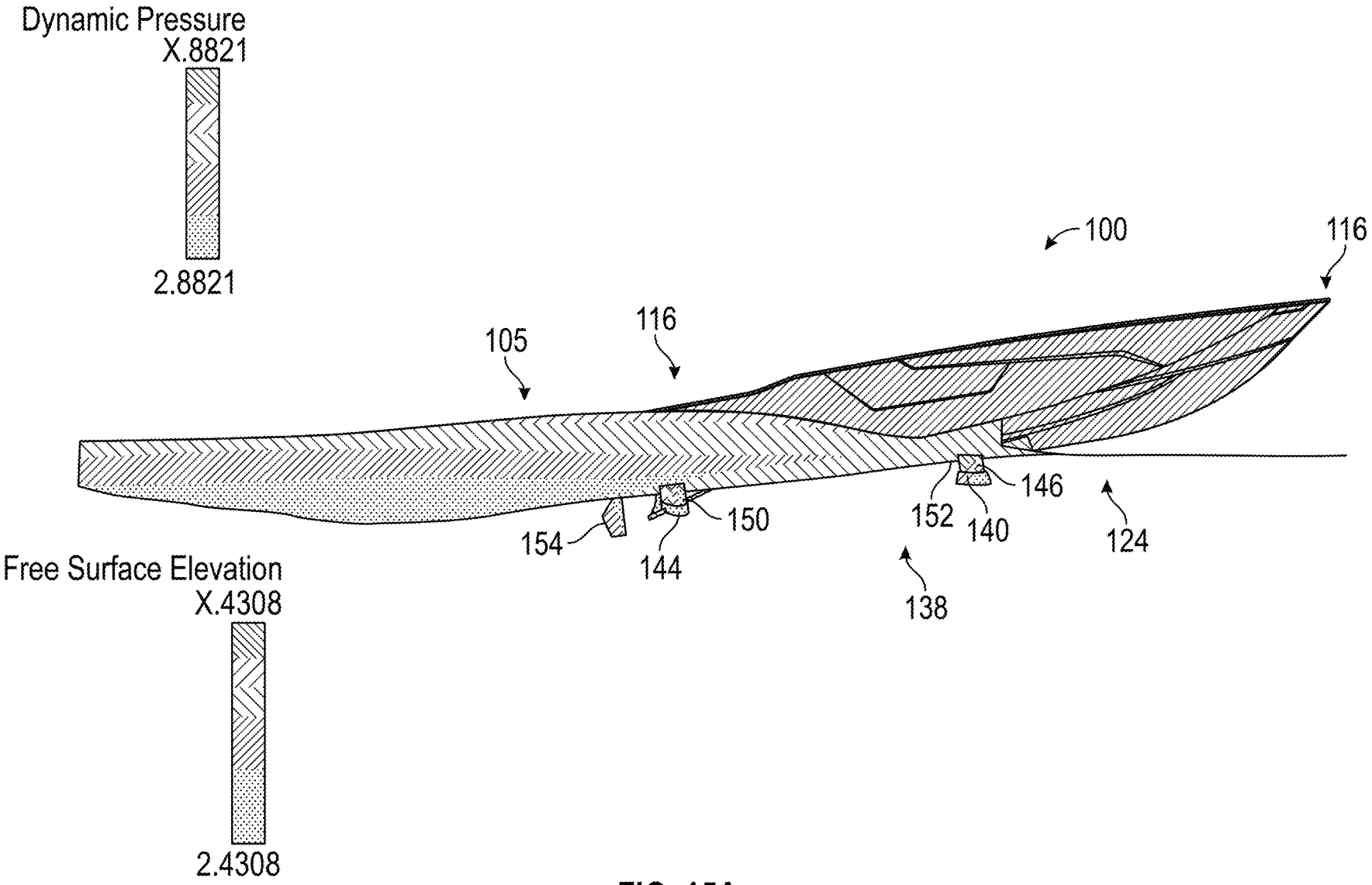
FIGS. 15A-15C illustrate results from a computational fluid dynamics (CFD) analysis for a water-sports boat in a wake boarding configuration.
Figure 15B:
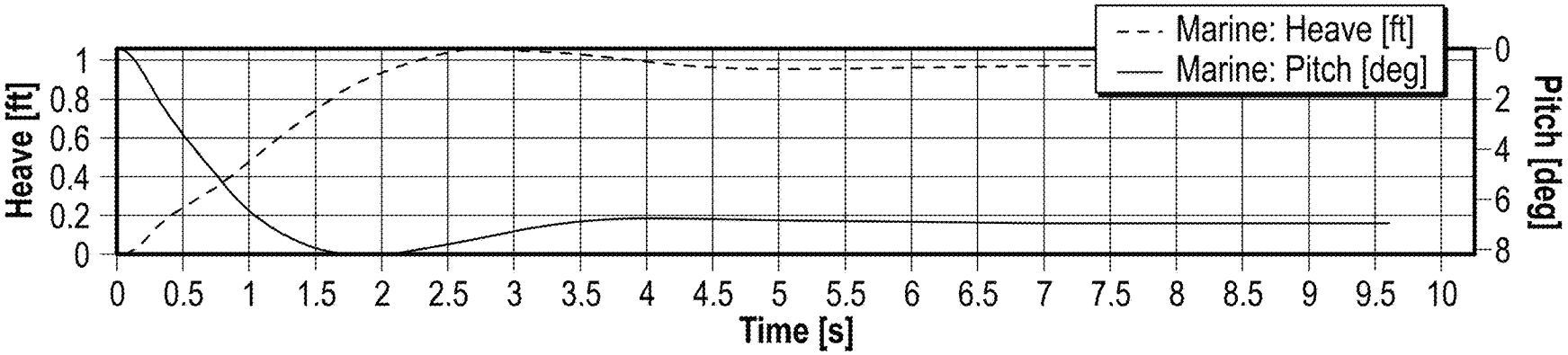
Figure 15C:
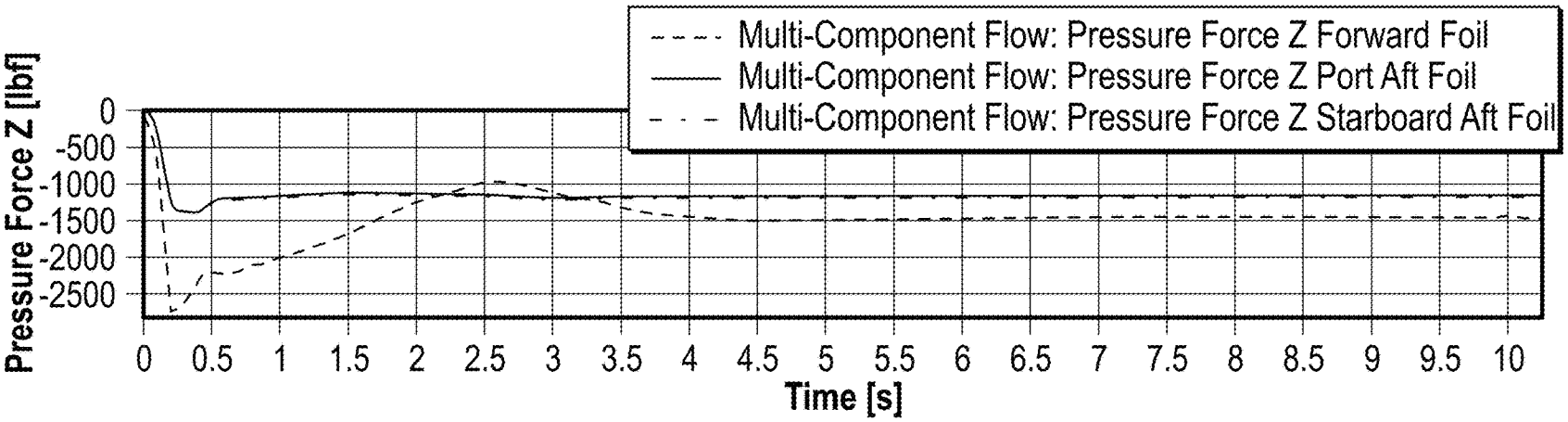

FIGS. 15A-15C illustrate the results of a CFD analysis with the water-sports boat 100 in an expected configuration suitable for wakeboarding with the wake shaper 128 stowed. The water-sports boat 100 is traveling at approximately 22 MPH. The spar 146 of the forward foil 140 and spars 148, 150 of the starboard aft foil 144 and port aft foil 142 are not pivoted (raked) from the neutral position. FIG. 15A illustrates the water-sports boat 100 traveling through water in the above configuration. The illustrated patterns on the water-sports boat 100 show pressure distributions while the illustrated patterns on the water indicate differences in elevation.

FIG. 15B illustrates a graph showing the resulting heave at the center of gravity in feet and pitch angle in degrees of the water-sports boat 100 operating under the wakeboarding configuration described above. The heave at the center of gravity is positive 0.968 feet and the pitch angle is positive 6.9 degrees (bow up), which are reflected at the far right of the graph where the lines converge on the foregoing values.

FIG. 15C illustrates a graph showing the resulting vertical force produced by the foils of the water-sports boat 100 in the wakeboarding configuration described above. The vertical force on the forward foil 140 is negative (down force, downward suction force) 1,456 pounds. The vertical force on the starboard aft foil 144 is negative 1,176 pounds. The vertical force on the port aft foil 142 is negative 1,176 pounds.

Figure 16A:
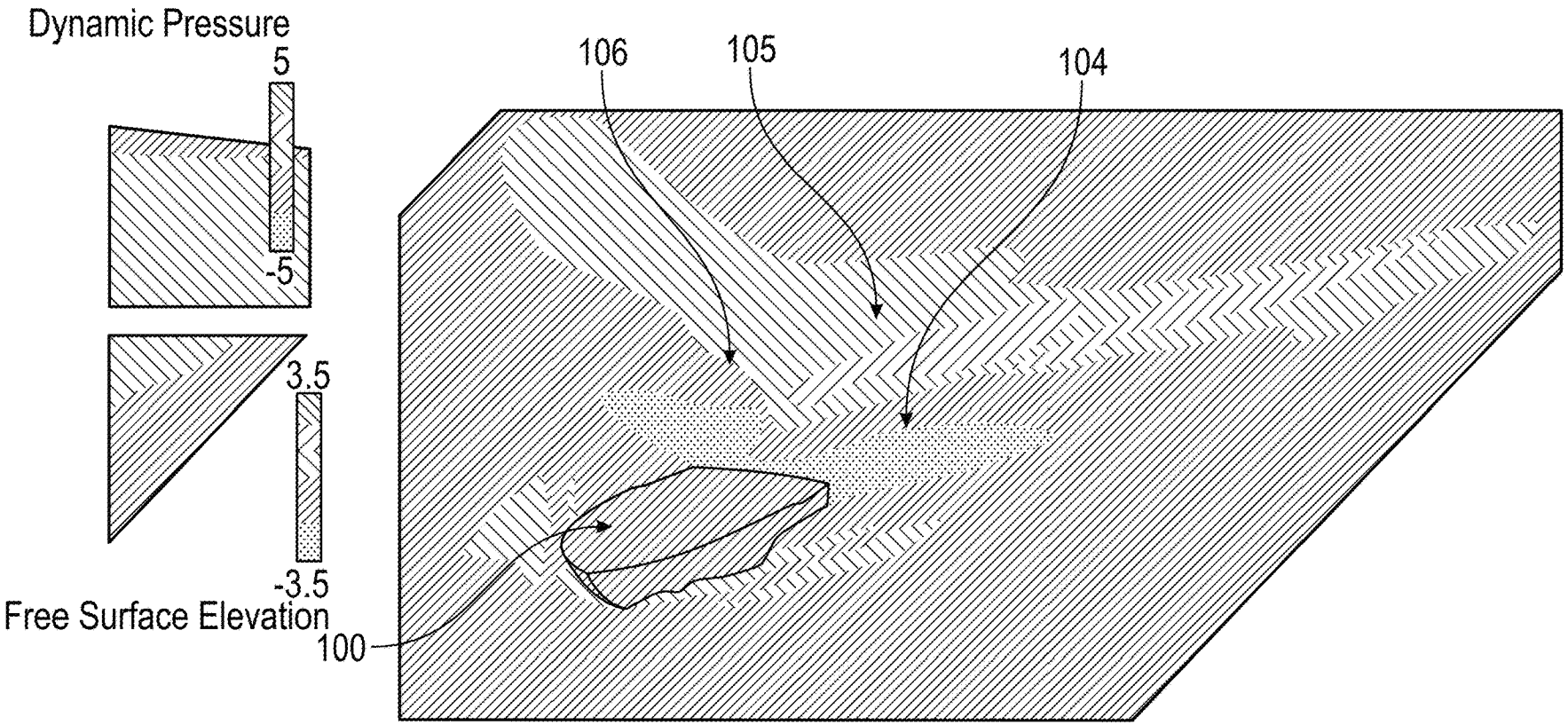
FIGS. 16A-16D illustrate results from a CFD analysis for a water-sports boat in a wake surfing configuration.
Figure 16B:
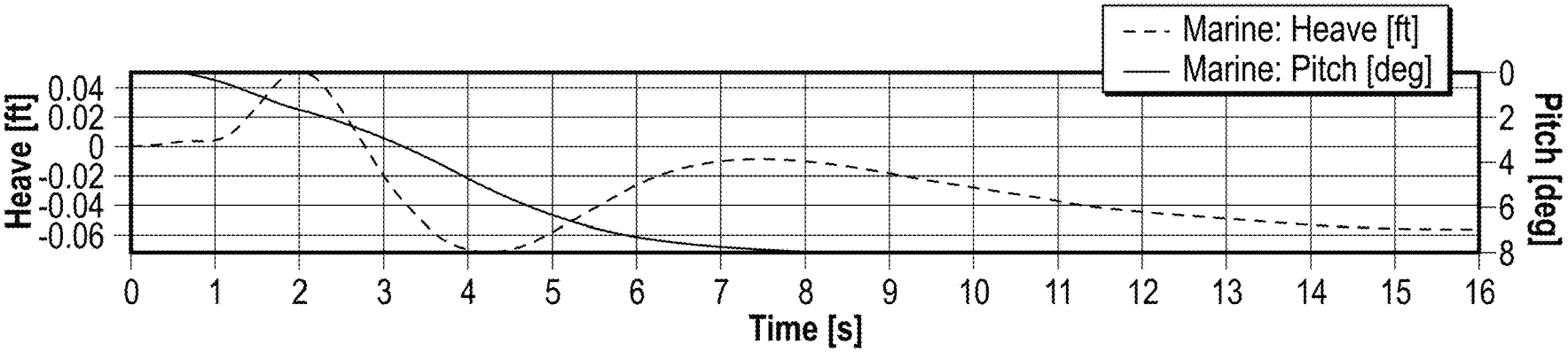
Figure 16C:
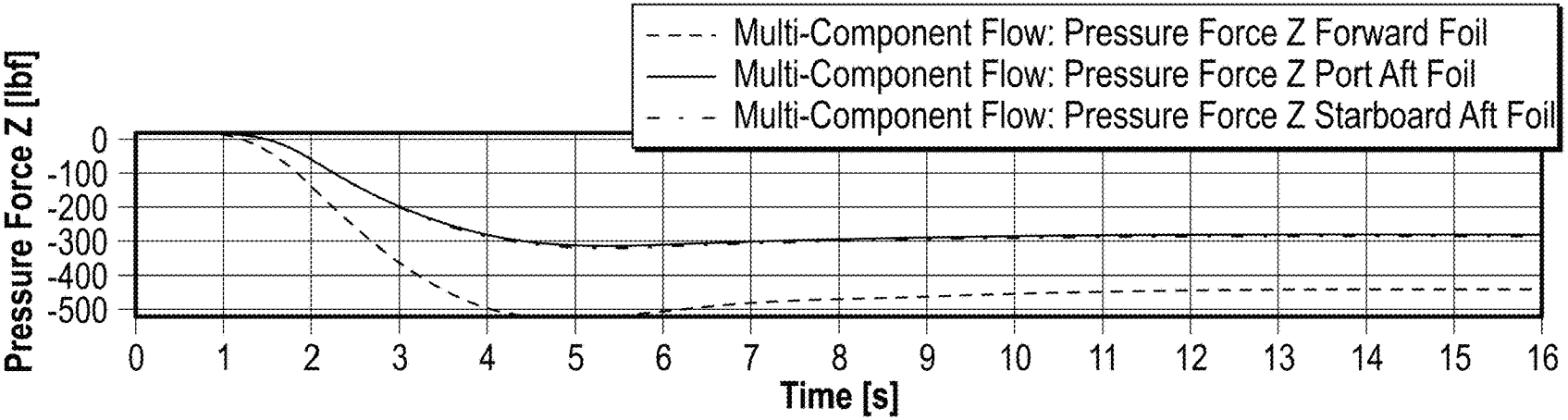

FIGS. 16A-16C illustrate the results of a CFD analysis with the water-sports boat 100 in a configuration suitable for wake surfing on the port-side portion 104 of the wake 105. The water-sports boat 100 is traveling at approximately 11.2 MPH. The spar 146 of the forward foil 140 and spars 148, 150 of the starboard aft foil 144 and port aft foil 142 are not pivoted (raked) from the neutral position. The water diverter (wake shaper) 128 is deployed on the port side 112, as illustrated in FIGS. 6A-6C. FIG. 16A illustrates the water-sports boat 100 traveling through water in the above-described wake surfing configuration. The illustrated patterns on the water-sports boat 100 show pressure distributions while the illustrated patterns on the water indicate differences in elevation. The port-side portion 104 has the following characteristics: a crest-trough height of 3 feet and 2¾ inches, wave face length of 14 feet and 2 inches, wave face slope of 48.3 degrees, and wave radiated angle of 31.6 degrees.

FIG. 16B illustrates a graph showing the resulting heave at the center of gravity in feet and pitch angle in degrees of the water-sports boat 100 operating under the wake surfing configuration described above. The heave at the center of gravity is positive 0.057 feet and the pitch angle is positive 8.034 degrees (bow up), which are reflected at the far right of the graph where the lines converge on the foregoing values. The lack of heave indicates good balancing of forces between the forward foil 140 and the aft foils 142, 144.

FIG. 16C illustrates a graph showing the resulting vertical force produced by the foils of the water-sports boat 100 in the wake surfing configuration described above. The vertical force on the forward foil 140 is negative (down force, downward suction force) 447 pounds. The vertical force on the starboard aft foil 144 is negative 298 pounds. The vertical force on the port aft foil 142 is negative 298 pounds. These negative vertical forces are substantially less than the ballast weight that would need to be added to the water-sports boat 100 to achieve the same or similar wave characteristics described in reference to FIG. 16A. A CFD analysis determined that the ballast tanks of the water-sports boat 100 would need to be filled to approximately 3,309 pounds to produce a similar wave profile. This improvement performance is understood to be, at least in part, due to increased control of the pitch angle of the water-sports boat 100 that is possible with the foil displacement systems disclosed herein. For example, lifting the bow 116 with the forward foil 140 can produce a wake 105 that is steep and short while lowering the bow 116 with the forward foil 140 can produce a wake 105 that is less steep and longer.

Figure 16D:
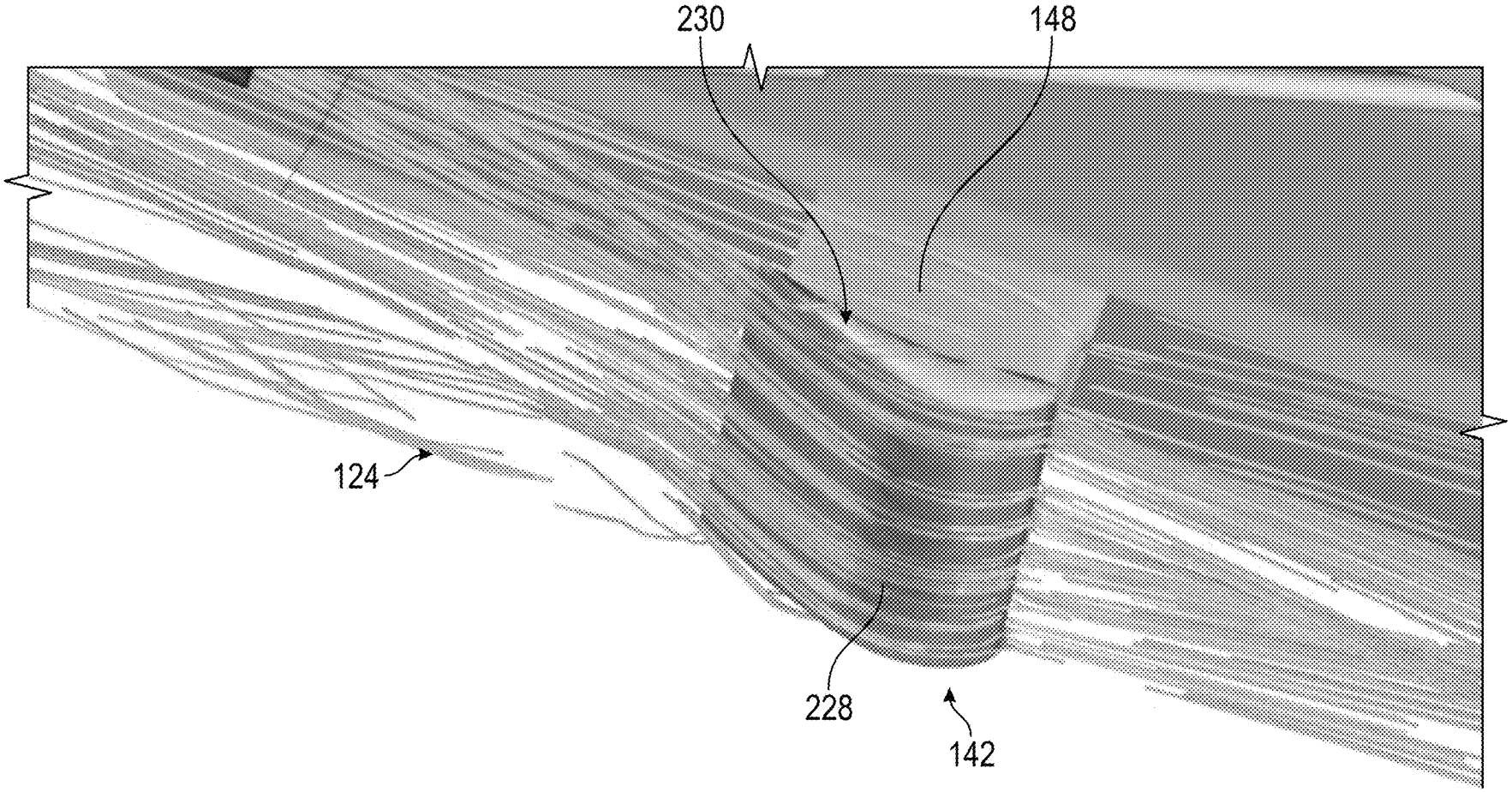

FIG. 16D illustrates stream lines smoothly flowing over the aft foil 144 when the water-sports boat 100 is in the wake surfing configuration described above. The illustrated patterns on the water-sports boat 100 show pressure distributions. For example, water is moving fastest at the portion 228 of the aft foil 144 creating a low pressure area that results in a suction downward force pulling the aft foil 144 and the stern 108 of the water-sports boat 100 downward. Stated differently, the pressure above the aft foil 144 is greater than the pressure at the portion 228 which pushes or pulls the aft foil 144 and stern 108 deeper into the water. The Eppler 420 foil configuration avoids substantial vortices but some vortices 230 are present. Vortices, as discussed elsewhere herein, can cause noise, vibrations, and diminished force production, if significant. The vortices 230 could be further reduced by tapering the aft foil 144 and/or adding winglets.

Figure 17:
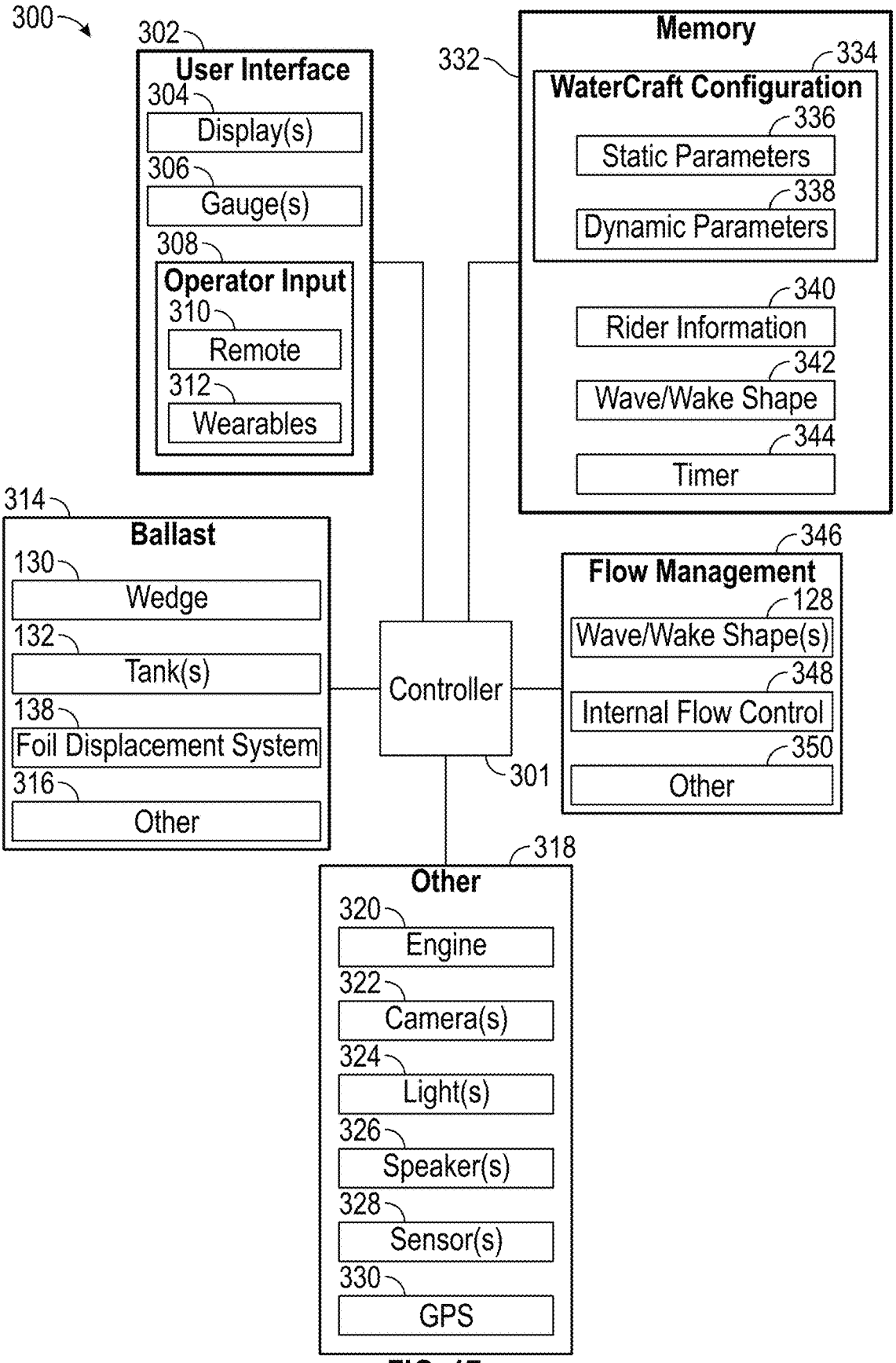
FIG. 17 schematically illustrates an example control system.

FIG. 17 schematically illustrates an example control system 300. The control system 300 can operate the foil displacement systems 138 as described herein. The architecture of the control system 300 can include an arrangement of computer hardware and software components used to implement aspects of the present disclosure. The control system 300 may include more or fewer elements than those shown in FIG. 17. It is not necessary, however, that all of these elements be shown in order to provide an enabling disclosure.

The control system 300 can be integrated into the water-sports boat 100, for example, fully integrated with a CAN bus of the water-sports boat 100. In some embodiments, the control system 300 or a portion thereof can be an aftermarket solution which may be installed on and/or otherwise connected with the water-sports boat 100, which can include connecting into the CAN bus or operating independently of the CAN bus. The control system 300, in some embodiments, can control the foil displacement system 138 and/or other systems and features of the water-sports boat 100, such as those illustrated in FIG. 17, which can include a wedge 130, ballast tank system 132, engine 320, camera(s) 322, light(s) 324, speaker(s) 326, sensor(s) 328, GPS 330, flow management system, user interface 302, etc. The control system 300 can include a controller 301 that is in communication, via a data communication technique (e.g., wired and/or wireless) with a memory system 332, user interface 302, ballast system 314, flow management system 346, and/or other systems 318.

The user interface 302 can provide (e.g., display) information to an operator and/or receive input from the operator. The user interface 302 and/or portions thereof can be integrated into the water-sports boat 100, such as built into a console proximate an operator's seat. The user interface 302 and/or portions thereof can be an application on a portable device, such as an operator's phone. The user interface 302 can include display(s) 304 and/or gauge(s) 306. In some embodiments, the display(s) 304 can be the operator's phone. The display(s) 304 can show status/configuration information regarding the water-sports boat 100 and/or the systems thereof. For example, the display(s) 304 can illustrate the status of the foils of the foil displacement system 138, such as whether the foils are stowed, deployed, in an intermediate positon, creating lift, the quantity of lift force generated, creating a downward force, the quantity of lift force generated, and/or information. The display(s) 304 can illustrate the status of the ballast tank system 132, wedge 130, wave shaper(s) 128, engine 320, etc.

In some embodiments, the display(s) 304 can show a view from camera(s) 322. The camera(s) 322 can show a view of the sternward 108, which can advantageously enable an operator of the water-sports boat 100 to monitor the status of a rider surfing, wakeboarding, etc. without turning to look sternward. In some embodiments, the display(s) 304 can display an alert if the foil displacement system 138 is not functioning, unable to perform as requested, etc. The gauge(s) 306 can display information such as fuel level, battery level, forces generated by the foils of the foil displacement system 138, the fill level of the tank(s) of the ballast tank system 132, etc.

The user interface 302 can receive operator input 308. The user interface 302 can receive operator input 308 to control the foil displacement system 138 and/or other systems, features, etc. of the water-sport boat 100, such as the wedge 130, ballast tank system 132, and wake shaper(s) 128. In some embodiments, the display(s) 304 are touch screen(s) that can receive operator input. In some embodiments, operator input 308 is received via a switch, button, and/or the like. In some embodiments, operator input 308 can be received via a remote device 310, such as through an app on an operator's phone or other portable device. In some embodiments, operator input 308 can be received via a wearable device 312, such as a wrist band or key fob or the like. In some embodiments, a rider can wear the wearable device 312 and control the wedge 130, ballast tank system 132, foil displacement system 138, and/or wave shaper(s) 128 while surfing, wakeboarding, etc. to change wave characteristics as desired. In some embodiments, the operator input 308 includes a go-home switch (button) that, when manipulated, can automatically stow wedge 130, empty the tanks of the ballast tank system 132, stow foils of the foil displacement system 138, stow wave shaper(s) 128, and/or perform other automated tasks to prepare the water-sports boat 100 for docking, loading onto a trailer, etc.

The memory system 332 can generally include RAM, ROM and/or other persistent auxiliary or non-transitory computer-readable media. The memory system 332 can store an operating system that provides computer program instructions for the controller 301 in the general administration and operation of the foil displacement system 138 and/or other systems, features, etc., which can at least include the methods described herein. The memory system 332 can store watercraft configuration information 334, which can include static parameters 336 such as hull shape, hull length, weight, etc., and/or dynamic parameters 338 such as passenger weight, ballast tank system 132 status, wedge 130 status, speed, water depth, fuel, wind conditions, engine 322 status, wake shaper(s) 334 status, etc. The memory system 332 can store rider information 340, such as favorite configurations of the wedge 130, ballast tank system 132, foil displacement system 138, wave shaper(s) 128, speed of the water-sports boat, etc. This can enable the rider to conveniently store and reselect favorite configurations without reselecting the desired configuration for each of the wedge 130, ballast tank system 132, foil displacement system 138, wave shaper(s) 128, speed of the water-sports boat, etc. The memory system 332 can include wave/wake shape instructions 342 to control the wedge 130, ballast tank system 132, foil displacement system 138, wave shaper(s) 128, speed of the water-sports boat 100, etc. to create a suitable wake shape for water skiing, wake boarding, surfing, pulling inflatables, minimizing a wake, reducing fuel use, improving the speed of the water-sports boat, improving riding comfort, etc. The memory system 332 can include wave/wake shape instructions 342 to control the wedge 130, ballast tank system 132, foil displacement system 138, wave shaper(s) 128, speed of the water-sports boat 100, etc. to create wakes of varying sizes, such as large, medium, and/or small wakes, and/or to position a surfing wave in the port, starboard, and/or center position. In some embodiments, the memory system 332 includes a timer 344 to determine whether the foil displacement system 138 and/or other system is performing correctly, as described elsewhere herein. The memory system 332 can include operation instructions for performing all the methods and actions described herein.

The flow management system 346 can include the wake shaper(s) 128. The flow management system 346 can include internal flow control 348, which can monitor the flow of water into the tanks of the ballast tank system 132.

The other systems 318 can include the engine 320, camera(s) 322, light(s) 324, speaker(s) 326, sensor(s) 328, and/or GPS 330. The camera(s) 322 can capture varying views of the water-sports boats 100 and surroundings. For example, the camera(s) 322 can capture a sternward view that can show a rider. In some embodiments, the camera(s) 322 can be used to detect when a rider has fallen into the water such that the control system 300 can alert the operator via the display(s) 304, light(s) 324, and/or speaker(s) 326. In some embodiments, the camera(s) 322 can provide the control system 300 with the current position of the rider such that the control system 300 can adjust the configuration of the wedge 130, ballast tank system 132, foil displacement system 138, and/or wake shaper(s) 128 to create a suitable wake based on the rider position. For example, the control system 300 can, in some embodiments, switch the surfing wake from the starboard side to the port side upon detecting that the rider has switched from the starboard portion 106 to the port portion 104 of the wake 105. The light(s) 324, speaker(s) 326, and/or display(s) 304 can provide alerts to the operator.

The sensor(s) 328 can include orientation sensor(s) that detect the pitch, roll, and/or yaw orientations of the water-sports boat 100. In some embodiment, an orientation sensor is positioned aft of the transverse axis 120 and another is positioned forward of the transverse axis 120 to detect pitch. In some embodiments, an orientation sensor is positioned on the starboard side 110 and another is positioned on the port side 112 to detect roll. In some embodiments, the foregoing configuration(s) of the orientation sensor(s) can also detect yaw. In some embodiments, an orientation sensor(s) can detect heave of the water-sports boat 100. In some embodiments, the sensor(s) 328 can include depth sensor(s) that can detect the depth of the water in which the water-sports boat 100 is positioned. In some embodiments, the foil displacement system 138 will not deploy foils if the water depth is not at or above a predetermined depth. In some embodiments, the foil displacement system 138 will automatically stow foils if the water depth is not at or above a predetermined depth The sensor(s) 328 can include speed sensor(s) that can determine the travel speed of the water-sports boat 100. In some embodiments, the speed of the water-sports boat 100 can restrict deployment of the foils of the foil displacement system 138 and/or certain angles of attack of the foils of the foil displacement system 138.

The GPS 330 can detect the location and/or speed of the water-sports boat 100. In some embodiments, the control system 300 can determine that the water-sports boat 100 is in an area with restrictions and control the various systems accordingly. For example, the control system 300 can determine, via the GPS 330, that the water-sports boat 100 is in a wake restriction area and control the size of the generated wake accordingly and/or alert the operator. In some embodiments, the water-sports boat 100 via GPS can determine that the water-sports boat 100 is in an area that prohibits the use of ballast tanks and alert the operator and/or prohibit use of the ballast tank system 132.

Figure 18:
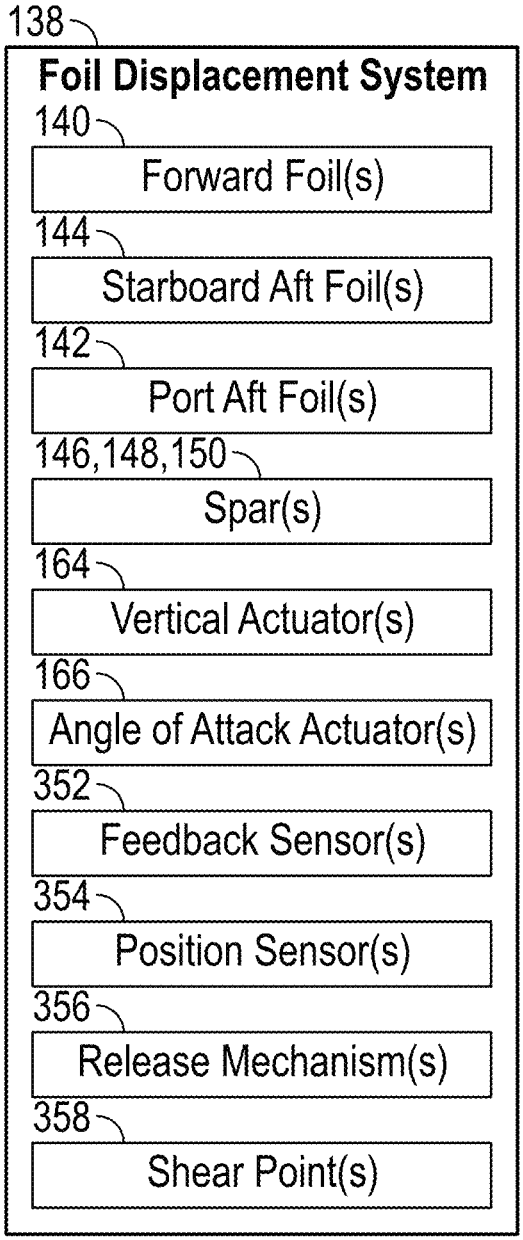
FIG. 18 schematically illustrates an example foil displacement system.

FIG. 18 schematically illustrates an foil displacement system 138. The foil displacement system 138 can include a forward foil(s) 140, which can be positioned forward of the transvers axis 120. The forward foil(s) can be spaced away from the hull 124 by a spar(s) 146. The foil displacement system 138 can include a starboard aft foil(s) 144, which can be positioned aft of the transvers axis 120 and/or on the starboard side 110. The starboard aft foil(s) 144 can be spaced away from the hull 124 by a spar(s) 150. The foil displacement system 138 can include a port aft foil(s) 142, which can be positioned aft of the transverse axis 120 and/or on the port side 112. The port aft foil(s) 142 can be spaced away from the hull 124 by a spar(s) 148.

The foil displacement system 138 can include vertical actuator(s) 164 that can vertically retract and/or extend the spar(s) 146, 148, and/or 150 to deploy and/or stow the forward foil(s) 140, port aft foil(s) 142, and/or starboard aft foil(s) 144, respectively. The foil displacement system 138 can include angle of attack actuator(s) 166 that can alter the angle of attack of the forward foil(s) 140, starboard aft foil(s) 144, and/or port aft foil(s) 142. In some embodiments, the angle of attack actuator(s) 166 can pivot the spar(s) 146, 148, and/or 150 to change the angle of attack of the forward foil(s) 140, port aft foil(s) 142, and/or starboard aft foil(s) 144, respectively. In some embodiments, the angle of attack actuator(s) 166 can rotate the forward foil(s) 140, port aft foil(s) 142, and/or starboard aft foil(s) 144 relative to the spar(s) 146, 148, and/or 150, respectively, to change the angle of attack of the forward foil(s) 140, port aft foil(s) 142, and/or starboard aft foil(s) 144. The vertical actuator(s) 164 and/or angle of attack actuator(s) 166 can be hydraulic, electric, pneumatic, and/or other suitable configurations. In some embodiments, the spar(s) 146, 148, 150 and/or forward foil(s) 140, port aft foil(s) 142, and/or starboard aft foil(s) 144 can be manually actuated.

In some embodiments, the foil displacement system 138 can include feedback sensor(s) 352 that can determine the amount of resistance exerted on the vertical actuator(s) 166 and/or angle of attack actuator(s) 164 such that the control system 300 can stop actuation of the vertical actuator(s) 166 and/or angle of attack actuator(s) 164 if the detected resistance exceeds a predetermined amount. In some embodiments, the foil displacement system 138 can include a position sensor(s) 354 that can determine the position of the spar(s) 146, 148, 150 and the angle of attack of the forward foil(s) 140, port aft foil(s) 142, and/or starboard aft foil(s) 144. In some embodiments, the position sensor(s) 354 can determine if the spar(s) 146, 148, 150, forward foil(s) 140, port aft foil(s) 142, and/or starboard aft foil(s) 144 are at an expected position based on the elapsed time counted by the timer 344. If the spar(s) 146, 148, 150, forward foil(s) 140, port aft foil(s) 142, and/or starboard aft foil(s) 144 are not at an expected position and/or within a range of expected positions, the control system 300 can initiate operations, such as stopping actuation of and/or stowing the spar(s) 146, 148, 150, forward foil(s) 140, port aft foil(s) 142, and/or starboard aft foil(s) 144 and/or alerting the operator via the light(s) 324, speaker(s) 326, and/or display(s) 304. The expected positions of the spar(s) 146, 148, 150, forward foil(s) 140, port aft foil(s) 142, and/or starboard aft foil(s) 144 can be saved in the memory system 332.

The foil displacement system 138 can include release mechanism(s) 356 that can enable the spar(s) 146, 148, 150 and/or forward foil(s) 140, port aft foil(s) 142, and/or starboard aft foil(s) 144 to be manually actuated despite being automatically actuated during normal use. In some embodiments, spar(s) 146, 148, 150 and/or forward foil(s) 140, port aft foil(s) 142, and/or starboard aft foil(s) 144 may not move or may not conveniently move unless the release mechanism(s) 356 is actuated, which can impede unwanted movement. In some embodiments, the release mechanism(s) 356 can be release valve(s) for a hydraulic actuator. In some embodiments, the foil displacement system 138 includes shear point(s) 358 that enable the spar(s) 146, 148, 150 and/or forward foil(s) 140, port aft foil(s) 142, and/or starboard aft foil(s) 144 to break away upon sufficient impact, such as impacting the ground. The shear point(s) can protect the hull 124 and/or water-sports boat 100 from more serious damage.

The controller 301 and/or control system 300 can activate one or more actuators operatively connected to one or more foil assemblies to move one or more foils to adjust a corresponding angel of attack of the one or more foils. The controller 301 and/or control system 300 can generate, receive, and/or send an increase wake size signal that can activate the one or more actuators to adjust the angle of attach of the one or more foils to increase downward force. The controller 301 and/or control system 300 can generate, receive, and/or send a signal to activate the one or more actuators to move the one or more foils farther away from the stowed position. The controller 301 and/or control system 300 can generate, receive, and/or send an adjust lift signal to activate one or more actuators to adjust an angle of attack of one or more foils to change a downward force to adjust lift of the hull 124. The controller 301 and/or control system 300 can generate, receive, and/or send a wake size control signal to activate one or more actuators to adjust an angle of attack of one or more foils to adjust a wake size within predetermined restrictions. The controller 301 and/or control system 300 can receive a signal from the operator, such as the driver, using a driver input device to activate the one or more actuators to adjust an angle of attack of the one or more foils. In some embodiments, the display(s) 304 can display indicia indicating current or available positions of one or more foils. In some embodiments, the display indicia can represent a lift of the hull, pitch of the hull, and/or an amount of ballast or displacement of the hull 124. In some embodiments, the controller 301 or control system 300 can receive a signal from the mobile phone of an operator and/or passenger to activate the one or more actuators to adjust an angle of attack of the one or more foils. In some embodiments, the controller 301 and/or control system 300 can receive a signal from a wakeboarder or a wake surfer using a wireless wristband or wireless fob and activate the one or more actuator to adjust an angle of attack of the one or more foils. In some embodiments, the controller 301 and/or control system 300 can send a signal to the one or more actuators from the controller 301 and/or control system 300 executing a preset activity run. In some embodiments, the controller 301 and/or control system 300 can send a signal to the one or more actuators from the controller 301 and/or control system 300 executing a preset active setting.

Figure 19:
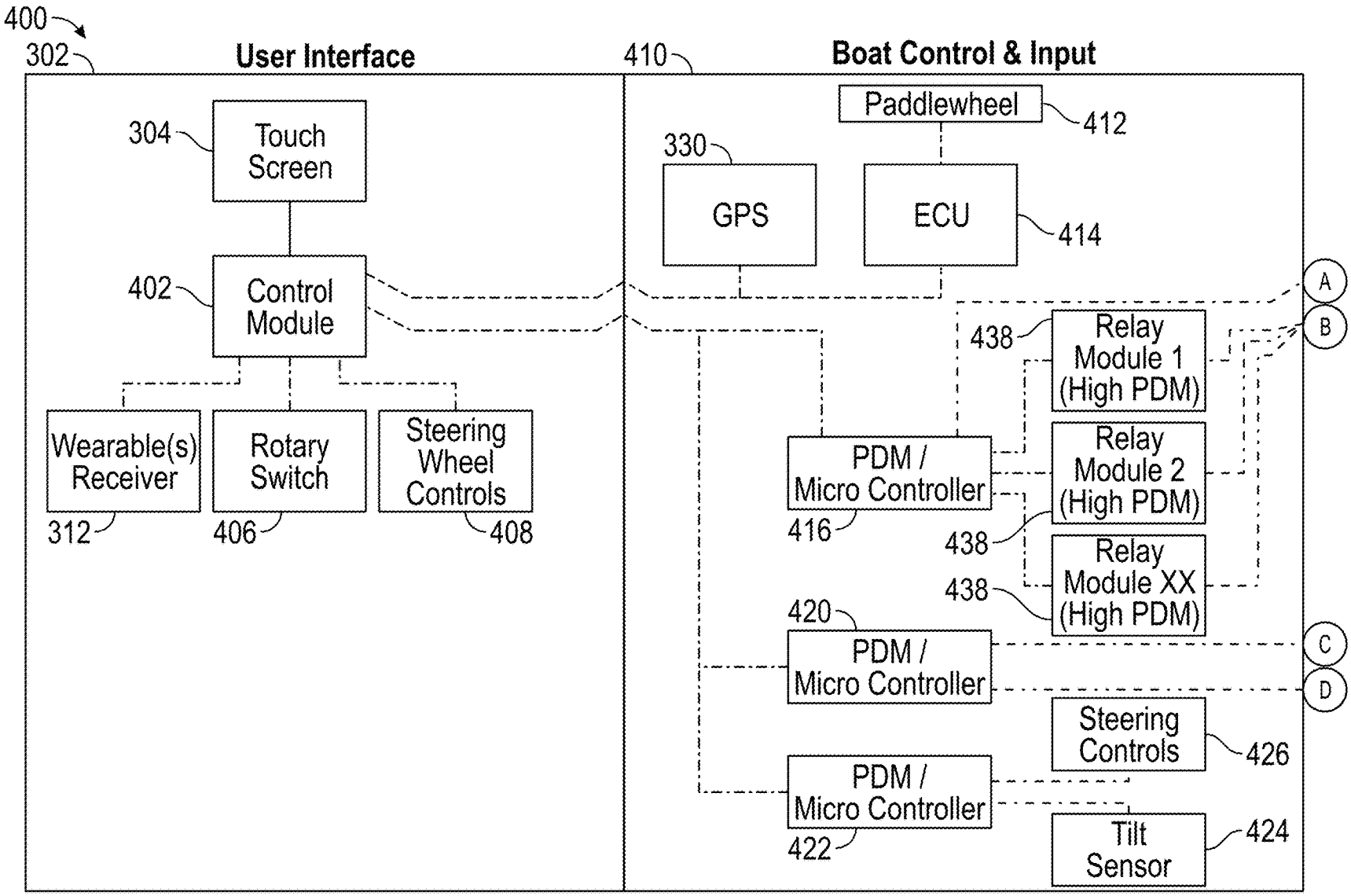
FIG. 19 schematically illustrates an example electrical controls diagram.
Figure 19:
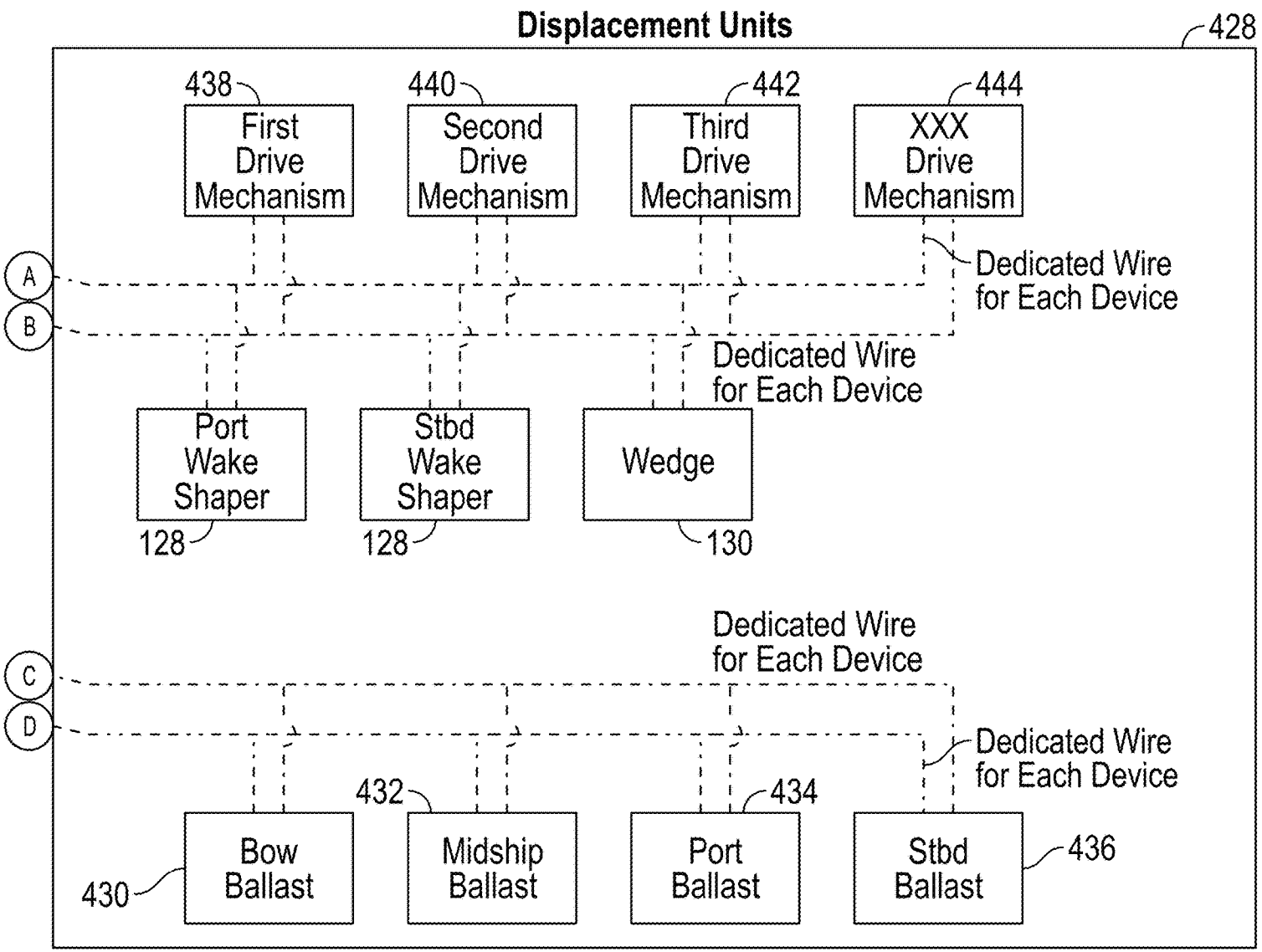

FIG. 19 schematically illustrates a electrical controls diagram 400. The user interface 302 can include a touch screen 304 to receive operator commands to control the systems disclosed herein. The user interface 302 can include a wearable receiver (transceiver) 312 that can receive operator input transmitted from a wearable device worn by a rider or operator. The user interface 302 can include a rotary switch 406 and/or steering wheel controls 408 that can be manipulated by the operator to indicate commands to control the systems disclosed herein. The touch screen 304, wearable(s) receiver 312, rotary switch 406, and/or steering wheel controls 408 can be in communication with a control module 402. The CAN bus of the water-sports boat 100 can provide the communications lines between the wearable(s) receiver 312, rotary switch 406, and/or steering wheel controls 408.

The control module 402 can be in communication with various features of the boat control and input 410. A communication line can communicatively connect the control module 402 with the GPS 330 and ECU 414, which is in communication with a paddlewheel speed sensor 412. The paddlewheel speed sensor 412 can detect the speed of travel of the water-sports boat 100, which can include detecting water movement to determine the speed of the water-sports boat 100. The GPS 330 can detect the speed and/or location of the water-sports boat 100.

A control module 402 can be in communication with a power distribution module (PDM)/microcontroller 416, PDM/microcontroller 42, and/or PDM/microcontroller 422. The CAN bus of the water-sports boat 100 can provide the communications lines between the control module 402 and the PDM/microcontroller 416, PDM/microcontroller 42, and/or PDM/microcontroller 422. The PDM/microcontroller 422 can be in communication with a tilt sensor 424, which can at least detect the pitch, roll, and/or yaw of the water-sports boat 100. The PDM/microcontroller 422 can be in communication with steering controls 426, which can include the steering controls of the operator. The steering controls of the operator can be used to manipulate different systems described herein. For example, the wake shaper(s) 128, foil displacement system 138, and/or wedge 130 may assume a different configuration based upon receiving input that the operator is turning the water-sports boat 100. In some embodiments, this can provide improved performance during boating maneuvers.

The PDM/microcontroller 420 can be in communication with several features of the displacement units 428. A separate dedicated communication line (e.g., separate wire) can run from the PDM/microcontroller 420 to a bow ballast 430, midship ballast 432, port ballast 434, and starboard ballast 436 (e.g., four separate communication lines). A separate dedicated power supply line can run from the PDM/microcontroller 420 to the bow ballast 430, midship ballast 432, port ballast 434, and starboard ballast 436 (e.g., four separate power supply lines). The bow ballast 430, midship ballast 432, port ballast 434, and starboard ballast 436 can be independently controlled to be filled, emptied, etc.

The PDM/microcontroller 416 can be in communication with several displacement units 428. Communication lines from the CAN bus of the water-sports boat 100 can connect the PDM/microcontroller 416 to one of a plurality of relay modules 438 (e.g., three) that distribute power to the displacement units 428. The relay modules 438 can be connected to a battery (e.g., 12 V battery) to supply power. A separate power supply line can run from one of the plurality of relay modules 438 to the port wake shaper 128, starboard wake shaper 128, wedge 130, first drive mechanism 438, second drive mechanism 440, third drive mechanism 442, and/or another drive mechanism 444 (e.g., seven separate power supply lines).

A separate dedicated communication line (e.g., separate wire) can connect the PDM/microcontroller 416 to the port wake shaper 128, starboard wake shaper 128, wedge 130, first drive mechanism 438, second drive mechanism 440, third drive mechanism 442, and/or another drive mechanism 444 (e.g., seven separate returning communication lines). The port wake shaper 128, starboard wake shaper 128, wedge 130, first drive mechanism 438, second drive mechanism 440, third drive mechanism 442, and/or another drive mechanism 444 can be independently controlled. The first drive mechanism 438, second drive mechanism 440, third drive mechanism 442, and/or another drive mechanism 444 can be assemblies of foil(s), spar(s), vertical actuator(s), and/or angle of attack actuator(s) that can be deployed and/or actuated to provide a downward or lifting force.

Figure 20A:
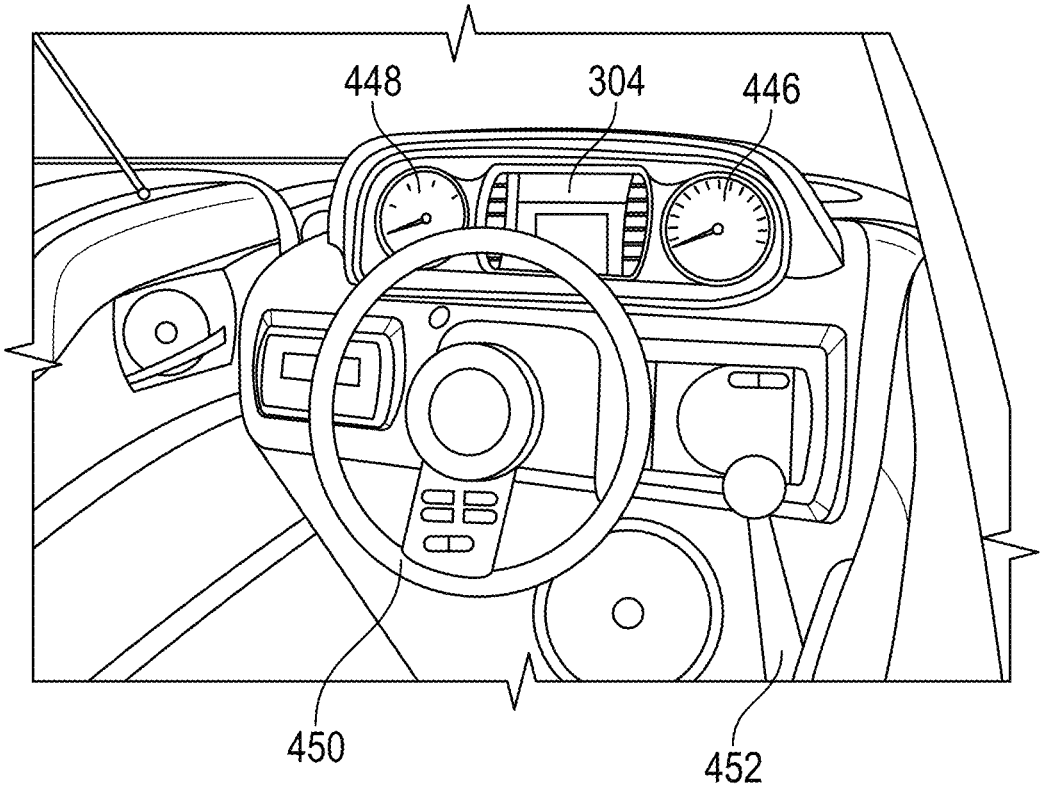
FIG. 20A illustrates steering controls.

Turning to FIG. 20A, the water-sports boat 100 can include a steering wheel 450, throttle control 452, and/or instrument panel bearing a tachometer 448 and/or speedometer 448. The water-sports boat 100 can include a multipurpose graphical display 304. The multipurpose graphical display 304 can display information to the user and/or function as a touch screen to receive user input.

Figure 20B:
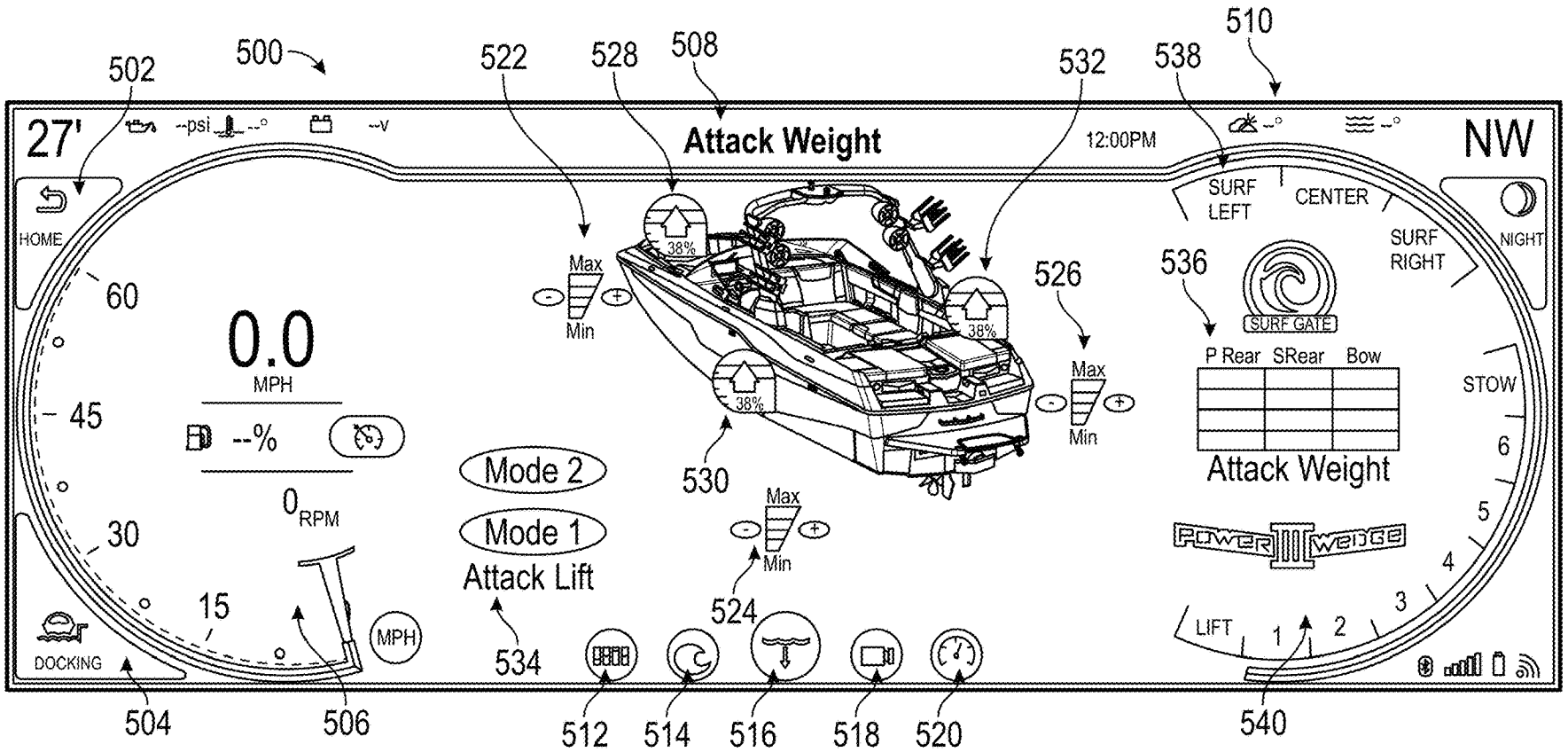
FIG. 20B illustrates an example driver user interface.

FIG. 20B illustrates an example driver user interface 500 that can be displayed on the multipurpose graphical display 304. The driver user interface 500 can include a speedometer 506. The driver user interface 500 can include a home button 502, which can be virtual, that can be manipulated to command the controller 301 and/or controller 300 to drain the tanks of the ballast tank system 132, stow the wave shapers 342 (e.g., move to center position), stow the wedge 130, and/or stow the foils of the foil displacement system 138. In some embodiments, the controller 301 and/or control system 300 can configure the foil(s) of the foil displacement system 138 for speed upon the home button 502 being manipulated to enable an operator to quickly reach a final destination. The driver user interface 500 can include a docking button 504, which can be virtual, that can be manipulated to make the throttle sensitivity more controlled. In some embodiments, manipulation of the docking button 504, can command the controller 301 and/or controller 300 to drain the tanks of the ballast tank system 132, stow the wave shapers 342 (e.g., move to center position), stow the wedge 130, and/or stow the foils of the foil displacement system 138 in preparation for docking. In some embodiments, the controller 301 and/or control system 300 can receive a go home signal, via the user interface 302, and activate one or more actuators to move one or more foils toward the stowed position.

The driver user interface 500 can include a variable display area 508. The variable display area 508 can be positioned between the speedometer 506 and a ballast/flow indicators area 510. In some embodiments, the ballast/flow indicators area 510 and speedometer 506 remain consistently displayed in the driver user interface 500, while the variable display area 508 changes. The variable display area 508 can display varying pages with different information and/or input options. The operator can change the page displayed in the variable display area 508 by selecting the ballast page 512, preset page 514, depth page 516, media page 518, and/or gauges page 520.

The variable display area 508 can show an illustration of the water-sports boat 100 and provide inputs to manipulate the ballast tank system 132 and/or foil displacement system 138, as illustrated in FIG. 20B. A forward foil input 522, port aft foil input 524, and/or starboard aft foil input 526 can enable the operator to individually command the forward foil 140, starboard aft foil 144, and/or port aft foil 142 to deploy/stow, increase/decrease downward force, and/or increase/decrease lift force. The forward foil input 522 can be positioned proximate the bow 116, the port aft foil input 524 can be positioned proximate the stern and port side, and/or the starboard aft foil input 526 can be positioned proximate the stern and starboard side on the illustrated water-sports boat 100 to indicate the general position of the forward foil 140, starboard aft foil 144, and/or port aft foil 142. The forward foil input 522, port aft foil input 524, and/or starboard aft foil input 526 can display the respective configuration of the forward foil 140, starboard aft foil 144, and/or port aft foil 142 that is selected (e.g., deployed/stowed, downward force, lift force).

A forward ballast input 528, port aft ballast input 530, and/or starboard aft ballast 532 input 532 can enable the operator to individually command the forward, port aft, and/or starboard aft ballast tanks 134 to fill or empty. The forward ballast input 528 can be positioned proximate the bow 116, the port aft ballast input 530 can be positioned proximate the stern and port side, and/or the starboard aft ballast 532 can be positioned proximate the stern and starboard side on the illustrated water-sports boat 100 to indicate the general position of the forward, port aft, and/or starboard aft ballast tanks 134. The forward ballast input 528, port aft ballast input 530, and/or starboard aft ballast 532 can respectively display the configuration of the forward, port aft, and/or starboard aft ballast tanks 134 (fill level, weight, etc.).

A foil displacement mode input 534 can enable the operator to select different configurations for the foil displacement system 138. For example, the foil displacement mode input 534 can include one or more lift options that, upon selection, configure the foil(s) of the foil displacement system 138 to generate lifting forces. The foil displacement mode input 534 can include one or more downward force options, such as Mode 1 and Mode 2 (Mode 2 generating a greater downward force than Mode 1), that upon selection, configure the foil(s) of the foil displacement system 138 to generate downward forces. The foil displacement mode input 534 can include a stow or deploy option.

The driver user interface 500 can display a foil displacement configuration graphic 536. The foil displacement configuration graphic 536 can indicate the configuration (stowed/deployed, generated downward force, and/or generated lift force) of the forward foil 140, starboard aft foil 144, and/or port aft foil 142. The foil displacement configuration graphic 536 can display numerical values and/or graphical indicators.

A wake shaper input 538 can enable the operator to select between at least three options: surf left, center, and/or surf right. The surf left and surf right options, upon selection, can actuate the port and/or starboard wave shaper(s) 128 to form a suitable wake surfing wave on the port-side portion 104 or starboard-side portion 106 of the wake 105. In some embodiments, the port and/or starboard wave shaper(s) 128 actuate between stowed/deployed positions. In some embodiments, the port and/or starboard wave shaper(s) 128 can be positioned in one of a continuum of positions between stowed and deployed. The center option can position the port and/or starboard wave shaper(s) 128 in a neutral position and/or stowed position to not shape the wake 105. The wake shaper input 538 can display an indication of the configuration of the wake shaper(s).

Figure 21:
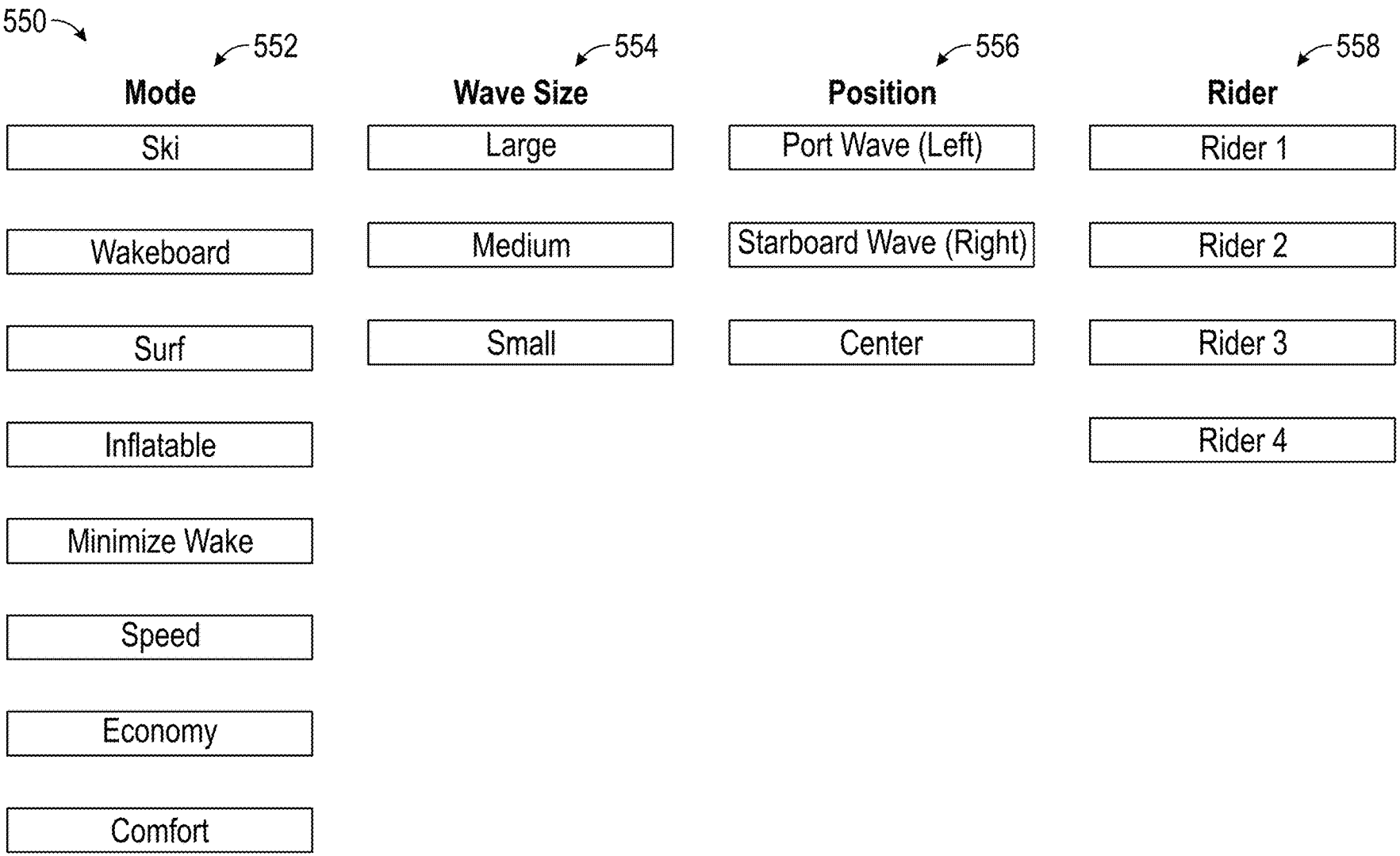
FIG. 21 illustrates an example user interface.

A wedge input 538 can enable the operator to select different configurations for the wedge 130, which can include one or more lift configurations, one or more downward force configurations, and/or a stowed configuration. The wedge input 538 can display an indication of the configuration of the wedge 130 and/or FIG. 21 illustrates a user interface 550 displaying options for the operator. In some embodiments, the displayed options are buttons (virtual buttons, touch screen feature, input switches). In some embodiments, the user interface 550 is displayed on the multipurpose graphical display 304. The user interface 550 can display one or more modes 552, which can at least include a ski, wakeboard, surf, inflatable, minimize wake, speed, economy (fuel economy), or comfort mode. Each one of the modes 552 can correspond to a configuration of the foil displacement system 138 that is appropriate for a given mode. For example, the surf mode can correspond with the foils of the foil displacement system 138 being deployed and creating downward forces. The ski mode, however, can correspond with the foils of the foil displacement system 138 being deployed and creating lifting forces to reduce wake size. The minimize wake, speed, and/or fuel economy modes can be similar to the ski mode in that the foils of the foil displacement system 138 are deployed but, in some embodiments, different lifting forces can be preferable for each mode. The comfort mode, in some embodiments, can result in the actuation of the foils of the foil displacement system 138 to provide lift and/or downward forces to provide a smoother ride and/or reduce porpoising, rolling, yawing, and/or pitch. Upon selection of a mode 552, the control system 300 can automatically actuate the spar(s) and/or foil(s) of the foil displacement system 138 to reflect the selected mode. In some embodiments, the control system 300 can manipulate the wedge 130, ballast tank system 132, wake shaper(s) 128, engine 320, and/or other system in response to a mode selection.

The user interface 550 can display one or more wave size options 554, which can at least include small, medium, and large. In some embodiments, a wave size along a continuum of wave sizes can be selected. Upon selection of a wave size 554, the control system 300 can automatically actuate the spar(s) and/or foil(s) of the foil displacement system 138 to reflect the selected size. For example, if surfing, the operator can select surf mode 552 and large wave size 554, surf mode 552 and medium wave size 554, or surf mode 552 and small wave size 554 depending on preference. Each size selection can correspond to a different configuration of the foil displacement system 138. For example, the large wave size can correspond to the foils being configured to generate the larges downward force compared to the medium wave size or small wave size. In some embodiments, the control system 300 can manipulate the wedge 130, ballast tank system 132, wake shaper(s) 128, engine 320, and/or other system in response to a wave size selection.

The user interface 550 can display one or more position options 556, which can at least include port wave (left), starboard wave (right), and/or center. Upon selection of a position 556, the control system 300 can automatically actuate the spar(s) and/or foil(s) of the foil displacement system 138 to reflect chosen position. For example, if port wave (left) is selected, the control system 300 may actuate the port aft foil 142 to generate more downward force. In some embodiments, the control system 300 may open the wake shaper 128 to configure the port-side portion 104 of the wake 105 for surfing. In some embodiments, the control system 300 can manipulate the wedge 130, ballast tank system 132, wake shaper(s) 128, engine 320, and/or other system in response to a wave size selection.

The user interface 550 can display one or more rider profiles 558. A rider, upon finding a preferred configuration of the foil displacement system 138, wedge 130, ballast tank system 132, wake shaper(s) 128, engine 320, and/or other system can save the preferred configuration as rider information 340 in the memory 332 under the rider's profile 558. This can enable a rider to quickly save and recreate preferred configurations. For example, in some embodiments, the rider can select the rider's profile and a preferred configuration therein and the control system 300 can automatically recreate the preferred configuration.

Figure 22:
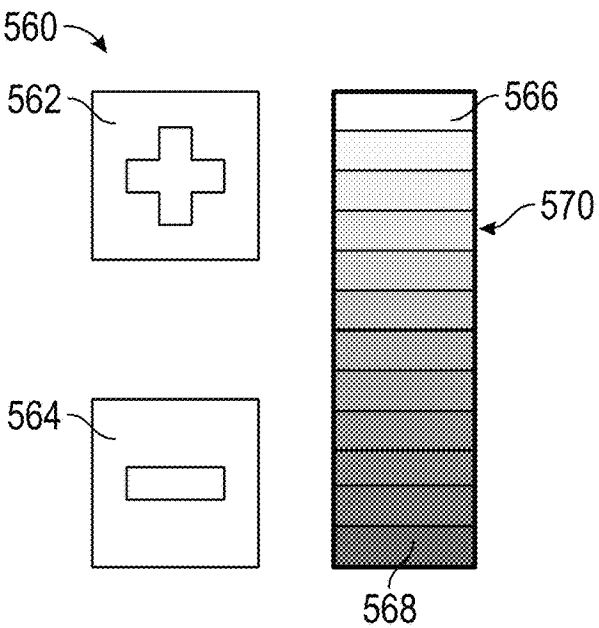
FIG. 22 illustrates an example user interface.

FIG. 22 illustrates an example user interface 560 for controlling the lifting or downward force of a given foil of the foil displacement system 138. The user interface 560 can include a positive button (switch, virtual button) 562. The positive button 562, when manipulated, can cause the control system 300 to increase the lift force and/or decrease the downward force generated by the given foil of the foil displacement system 138. In some embodiments, the reverse controls are implemented—positive increasing downward force and negative increasing lift force. The user interface 560 can include a negative button (switch, virtual button) 564. The negative button 564, when manipulated, can cause the control system 300 to decrease the lift and/or increase the downward force generated by the given foil of the foil displacement system 138. Manipulation of the positive button 562 and/or negative button 564 can be indicated on a graph 570. In some embodiments, manipulation of the positive button 562 and/or negative button 564 can be indicated by discrete movements on the graph 570 or along a continuum of positions between the maximum lift indicator 566 and the maximum downward force indicator 568. In some embodiments, the value of the lifting or downward force of the given foil can be displayed. In some embodiments, the user can use a digit to drag up or down on the graph 570 to change downward force and/or lifting force.

Figure 23B:
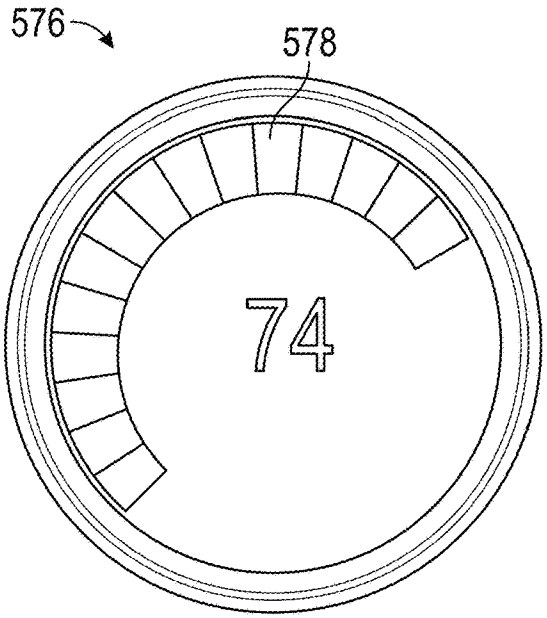
FIGS. 23A and 23B illustrates an example user interface.
Figure 23A:
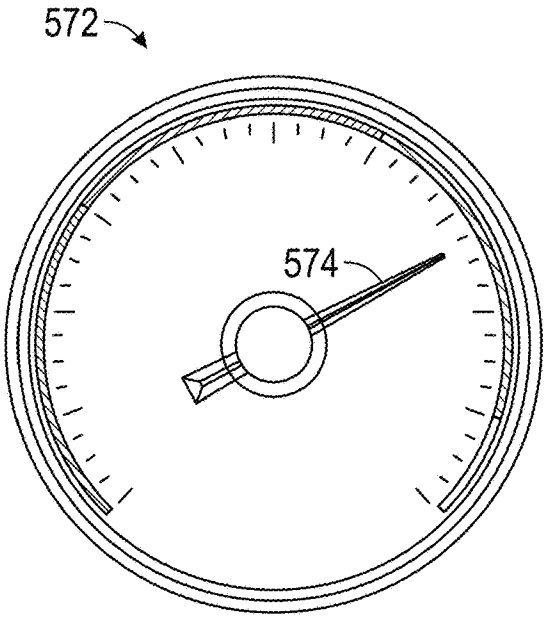

FIG. 23A illustrates an example user interface 572 for visualizing and/or controlling the lifting or downward force of a given foil of the foil displacement system 138. The user interface 572 can be a gauge with a needle (virtual needle, indicator) 574 indicating the generated lifting and/or downward force. In some embodiments, the needle 574 can indicate percentages of a maximum generated lifting and/or downward force, positive or negative values of the generated lifting or downward force, and/or otherwise provide an indication of the generated lifting and/or down ward force. In some embodiments, the needle 574 can be manipulated to control the generated lifting and/or downward forces.

FIG. 23B illustrates an example user interface 576 for visualizing and/or controlling the lifting or downward force of a given foil of the foil displacement system 138. The user interface 576 can be a gauge with indicators 578 that visually illustrate the generated lifting and/or downward force of a given foil of the foil displacement system 138. The user interface 576 can indicate the value of the generated lifting and/or downward force. In some embodiments, the user interface 576 is displayed via a touch screen and the operator can control the generated lifting and/or downward force by dragging a digit clockwise or counterclockwise over the indicators 578.

Figure 23C:
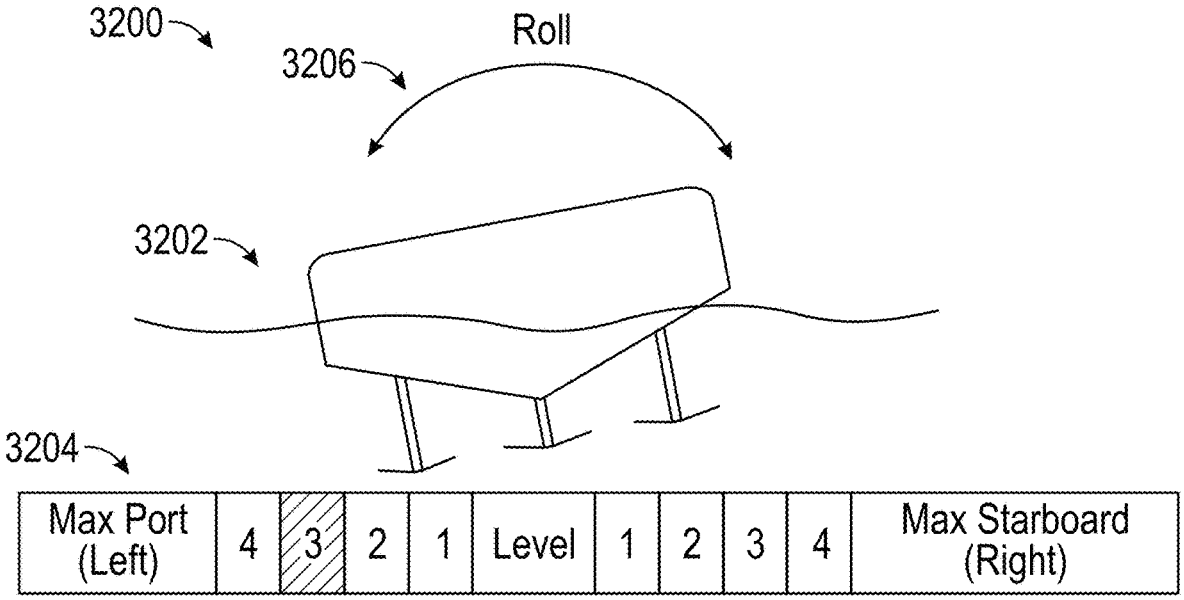
FIG. 23C illustrates an example user interface for controlling roll.

FIG. 23C illustrates an example user interface 3200 for visualizing and/or controlling the roll orientation of the water-sports boat 100. The user interface 3200 can include a visualization of the real time roll orientation of the water-sports boat 100 in the graphic 3202. The user interface 3200 can include an input 3204 that enables the operator to select between a max port (left) roll, max starboard (right) roll orientations, level orientation (neutral), and/or intermediate positions between the foregoing orientations. In some embodiments, there are discrete orientations or positions along a continuum. In some embodiments, the operator can drag a digit across the input 3204 to change the orientation of the water-sports boat 100 or select a given position. In some embodiments, the input 3204 can display the current orientation. In some embodiments, the user interface 3200 can include a binary control input 3206 that enables the operator to select to roll more starboard or more port.

Figure 23D:
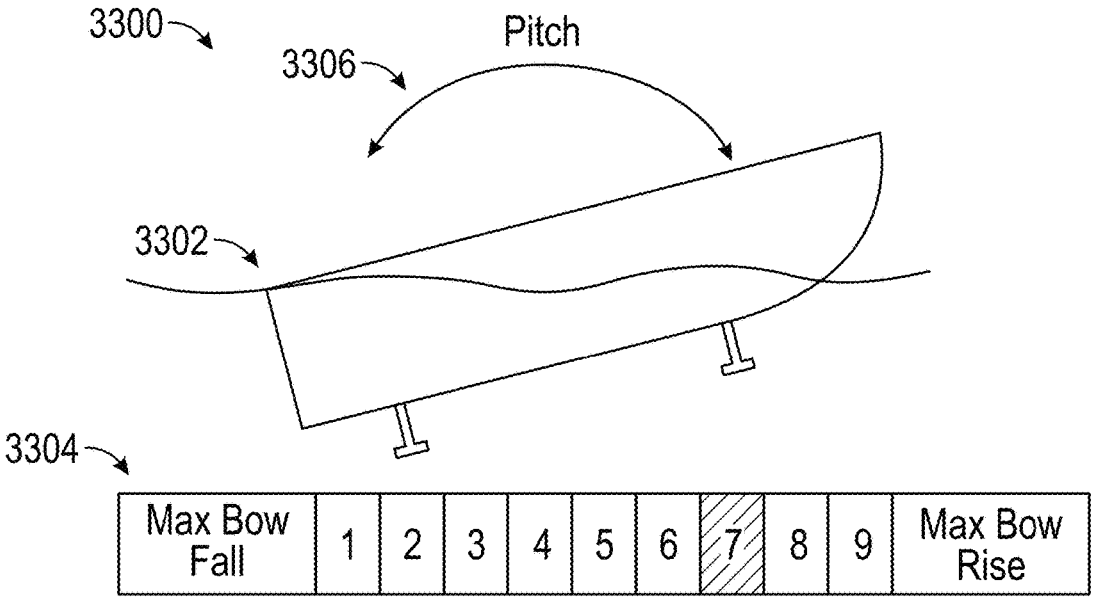
FIG. 23D illustrates an example user interface for controlling pitch.

FIG. 23D illustrates an example user interface 3300 for visualizing and/or controlling the pitch orientation of the water-sports boat 100. The user interface 3300 can include a visualization of the real time pitch orientation of the water-sports boat 100 in the graphic 3302. The user interface 3300 can include an input 3304 that enables the operator to select between a max bow rise orientation, max bow fall orientation, and/or intermediate orientations between the foregoing orientations. In some embodiments, there are discrete orientations or positions along a continuum. In some embodiments, the operator can drag a digit across the input 3304 to change the orientation of the water-sports boat 100 or select a given position. In some embodiments, the input 3304 can display the current orientation. In some embodiments, the user interface 3300 can include a binary control input 3306 that enables the operator to select to increase or decrease pitch (e.g., raise or lower the bow).

Figure 23E:
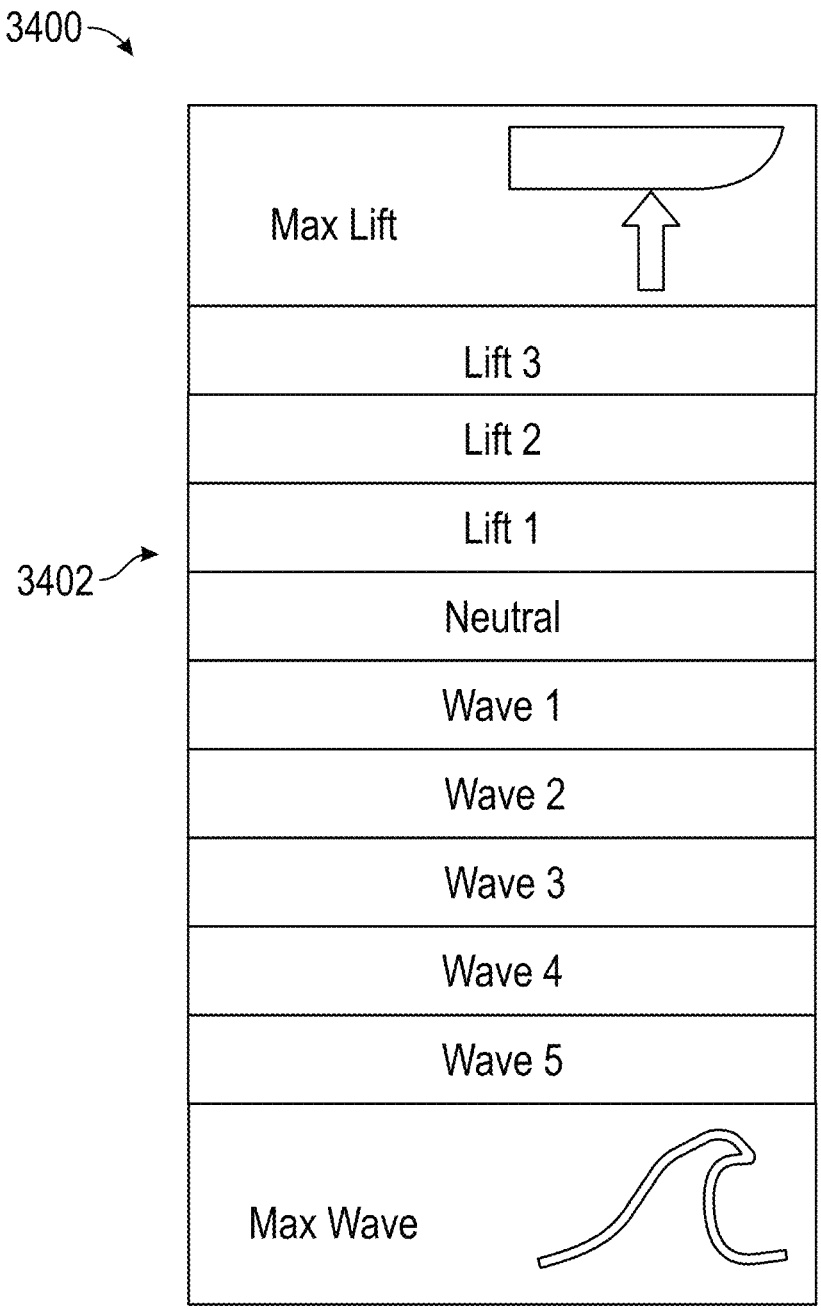
FIG. 23E illustrates an example user interface for controlling lift and/or wave generation.

FIG. 23E illustrates an example user interface 3400 for controlling the wave size creation and/or lift. The user interface 3400 can include an input 3402 that enables the operator to select between a max lift configuration, neutral configuration, max wave configuration, and/or intermediate configurations between the foregoing. In some embodiments, there are discrete configurations or configurations along a continuum. In some embodiments, the operator can drag a digit across the input 3402 to change the configuration of the water-sports boat 100 or select a given configuration. The max wave configuration can correspond to a configuration of the water-sports boat 100 that produces the largest wake/wave. The max lift configuration can correspond to a configuration of the water-sports boat 100 that lifts the water-sports boat 100 the most. In some embodiments, the neutral configuration can correspond to a configuration of the water-sports boat 100 without enhancing lift or displacement with some or all of the systems disclosed herein.

Figure 24:
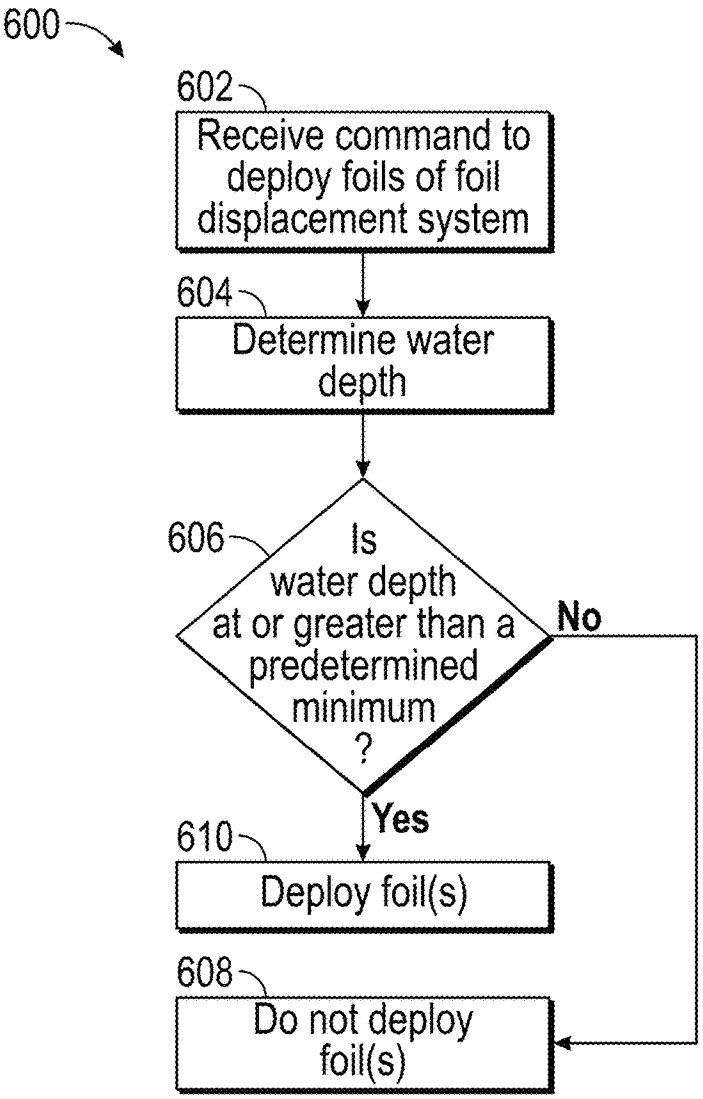
FIG. 24 illustrates an example method for deploying the foils of a foil displacement system.

FIG. 24 illustrates an example embodiment of a method 600 for deploying the foils of the foil displacement system 138. At block 602, the controller 301 and/or control system 300 can receive via the user interface 302 a command to deploy the foil(s) of the foil displacement system 138. At block 602, the sensor(s) 328 can detect the water depth. At block 606, the controller 301 and/or control system 300 can determine if the detected water depth is at or greater than a predetermined minimum. If the water depth is not at or greater than a predetermined minimum, the process can proceed to block 608 and not deploy the foil(s) of the foil displacement system 138. In some embodiments, the controller 301 and/or control system 300 can alert the operator of the failed deployment via the light(s) 324, speaker(s) 326, and/or display(s) 304. If the water depth is at or greater than a predetermined minimum, the process can proceed to block 610 and deploy the foil(s) of the foil displacement system 610. In some embodiments, the foil(s) and/or spar(s) of the foil displacement system 138 can automatically stow and/or retract in response detecting that the water depth is not at or greater than a predetermined minimum. The controller and/or control system 300 can alert the operator of the automatic stowage and/or retraction via the light(s) 324, speaker(s) 326, and/or display(s) 304.

Figure 25:
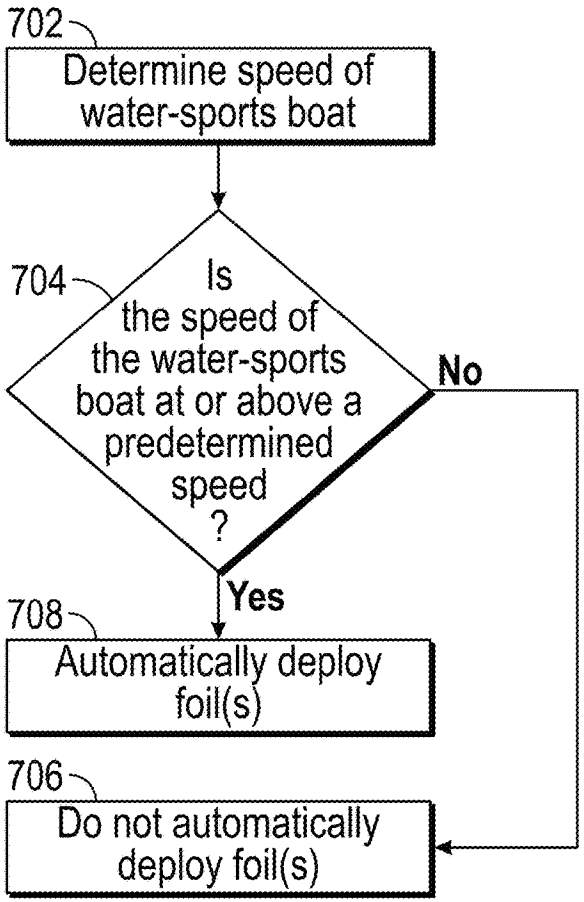
FIG. 25 illustrates an example method for automatically deploying foil(s) and/or spar(s) of a foil displacement system.

FIG. 25 illustrates an example embodiment of a method 700 for automatically deploying the foil(s) of the foil displacement system 138. At block 702, the controller 301 and/or control system 300 can determine the speed of the water-sports boat 100 via the sensor(s) 328, GPS 330, and/or paddlewheel speed sensor 412. At block 704, the controller 301 and/or control system 300 can determine if the detected speed of the water-sports boat 100 is at or above a predetermined speed. If the detected speed of the water-sports boat 100 is not at or above the predetermined speed, the process continues to block 706 and the controller 301 and/or control system 300 do not automatically deploy the foils of the foil displacement system 138. If the detected speed of the water-sports boat 100 is at or above the predetermined speed, the process continues to block 708 and the controller and/or control system 300 automatically deploys the foils of the foil displacement system 138.

Figure 26:
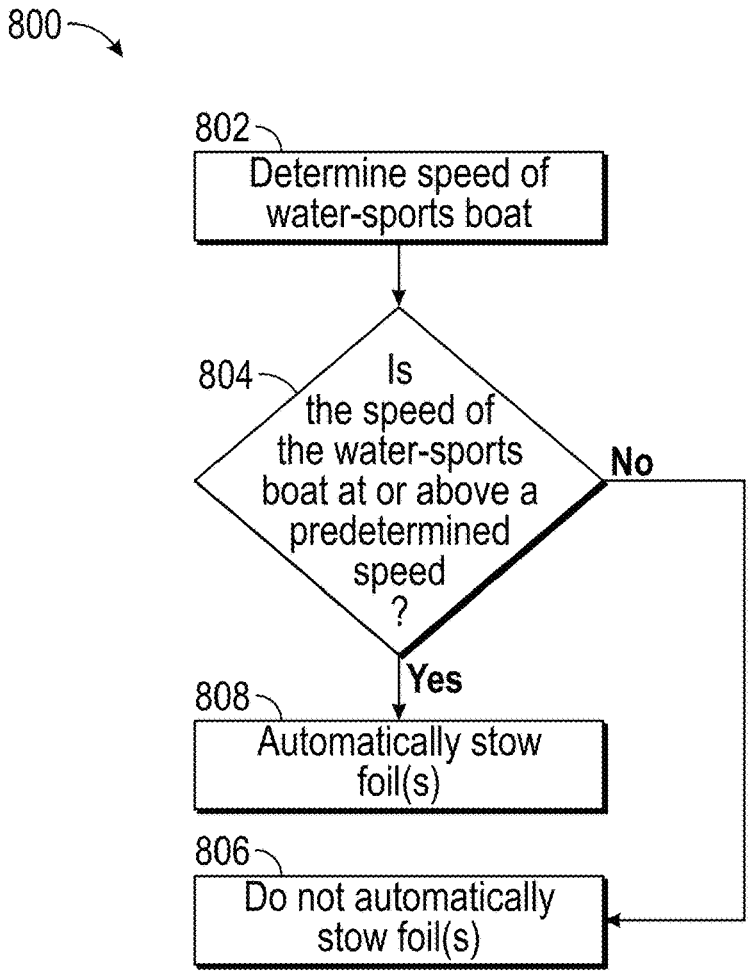
FIG. 26 illustrates an example method for automatically stowing the foil(s) and/or spar(s) of a foil displacement system.

FIG. 26 illustrates an example embodiment of a method 800 for automatically stowing the foil(s) of the foil displacement system 138. At block 802, the controller 301 and/or control system 300 can determine the speed of the water-sports boat 100 via the sensor(s) 328, GPS 330, and/or paddlewheel speed sensor 412. At block 804, the controller 301 and/or control system 300 can determine if the detected speed of the water-sports boat 100 is at or below a predetermined speed. If the detected speed of the water-sports boat 100 is not at or below the predetermined speed, the process continues to block 806 and the controller 301 and/or control system 300 do not automatically stow the foils of the foil displacement system 138. If the detected speed of the water-sports boat 100 is at or below the predetermined speed, the process continues to block 808 and the controller and/or control system 300 automatically stows the foils of the foil displacement system 138.

Figure 27:
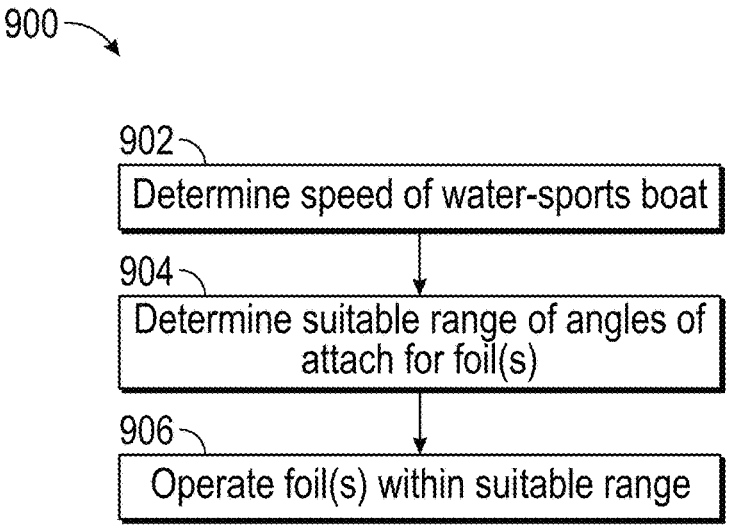
FIG. 27 illustrates an example method for automatically operating foil(s) and/or spar(s) of a foil displacement system within a suitable range of attack angles.

FIG. 27 illustrates an example embodiment of a method 900 for automatically operating the foils of the foil displacement system 138 within a suitable range of attack angles. At block 802, the controller 301 and/or control system 300 can determine the speed of the water-sports boat 100 via the sensor(s) 328, GPS 330, and/or paddlewheel speed sensor 412. At block 904, the controller 301 and/or control system 300 can determine the suitable range of angles of attack for the foil(s) of the foil displacement system. In some embodiments, a large angle of attack is not safe at some speeds. The memory 332 can store safe angles of attack for a given speed based on the watercraft configuration information 334, foil configuration, and/or other information. At block 906, the controller 301 and/or control system 300 can operate the foil(s) within the suitable range of attack angles. In some embodiments, the controller 301 and/or control system 300 can alert the operator via the light(s) 324, speaker(s) 326, and/or display(s) 304 if a command for unsuitable angle of attack is received. In some embodiments, a foil cannot be maneuvered to a given angle of attack if an unsafe pitch, yaw, or roll orientation would result, which can be dependent on speed. Accordingly, in some embodiments, one angle of attack may be safe at surf speeds but unsafe at wakeboarding speeds.

Figure 28:
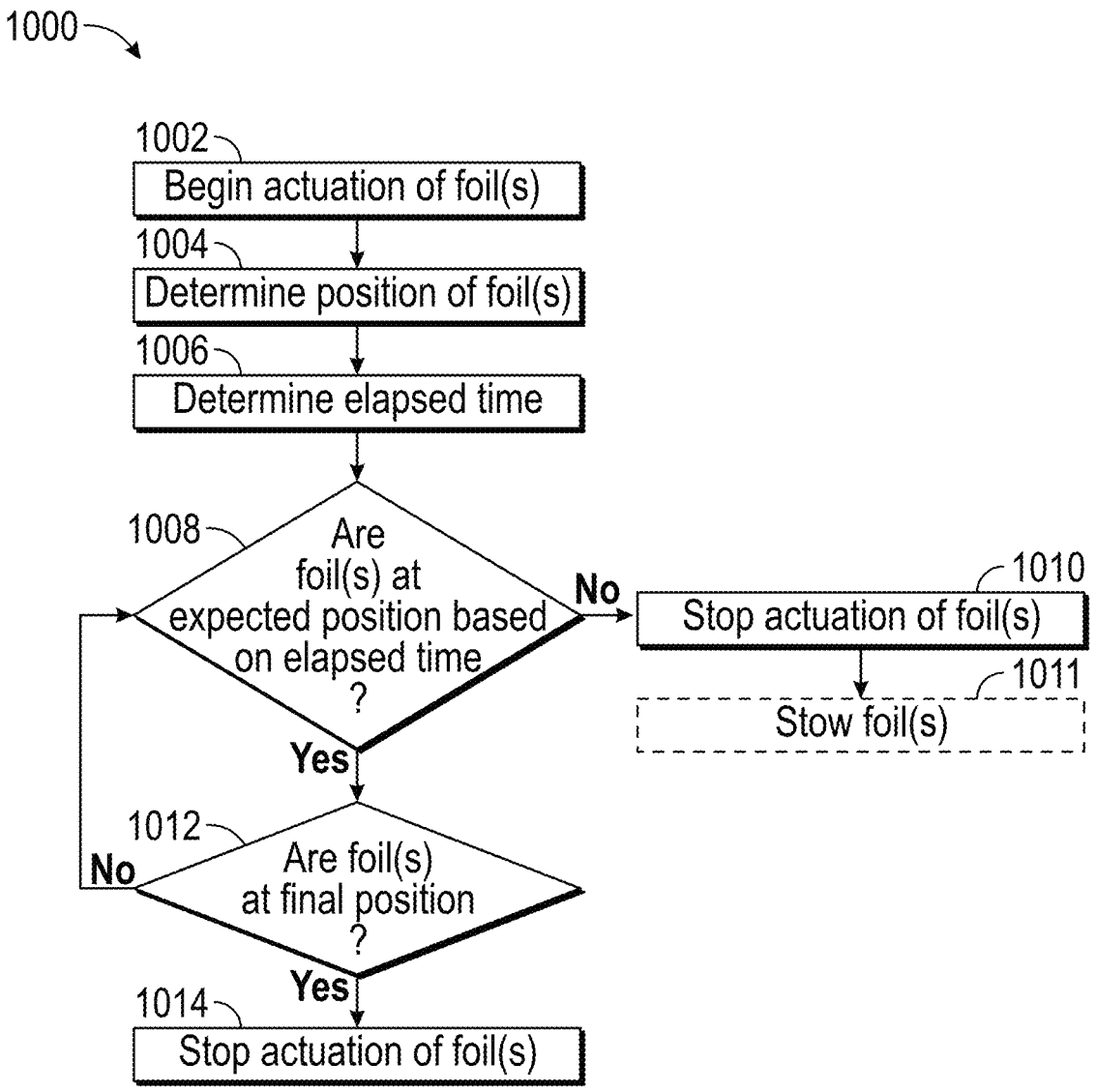
FIG. 28 illustrates an example method for controlling actuation of foil(s) and/or spar(s) of a foil displacement system.

FIG. 28 illustrates an example embodiment of a method 1000 for controlling actuation of the foil(s) and/or spar(s) of the foil displacement system 138. At block 1002, the controller 301 and/or control system 300 can begin actuation of the foil(s) and/or spar(s) of the foil displacement system 138, which can include deploying, stowing, and/or changing an angle of attack. At block 1004, the controller 301 and/or control system 300 can determine the position of the foil(s) and/or spar(s) of the foil displacement system 138 via the position sensor(s) 354. At block 1006, the controller 301 and/or control system 300 can determine the elapsed time since the actuation of the foil(s) and/or spar(s) began with the timer 344. The timer 344 can, in some embodiments, begin timing at the start of an actuation movement of the foil(s) and/or spar(s) of the foil displacement system 138.

At block 1008, the controller 301 and/or control system 300 can determine if the foil(s) and/or spar(s) of the foil displacement system 138 are at an expected position based on the determined elapsed time. The controller 301 and/or control system 300 can compare the position sensed by the position sensor(s) 354 against the expected position based on the elapsed time counted by the timer 344. The expected position can be saved in the memory system 332. If the sensed position and the expected position are not the same and/or the sensed position deviates beyond a predetermined range of expected positions, the process can proceed to block 1010 and stop actuation of the foil(s) and/or spar(s). In some embodiments, the controller 301 and/or control system 300 can alert the operator via the light(s) 324, speaker(s) 326, and/or display(s) 304 of the failed actuation. The process can optionally proceed to block 1011 and stow the foil(s) and/or spar(s). If the sensed position and the expected position are the same and/or the sensed position is within a predetermined range of expected positions, the process can proceed to block 1012 and determine if the foil(s) and/or spar(s) are at the final position. The controller 301 and/or control system 300 can determine if the foil(s) and/or spar(s) are at the final position via the position sensor(s) 354, which can include comparing the sensed position with an expected final positon saved in the memory system 332. If the foil(s) and/or spar(s) are not at the final position, the process can return to block 1008. If the foil(s) and/or spar(s) are at the final position, the process can proceed to block 1014 and stop actuation of the foil(s) and/or spar(s). In some embodiments, the controller 301 and/or control system 300 can begin actuation, such as deployment, and monitor elapsed time via the timer 334 and, upon the elapsed time reaching a threshold, cease actuation, such as deployment. In some embodiments, the controller 301 or control system 300 can receive a deploy signal from the operator, such as the driver, via the user interface 302 to begin deployment of the foil assembly.

Figure 29:
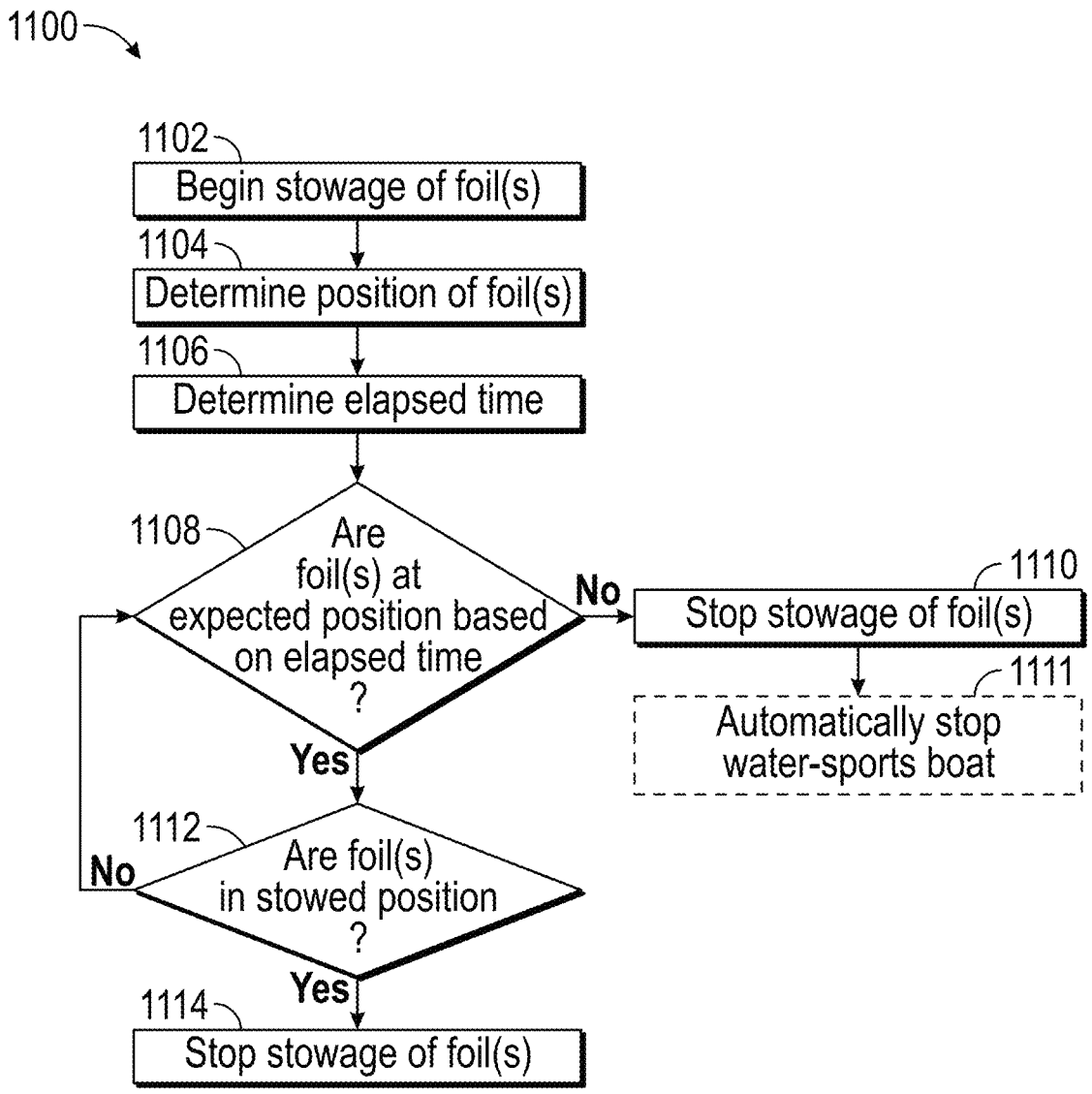
FIG. 29 illustrates an example method for controlling stowage of foil(s) and/or spar(s) of a foil displacement system

FIG. 29 illustrates an example embodiment of a method 1100 for controlling stowage of the foil(s) and/or spar(s) of the foil displacement system 138. At block 1102, the controller 301 and/or control system 300 can begin stowage of the foil(s) and/or spar(s) of the foil displacement system 138. In some embodiments, the controller 301 and/or control system 300 can send a deploy signal to the one or more actuators to move the one or more foils away from the deployed position and toward a stowed position. At block 1104, the controller 301 and/or control system 300 can determine the position of the foil(s) and/or spar(s) of the foil displacement system 138 via the position sensor(s) 354. At block 1106, the controller 301 and/or control system 300 can determine the elapsed time since the stowage of the foil(s) and/or spar(s) began with the timer 344. The timer 344 can, in some embodiments, begin timing at the start of the stowage of the foil(s) and/or spar(s) of the foil displacement system 138.

At block 1108, the controller 301 and/or control system 300 can determine if the foil(s) and/or spar(s) of the foil displacement system 138 are at an expected position based on the determined elapsed time. The controller 301 and/or control system 300 can compare the position sensed by the position sensor(s) 354 against the expected position based on the elapsed time counted by the timer 344. The expected position can be saved in the memory system 332. If the sensed position and the expected position are not the same and/or the sensed position deviates beyond a predetermined range of expected positions, the process can proceed to block 1010 and stop stowage of the foil(s) and/or spar(s). In some embodiments, the controller 301 and/or control system 300 can alert the operator via the light(s) 324, speaker(s) 326, and/or display(s) 304 of the failed stowage. The process can optionally proceed to block 1111 and automatically stop the water-sports boat 100. If the sensed position and the expected position are the same and/or the sensed position is within a predetermined range of expected positions, the process can proceed to block 1112 and determine if the foil(s) and/or spar(s) are at the stowed position. The controller 301 and/or control system 300 can determine if the foil(s) and/or spar(s) are at the stowed position via the position sensor(s) 354, which can include comparing the sensed position with the stowed positon saved in the memory system 332. If the foil(s) and/or spar(s) are not at the stowed position, the process can proceed to block 1108. If the foil(s) and/or spar(s) are at the stowed position, the process can proceed to block 1014 and stop stowage of the foil(s) and/or spar(s). In some embodiments, the controller 301 and/or control system 300 can alert the operator via the light(s) 324, speaker(s) 326, and/or display(s) 304 of the successful stowage. In some embodiments, the controller 301 and/or control system 300 can stowage and monitor elapsed time via the timer 334 and, upon the elapsed time reaching a threshold cease stowage. In some embodiments, the controller 301 or control system 300 can receive a deploy signal from the operator, such as the driver, via the user interface 302 to begin deployment of the foil assembly.

Figure 30:
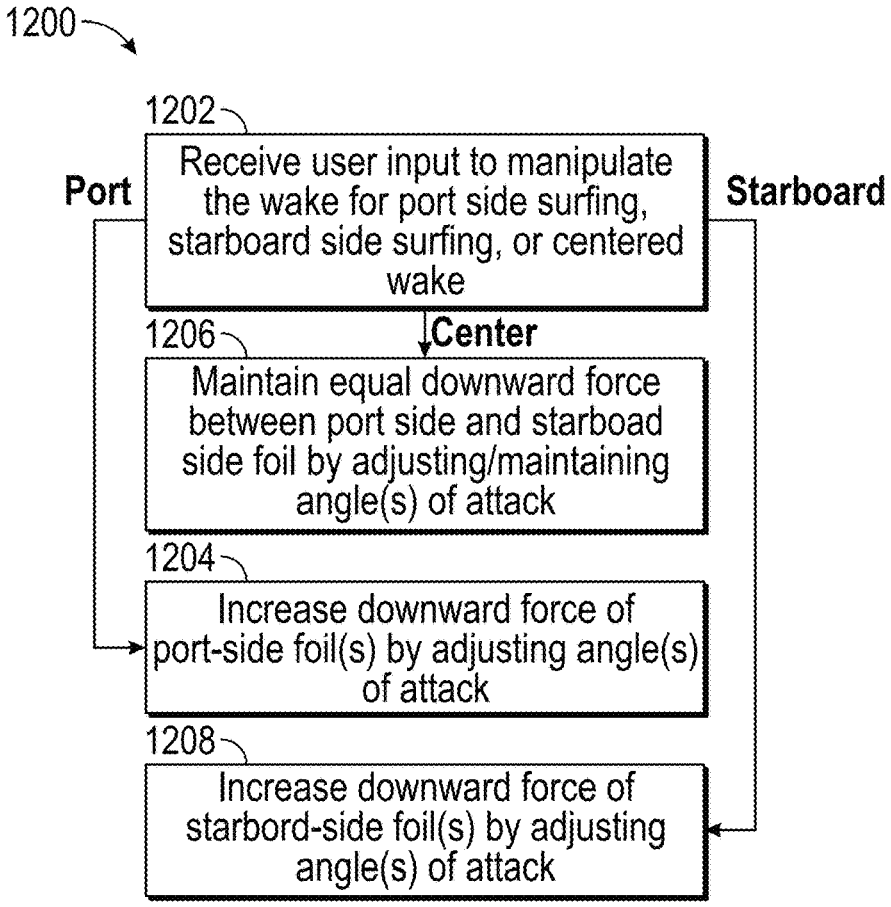
FIG. 30 illustrates an example method for reconfiguring wake characteristics based on user input.

FIG. 30 illustrates an example method 1200 for reconfiguring wake characteristics based on user input. At block 1202, the controller 301 and/or control system 300 can receive user input via the user interface 302 to manipulate the wake 105 for port side surfing, starboard side surfing, or a centered wake. For port side surfing, the process can proceed to block 1204 and the controller 301 and/or control system 300 can increase the downward force produced by the port aft foil(s) 142, which can include orienting the port aft foil(s) 142 in a more negative angle of attack position. For starboard side surfing, the process can proceed to block 1208 and the controller 301 and/or control system 300 can increase the downward force produced by the starboard aft foil(s) 144, which can include orienting the starboard aft foil(s) in a more negative angle of attack position. For a centered wake, the process can proceed to block 1206 and the controller 301 and/or control system 300 can maintain equal downward force between the starboard aft foil(s) 144 and port aft foil(s) 142, which can include adjusting/maintaining angles of attack. In some embodiments, the ballast tank system 132, wedge 314, and/or wake shaper(s) 128 can also used in the method 1200.

Figure 31:
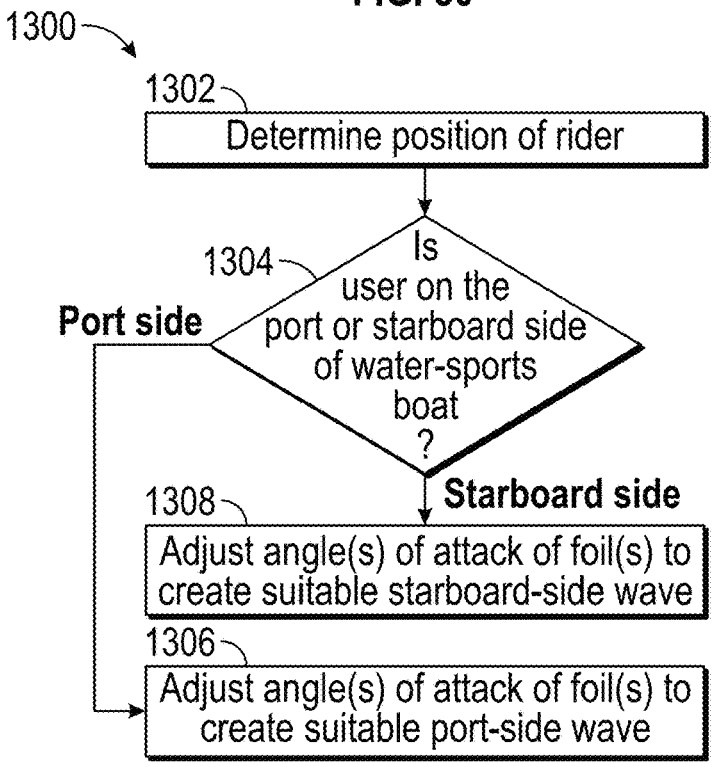
FIG. 31 illustrates an example method for changing a configuration of a foil displacement system and/or other systems based on the position of a rider.

FIG. 31 illustrates an example method 1300 for changing the configuration of the foil displacement system 138 and/or other systems based on the position of the rider. At block 1302, the controller 301 and/or control system 300 can determine the position of the rider. In some embodiments, the controller 301 and/or control system 300 can determine the position of the rider via the camera(s) 322 and/or sensor(s) 326, such as position sensor(s), proximity sensor(s), etc. At block 1304, the controller 301 and/or control system 300 can determine if the rider is on the port side 112 or starboard side 110 of the water-sports boat 100 and/or the port-side portion 104 or starboard-side portion 106 of the wake 105. If the rider is on the port side 112 of the water-sports boat 100 and/or the port-side portion 104 of the wake 105, the controller 301 and/or control system 300 can adjust the angle of attack of the foil(s) of the foil displacement system 138 to create more downward force on the port side 112 to form a larger port-side portion 104 of the wake 105 for surfing. In some embodiments, the port aft foil 142 and/or spar 148 can be actuated to have a greater negative angle of attack to create more downward force. In some embodiments, the ballast tank system 132, wedge 314, and/or wake shaper(s) 128 can be manipulated to better form the port-side portion 104 of the wake 105 for surfing. If the rider is on the starboard side 110 of the water-sports boat 100 and/or the starboard-side portion 106 of the wake 105, the controller 301 and/or control system 300 can adjust the angle of attack of the foil(s) of the foil displacement system 138 to create more downward force on the starboard side 110 to form a larger starboard-side portion 106 of the wake 105 for surfing. In some embodiments, the starboard aft foil 144 and/or spar 150 can be actuated to have a greater negative angle of attack to create more downward force. In some embodiments, the ballast tank system 132, wedge 314, and/or wake shaper(s) 128 can also be manipulated to form the port-side portion 104 of the wake 105 for surfing in the method 1300.

Figure 32:
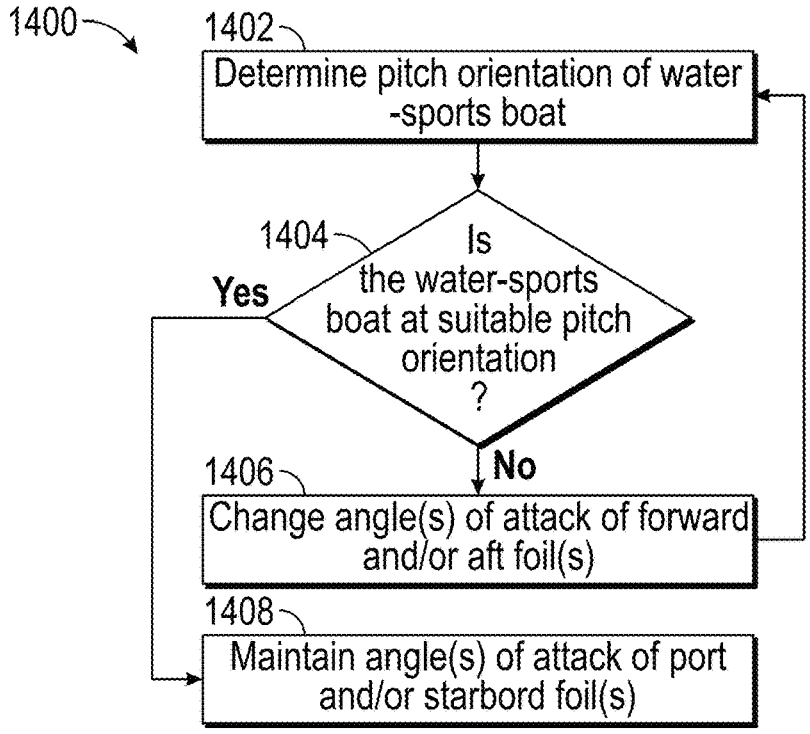
FIG. 32 illustrates an example method for controlling the pitch of a water-sports boat.

FIG. 32 illustrates an example method 1400 for controlling the pitch of the water-sports boat 100. At block 1402, the controller 301 and/or control system 300 can determine the pitch orientation of the water-sports boat 100. The controller 301 and/or control system 300 can determine the pitch orientation via the sensor(s) 328 and/or tilt sensor 424. At block 1404, the controller 301 and/or control system 300 can determine if the waters-sports boat 100 is at a suitable pitch angle. Different pitch angles can be preferred depending on activity and/or mode. For example, a higher pitch angle may be desired while surfing to drag the stern 108 of the hull 124 deeper in the water but a pitch angle closer to neutral may be desired for driving the water-sports boat 100 at high speeds. Different pitch angels can be preferred for safety when travelling at certain speeds. Accordingly, the controller 301 and/or control system 300 can determine if the detected pitch angle is suitable for the selected mode, activity (e.g., waterskiing, wake surfing, speed, etc.), safety, and/or other considerations. If the pitch angle is not suitable, the process proceeds to block 1406 and the controller 301 and/or control system 300 can change the angle of attack of the forward foil(s) 140 and/or aft foils 142, 144 to change the pitch angle. In some embodiments, controller 301 and/or control system 300 can receive an adjust pitch signal, which can activate one or more actuators to adjust an angle of attack of one or more foils to change a downforce to adjust a pitch angle of the hull 124. The process can then return to block 1402. If the pitch angle is suitable, the process proceeds to block 1408 and maintains the angle(s) of attack of the port and/or starboard aft foils 142, 144. In some embodiments, the ballast tank system 132 and/or wedge 314 can be also used in the method 1400.

Figure 33:
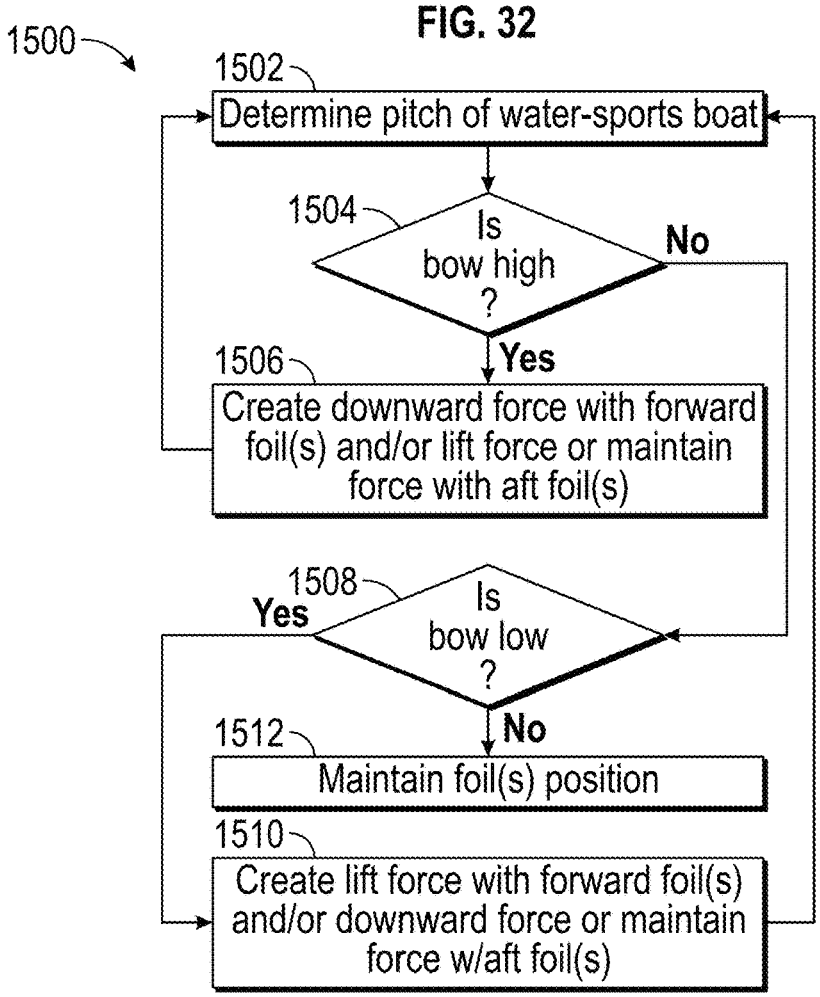
FIG. 33 illustrates an example method for controlling the pitch of a water-sports boat.

FIG. 33 illustrates an example method 1500 for controlling the pitch of the water-sports boat 100. At block 1502, the controller 301 and/or control system 300 can determine the pitch orientation of the water-sports boat 100. The controller 301 and/or control system 300 can determine the pitch orientation via the sensor(s) 328 and/or tilt sensor 424. At block 1504, the controller 301 and/or control system 300 can determine if the bow 116 is high, which can be based on comparing the detected pitch angle of the water-sports boat 100 against a predetermined desired pitch angle. If the bow 116 is high (which can be common when accelerating), the process proceeds to block 1506 and the controller 301 and/or control system 300 can create downward force with the forward foil(s) 140 and/or lift force with the aft foils 142, 144 or maintain force with the aft foils 142, 144. The process can then return to block 1502. If the bow 116 is low (which can be common when decelerating), the process proceeds to block 1510 and the controller 301 and/or control system 300 can create lift force with the forward foil(s) and/or downward force or maintain force with the aft foils 142, 144. The process can then return to block 1502. If the bow 116 is not low, the process can proceed to block 1512 and the controller 301 and/or control system 300 can maintain foil positions. In some embodiments, the ballast tank system 132 and/or wedge 314 can also be used in the method 1500.

Figure 34:
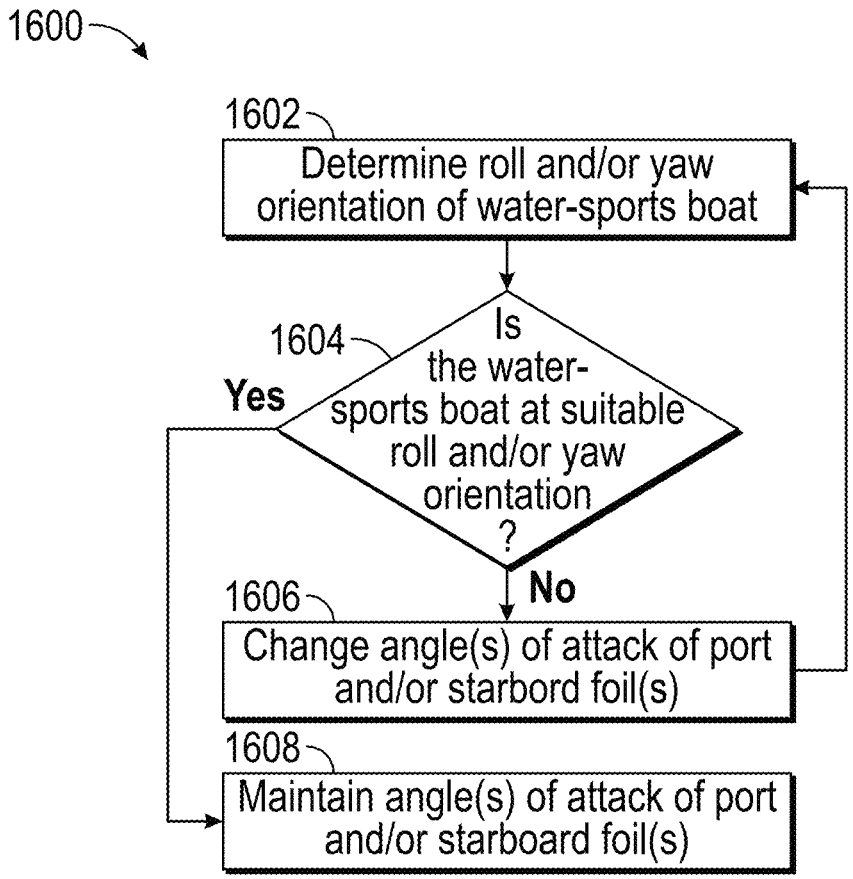
FIG. 34 illustrates an example method for controlling roll and/or yaw orientations of a water-sports boat

FIG. 34 illustrates an example method 1600 for controlling the roll and/or yaw orientation of the water-sports boat 100. At block 1602, the controller 301 and/or control system 300 can determine the roll and/or yaw orientation of the water-sports boat 100. The controller 301 and/or control system 300 can determine the roll and/or yaw orientations via the sensor(s) 328 and/or tilt sensor 424. At block 1604, the controller 301 or control system 300 can determine whether the water-sports boat 100 is at a suitable roll and/or yaw orientation, which can be based on comparing the detected roll and/or yaw orientation(s) of the water-sports boat 100 against predetermined desired roll and/or yaw orientation saved in the memory system 332 that can vary depending on activity, mode, safety, etc. If the water-sports boat 100 is not at a suitable roll and/or yaw orientation, the controller 301 and/or control system 300 can manipulate the forward foil(s) 140, aft foils 142, 144, and/or associated spars, which can include changing the angle(s) of attack. The process can then return to block 1602. If the water-sports boat 100 is at a suitable roll and/or yaw orientation, the controller 301 and/or control system 300 can maintain the forward foil(s) 140, aft foils 142, 144, and/or associated spars, which can include maintaining the angle(s) of attack. In some embodiments, the ballast tank system 132, wedge 314, and/or wake shaper(s) 128 can also be used in the method 1600. The methods 1400, 1600 can be especially practical with uneven loading of passengers within the water-sports boat 100 and/or passengers that are moving.

Figure 35:
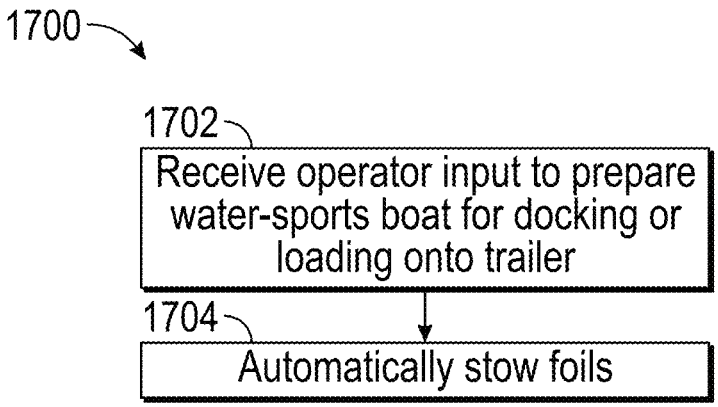
FIG. 35 illustrates an example method for automatically stowing the foil(s) and/or spar(s) of a foil displacement system.

FIG. 35 illustrates an example method 1700 for automatically stowing the foil(s) and/or spar(s) of the foil displacement system 138. At block 1700, the controller 301 and/or control system 300 can receive via the user interface 302 a command to prepare the water-sports boat 100 for docking and/or loading onto a trailer. At block 1704, the controller 301 and/or control system 300 can automatically stow foil(s) and/or spar(s) of the foil displacement system 138 in preparation for docking and/or loading onto a trailer. Ins some embodiments, the controller 301 and/or control system 300 can stow the wedge 130, wake shaper(s) 128, and/or empty the ballast tanks of the ballast tank system 132.

Figure 36:
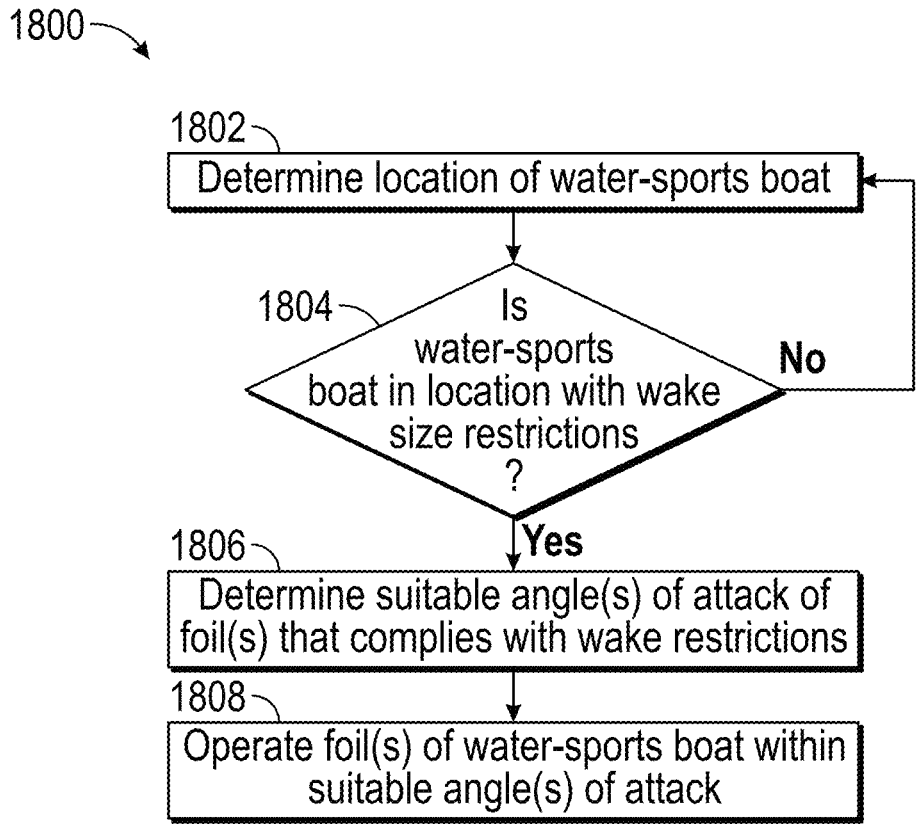
FIG. 36 illustrates an example method for controlling the wake enhancing capabilities of a water-sports boat based on a location of the water-sports boat.

FIG. 36 illustrates an example method 1800 for controlling the wake enhancing capabilities of the water-sports boat 100 based on the location of the water-sports boat 10. At block 1802, the controller 301 and/or control system 300 can determine the location of the water-sports boat 100 via the GPS 330. At block 1804, the controller 301 and/or control system 300 can determine if there are wake restrictions at the location of the water-sports boat 100 by comparing the location of the water-sports boat 100 against locations that have wake restrictions that are saved in the memory system 332, which can be updated via a network. If the water-sports boat 100 is not in a location with a wake restriction, the process can return to block 1802. If the water-sports boat 100 is in a location with wake restrictions, the process can proceed to block 1806. At block 1806, the controller 301 and/or control system 300 can determine suitable configurations of the foil displacement system 138 that comply with the wake restrictions, which can include suitable angles of attack for the foil(s). In some embodiments, the controller 301 and/or control system 300 can determine suitable configurations of the wedge 130, wake shaper(s) 128, and/or ballast tank system 132 that comply with the wake restrictions. In some embodiments, the controller 301 and/or control system 300 can determine that use of ballast tank systems 132 are prohibited at a given location. At block 1808, the controller 301 and/or control system 300 can operate the foil(s) and/or spar(s) of the foil displacement system 138, wedge 130, wake shaper(s) 128, and/or ballast tank system 132 consistent with the wake restrictions. In some embodiments, the controller 301 and/or control system 300 can operate the foil(s) and/or spar(s) of the foil displacement system 138 within suitable angles of attack. In some embodiments, the controller 301 and/or control system 300 can alert the operator via the display(s) 304, light(s) 324, and/or speaker(s) 326 of the wake restrictions and the compliant operating parameters.

Figure 37:
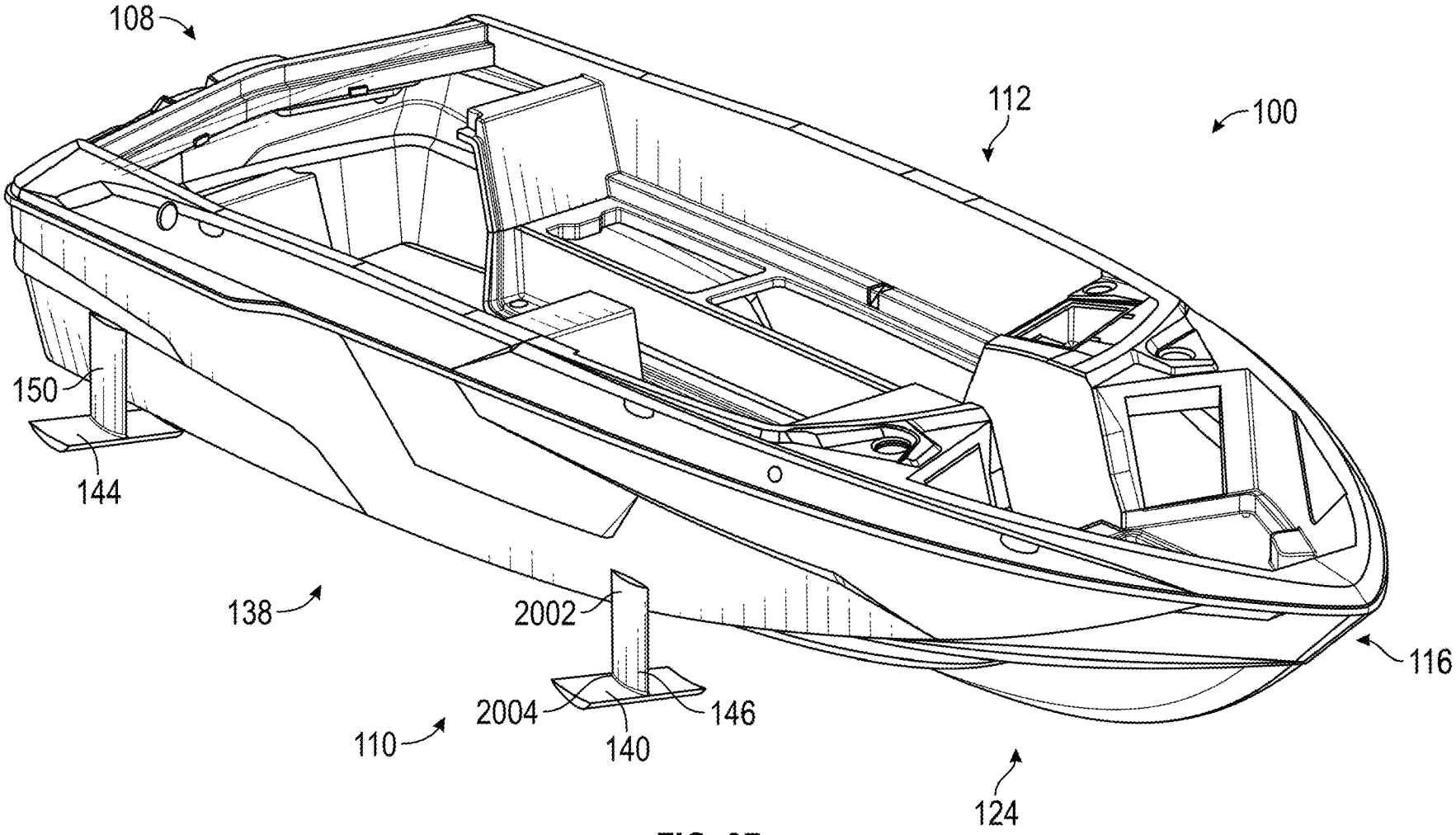
FIG. 37 illustrates a water sports boat with a foil displacement system.

FIG. 37 illustrates an embodiments where the aft foil(s) 144 and spar(s) 150 are mounted to the starboard side 110 and/or port side 112 of the stern 108 and the forward foil(s) 140 and spar(s) 146 are forward therefrom and attached to the starboard side 110 and/or port side 112. In some embodiments, the spars 150, 146 can pivot to change an angle of attack of the foils 144, 140 (e.g., the spar(s) 150, 146 can rotate with respect to a pivot 2002, respectively). In some embodiments, the foils 144, 140 can pivot relative to the spars 150, 146 to change an angel of attack of the foils 144, 140 (e.g., the foil(s) 140, 144 can rotate with respect to a pivot 2004, respectively). In some embodiments, the foregoing pivoting can be free rotation or via power. In some embodiments, the spars 146, 150 an/or the foils 144, 140 are fixedly coupled to the water-sports boat 100, rendering the spars 146, 150 and/or foils 144, 140 static. In some embodiments, the angle of attack of the foils 144, 150 is static but the height of the foils can be manually adjusted.

Figure 38:
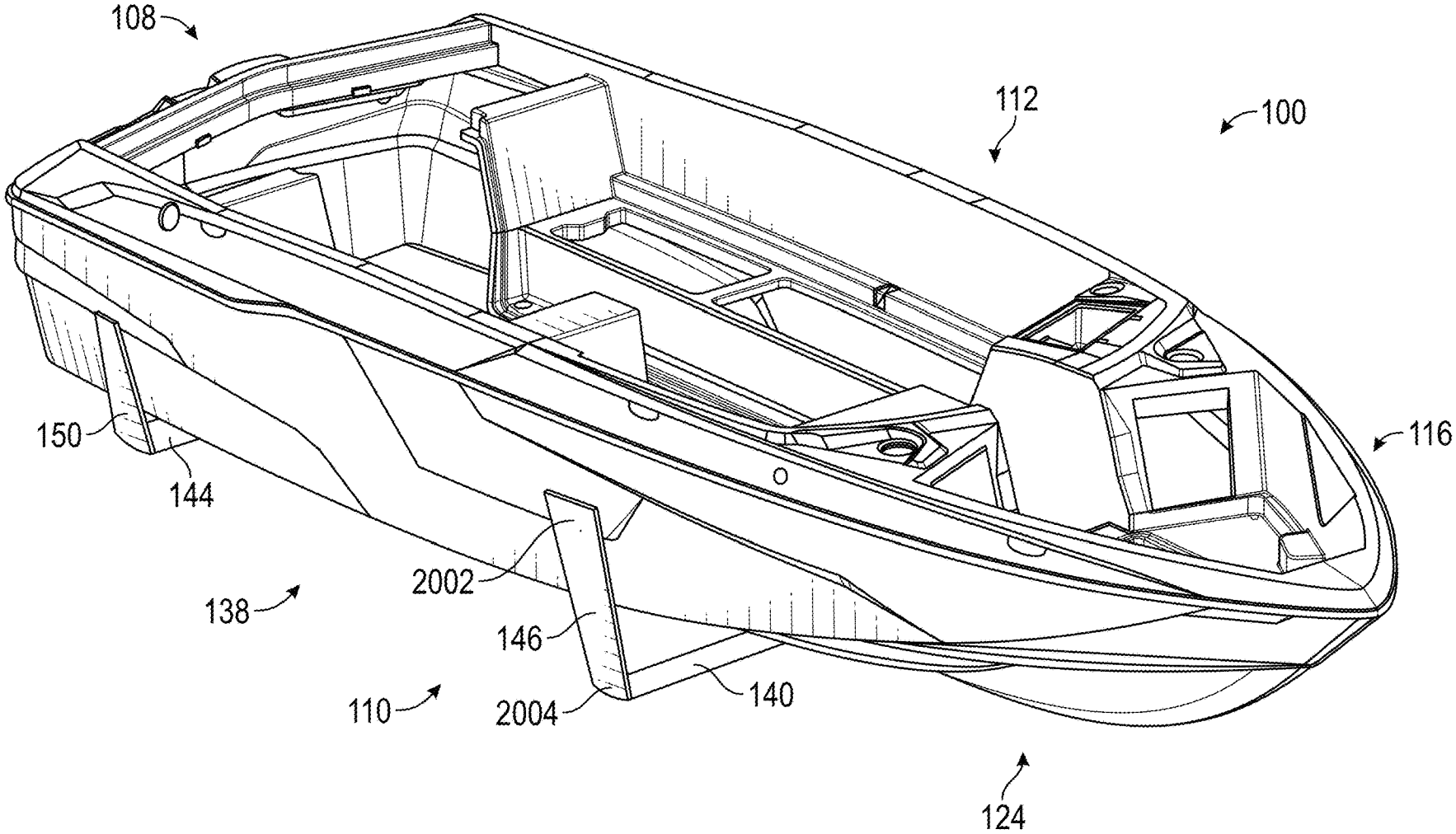
FIG. 38 illustrates a water sports boat with a foil displacement system.

FIG. 38 illustrates an embodiments where the aft foil(s) 144 and spar(s) 150 are mounted to the starboard side 110 and/or port side 112 of the stern 108 and the forward foil(s) 140 and spar(s) 146 are forward therefrom and attached to the starboard side 110 and/or port side 112. In some embodiments, the spar 150 and aft foil 144 form a continuous foil, which can be referred to as an L foil, curved L foil, and/or J foil. In some embodiments, the forward foil 140 and spar 146 form a continuous foil, which can be referred to as an L foil, curved L foil, and/or J foil. In some embodiments, the forward foil 140 and aft foil 144 curve under the hull 124 of the water-sports boat 100. In some embodiments, the spars 150, 146 can pivot to change an angle of attack of the foils 144, 140 (e.g., the spar(s) 150, 146 can rotate with respect to a pivot 2002, respectively). In some embodiments, the foils 144, 140 can pivot relative to the spars 150, 146 to change an angel of attack of the foils 144, 140 (e.g., the foil(s) 140, 144 can rotate with respect to a pivot 2004, respectively). In some embodiments, the foregoing pivoting can be free rotation or via power. In some embodiments, the spars 146, 150 an/or the foils 144, 140 are fixedly coupled to the water-sports boat 100, rendering the spars 146, 150 and/or foils 144, 140 static. In some embodiments, the angle of attack of the foils 144, 150 is static but the height of the foils can be manually adjusted. In some embodiments, foils 144, 140 can each be split into more than one pivoting foil.

Figure 39:
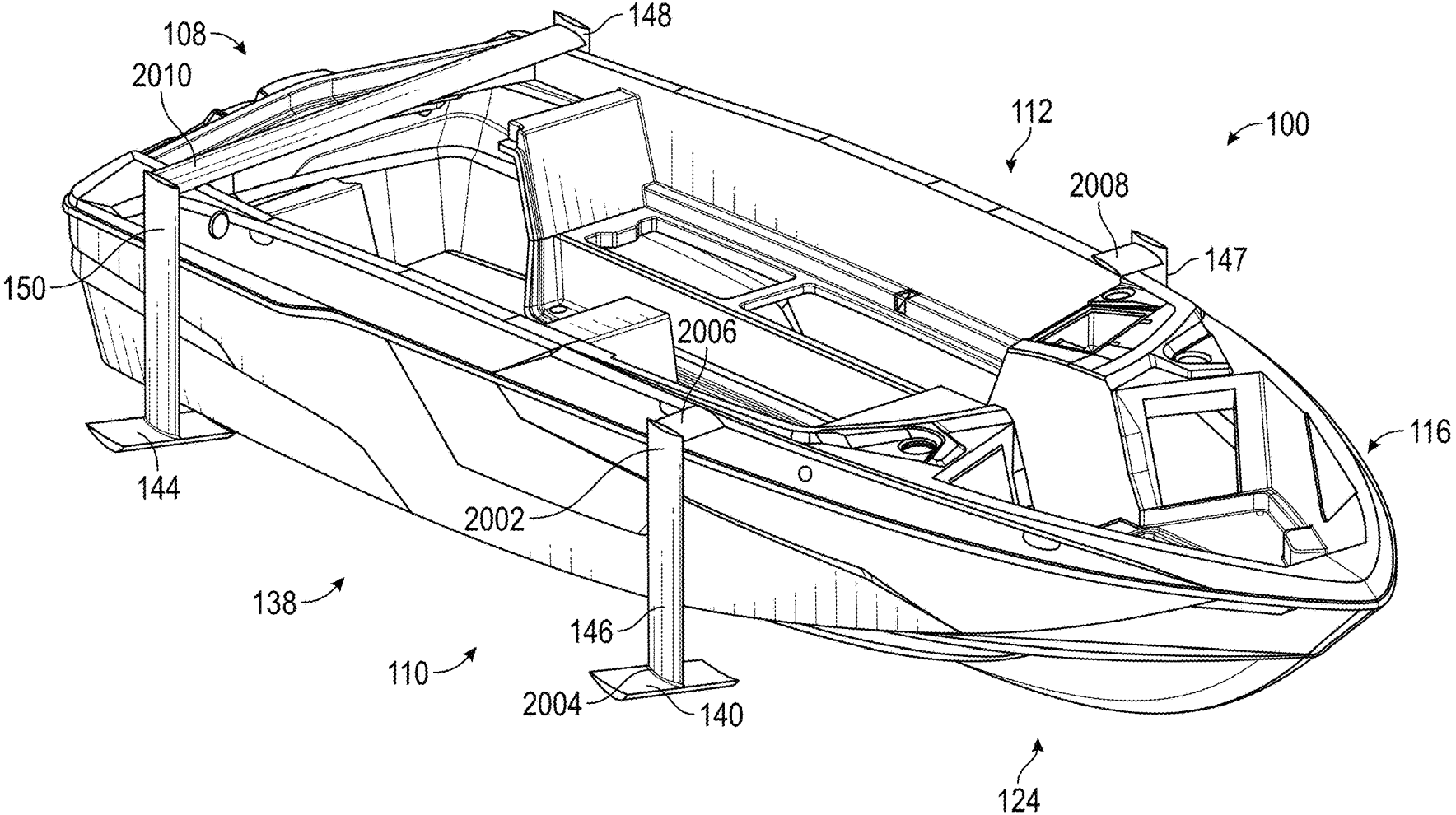
FIG. 39 illustrates a water sports boat with a foil displacement system.

FIG. 39 illustrates an embodiments where the aft foil(s) 144 and spars 150, 148 are positioned on the starboard side 110 and/or port side 112 of the stern 108 and the forward foil(s) 140 and spars 146, 147 are forward therefrom and attached to the starboard side 110 and/or port side 112. The spars 150, 148 can be connected to a cross support (brace, bar, beam) 2010 that extends over the deck of the water-sports boat 100. The cross support 2010 can support the aft foil(s) 144 and spars 150, 148 on the water-sports boat 100. The cross-support 2010 can mount to the gunwales, tower, and/or another location above the shear line of the water-sports boat 100. The spar 146 can include a mount (clip, bracket, hook) 2006 that mounts to the gunwale, tower, and/or another location above the shear line of the water-sports boat 100 on the starboard side 110. The spar 146 and mount 2006 can support the forward foil(s) 140. The spar 147 can include a mount (clip, bracket, hook) 2008 that mounts to the gunwale, tower, and/or another location above the shear line of the water-sports boat 100 on the port side 112. The spar 147 and mount 2008 can support a forward foil(s) 140. In some embodiments, the spars 146, 147, 148, 150 can pivot to change an angle of attack of the foils 144, 140 (e.g., the spar(s) 146, 147, 148, 150 can rotate with respect to a pivot 2002, respectively). In some embodiments, the foils 144, 140 can pivot relative to the spars 146, 147, 148, 150 to change an angel of attack of the foils 144, 140 (e.g., the foil(s) 140, 144 can rotate with respect to a pivot 2004, respectively). In some embodiments, the foregoing pivoting can be free rotation or via power. In some embodiments, the spars 146, 147, 148, 150 and/or the foils 144, 140 are fixedly coupled to the water-sports boat 100, rendering the spars 146, 147, 148, 150 and/or foils 144, 140 static. In some embodiments, the angle of attack of the foils 144, 150 is static but the height of the foils can be manually adjusted.

Figure 40:
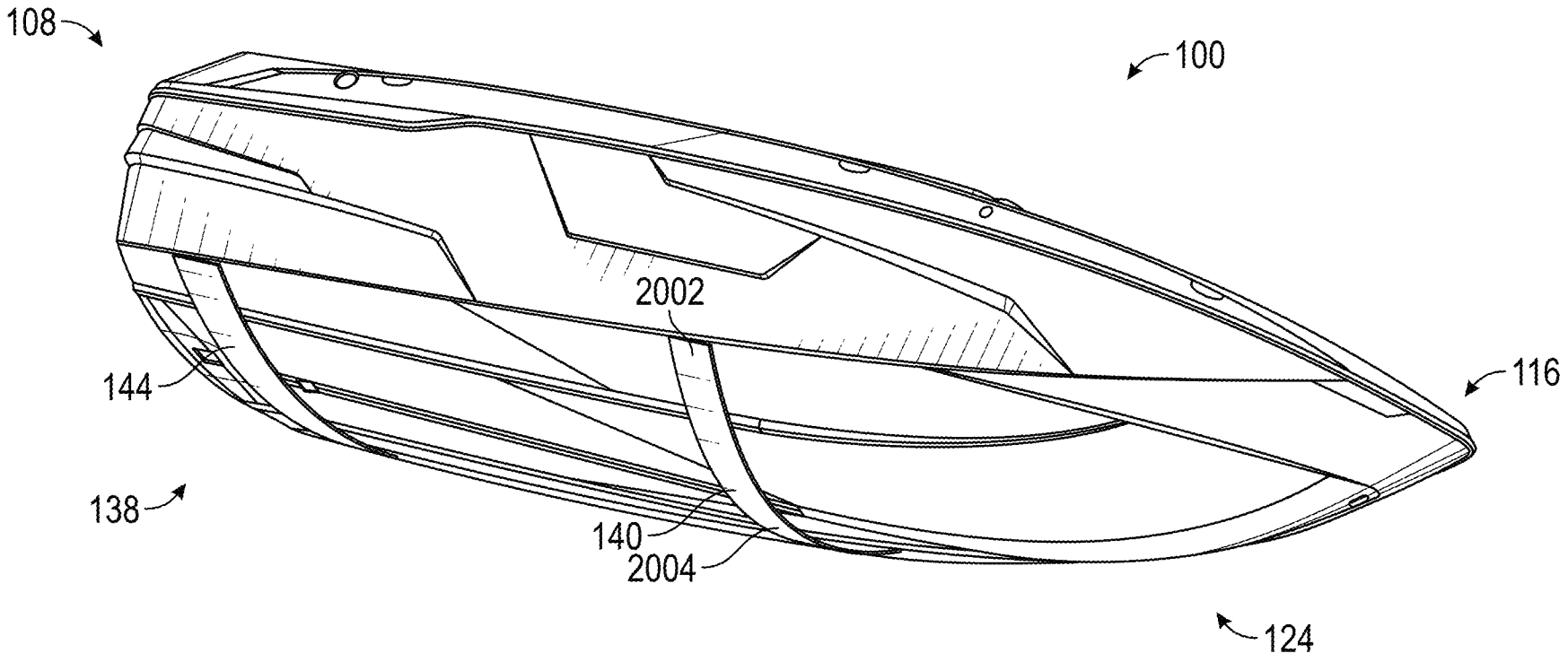
FIG. 40 illustrates a water sports boat with a foil displacement system.
Figure 41A:
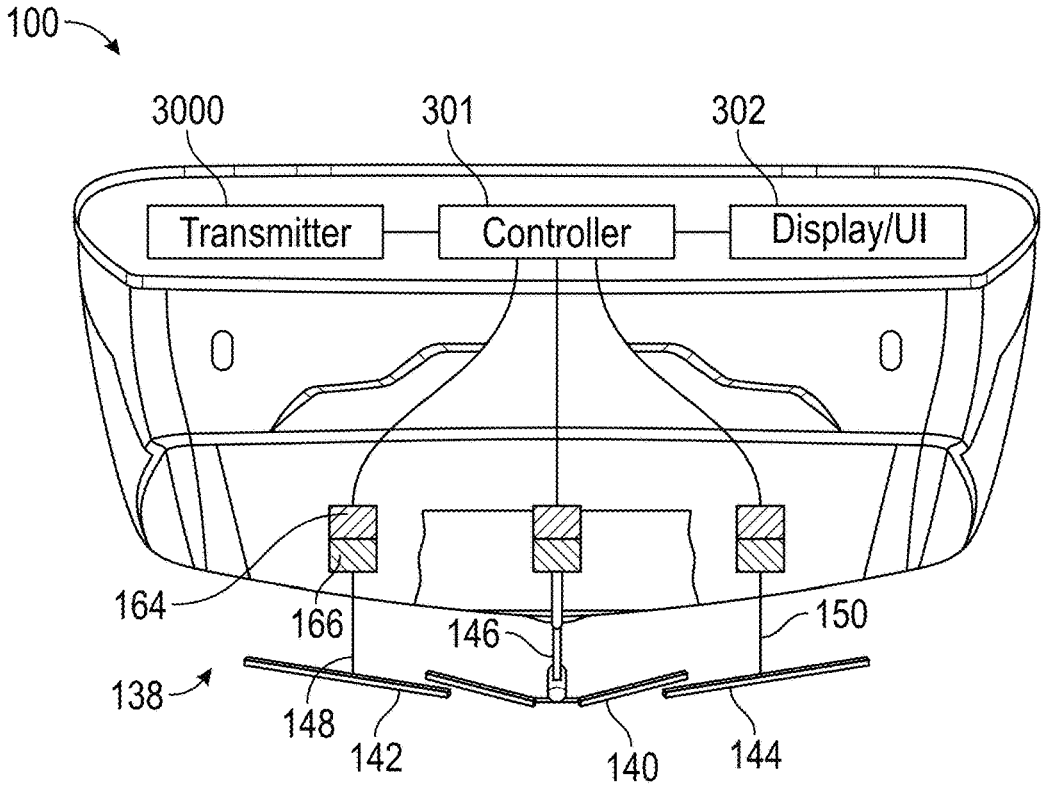
FIG. 41A illustrates a water sports boat with a foil displacement system.

FIG. 40 illustrates an embodiment where the aft foil(s) 144 and/or forward foil(s) 140 are mounted to the bottom surface of the hull 124. The aft foil(s) 144 and/or forward foil(s) 140 can extend across the transverse length and/or a majority of the transverse length of the bottom surface of the hull 124. The aft foil(s) 144 and/or forward foil(s) 140 pivot can be us-shaped. The aft foil(s) 144 and/or forward foil(s) 140 can rotate with respect to the hull 124 at pivot 2002. In some embodiments, the aft foil(s) 144 and/or forward foil(s) 140 can be split at one or more locations to create multiple foils segments that can rotate independently. For example, in some embodiments, a pivot 2004 can be positioned between the starboard and port ends of each of the aft foil(s) 144 and/or forward foil(s) 140, which can split segments of the aft foil(s) 144 and/or forward foil(s) 140 to be capable of independent movement with respect to the pivot 2004. The aft foil(s) 144 and/or forward foil(s) 140 rotate aft to create downward force and/or forward to create lifting force. When rotated aft, the aft foil(s) 144 and/or forward foil(s) 140 can behave similar to a scoop to deflect water upward to the hull 124 to create a downward force. When rotated forward, the aft foil(s) 144 and/or forward foil(s) 140 can deflect water downward away from the hull 124 to create lifting force. In some embodiments, the foregoing pivoting can be free rotation or via power. In some embodiments, the aft foil(s) 144 and/or forward foil(s) 140 are fixedly coupled to the water-sports boat 100, rendering the aft foil(s) 144 and/or forward foil(s) 140 static. In some embodiments, the angle of attack of the foils 144, 150 is static but the height of the foils can be manually adjusted. In some embodiments, the foils 144, 150 have gate sections that break away (e.g., via a spring or other mechanism) form the main body of the foils 144, 1500 as speed increases to increase the maximum and/or minimum potential for generating downward force and/or upward force. In some embodiments the hull 124 can include internal ducting that can receive water flow therethrough that can increase the drag of the hull 124, which can help create larger wakes FIG. 41A illustrates a water-sports boat 100 with a controller 301 that can receive user input via a user interface 302, which can include a display. The controller 301 can be in communication with a transmitter 3000 that can send commands from the controller 301 to systems of the water-sports boat 100, such as the foil displacement system 138. The foil displacement system 138 can include a forward foil(s) 104, spar(s) 146, starboard aft foil(s) 144, spar(s) 144, port aft foil(s) 142, spar(s) 148, angle of attack actuator(s) 166, and/or vertical actuator(s) 164 that can operate as described elsewhere herein. In some embodiments, a wired communication line is between the controller 301 and the angle of attack actuator(s) 166 and/or vertical actuator(s) 164. The forward foil(s) 104, spar(s) 146, starboard aft foil(s) 144, spar(s) 144, port aft foil(s) 142, and/or spar(s) 148 are in a dihedral T-foil configuration.

Figure 41B:
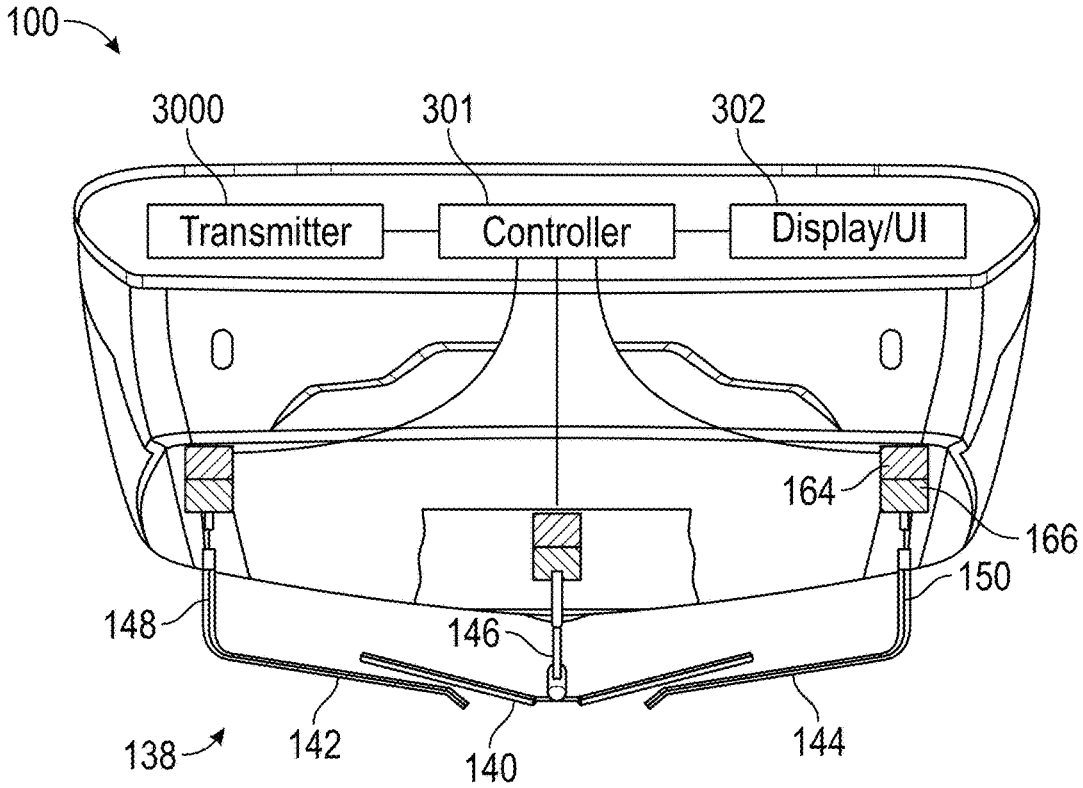
FIG. 41B illustrates a water sports boat with a foil displacement system.

FIG. 41B is the same as FIG. 41A except that the starboard aft foil(s) 144, spar(s) 144, port aft foil(s) 142, and spar(s) 148 are different. For example, the starboard aft foil 144 and spar 144 are in an inverted J foil configuration with the foil 144 extending inward. The port aft foil(s) 142 and spar(s) 148 are a mirror arrangement.

Figure 42B:
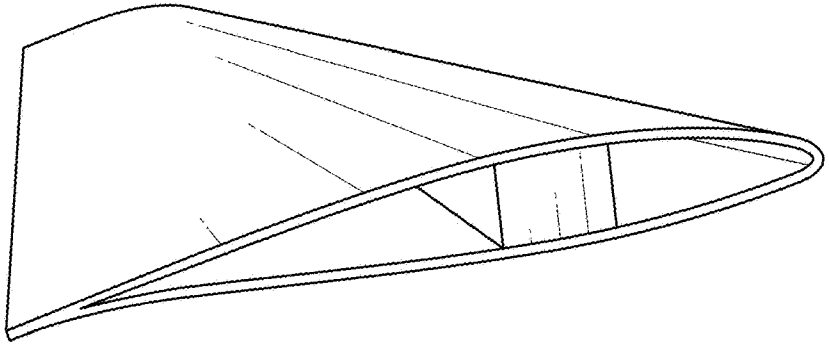
FIGS. 42A-42E illustrate various foil(s), spar(s), and manufacturing techniques.
Figure 42D:
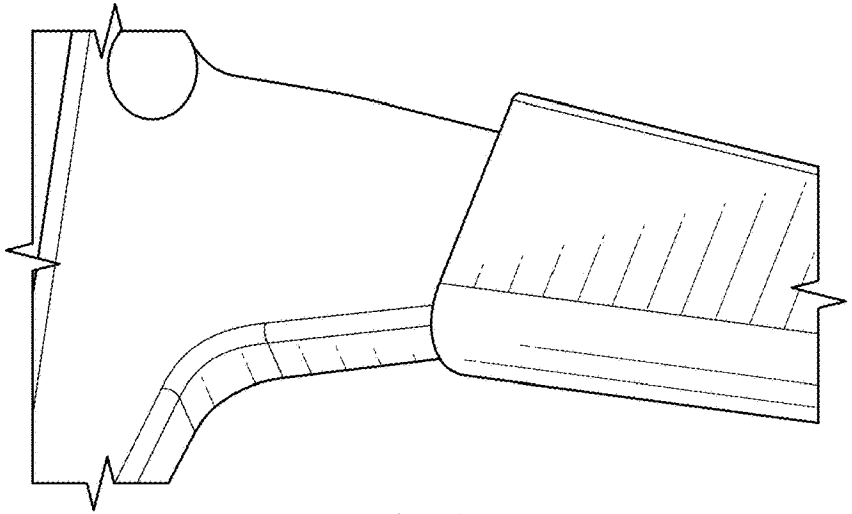
Figure 42A:
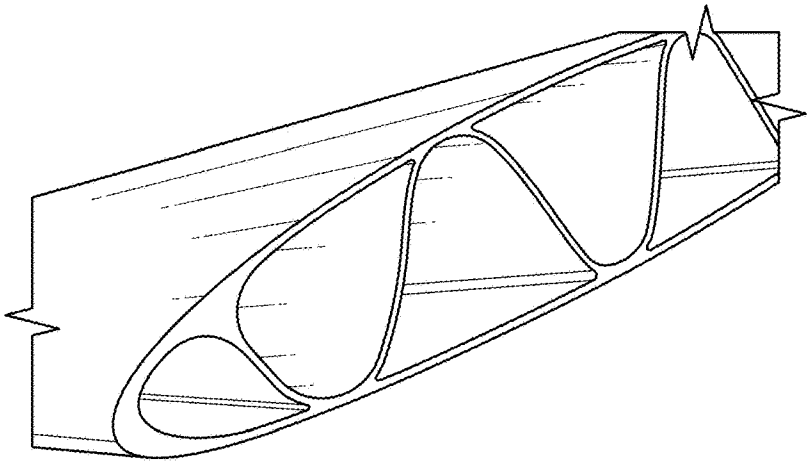
Figure 42C:
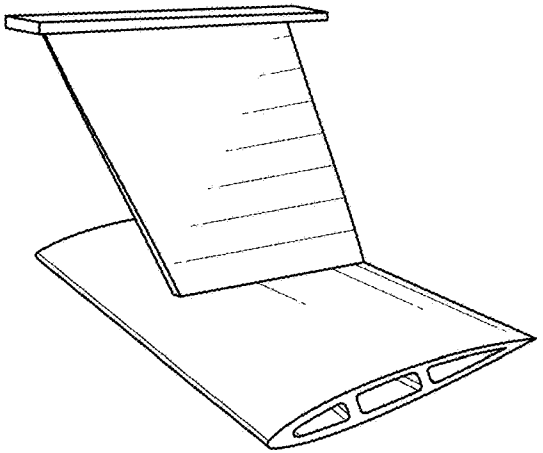
Figure 42E:
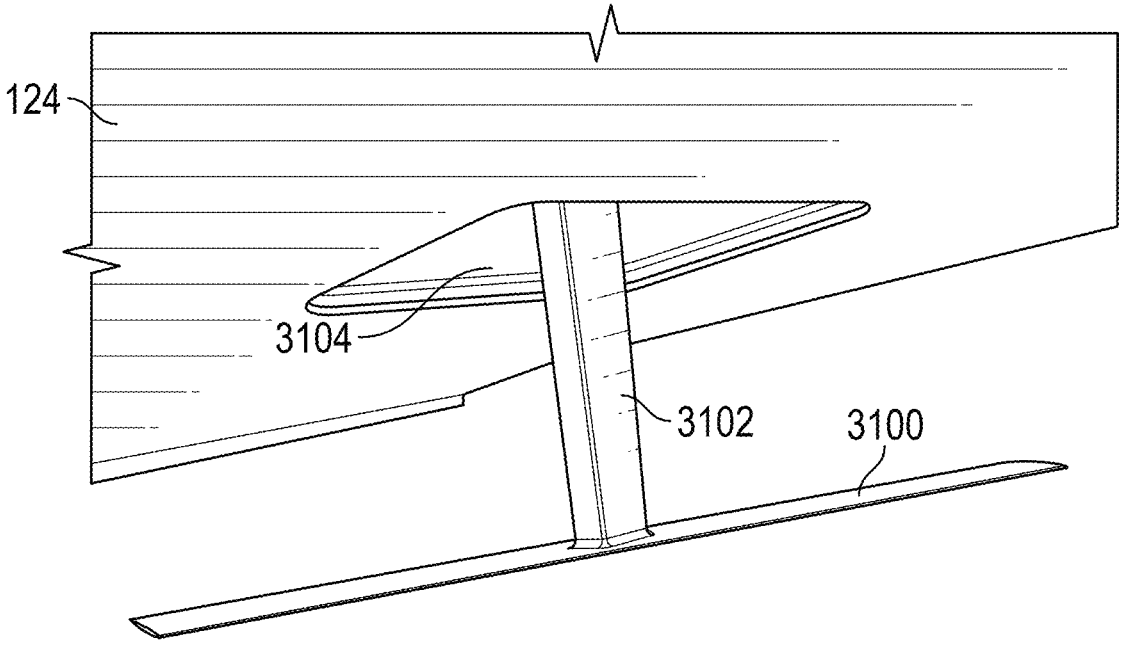
Figure 42E:
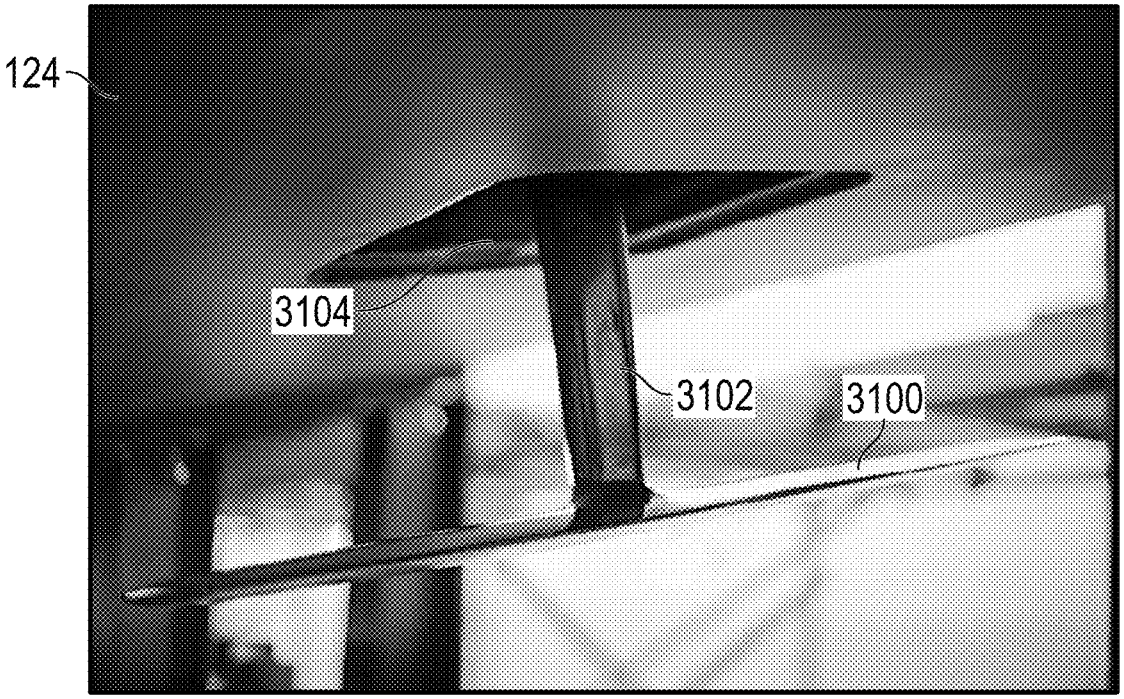

The foils and spars described herein can be manufactured with a variety of techniques. In some embodiments, a spar and foil can be separate members that are bolted together, chemically bonded, welded, and/or otherwise connected. In some embodiments, the spar and foil can be made as a single piece. In some embodiments, the foil and/or spar can be made of fiber glass with or without a core and chemically bonded together. In some embodiments, the foil and/or spare can be made of carbon fiber and/or fiber glass with or without a core and chemically bonded or connected via threaded inserts that are bolted together. In some embodiments, a carbon fiber sheet core can be used, as shown in FIG. 42A. In some embodiments, a core, such as the core shown in FIG. 42B, can be used. In some embodiments, the foils and spars are injection molded thermoset glass filled polymer, which can be used for a single piece or multi-piece construction. The polymer can be hydrophobic or coated. In some embodiments, the foils and/or spars can be machined from large billets (metals, alloys, etc.) and bolted, welded, etc. together. In some embodiments, the foils and/or spars can be cast (metals, alloys, etc.), machined, finished, and then connected together via bolts, welding, etc. In some embodiments, the foils and/or spars can be extruded (metals, alloys, etc.), machined, and/or assembled together via bolts, welding, etc., as shown in FIG. 42C. In some embodiments, a carbon fiber lug method can be used to join the foil and spar, as shown in FIG. 42D. In some embodiments, additive manufacturing can be used which can advantageously provide improve and/or optimal strength to weight ratio and/or potential cost reduction over time. FIG. 42E shows a foil 3100 and spar 3102. The foil 3100 and spar 3102 can be a single piece. In some embodiments, the foil 3100 and spar 3102 can be welded, bolted, and/or otherwise connected. The spar 3102 can extend from an opening 3104. The spar 3102 can be extended and retracted from the opening 3104 to move the foil 3100 vertically. In some embodiments, the spar 3102 can pivot to change an angle of attack of the foil 3100. In some embodiments, the opening 3104 is in the hull 124 and/or a structure attached to the hull 124. The foil(s) and/or spar(s) can be made of a variety of materials, such as metals (stainless steel, aluminum, etc.), metal alloys, polymers, etc. The foil(s) and/or spar(s) can be made of fiber glass and/or carbon fiber.

Terminology

Although this disclosure has been described in the context of certain embodiments and examples, a person of ordinary skill in the art would recognize, after reviewing the disclosure herein, that any embodiment disclosed can be combined with other embodiments, portions/aspects of other embodiments, and/or technologies known in the art to accomplished the desired advantages discussed herein. It will be understood by those skilled in the art, after reviewing the disclosure herein, that the disclosure extends beyond the specifically disclosed embodiments to other alternative embodiments and/or uses and obvious modifications and equivalents thereof. In addition, while several variations of the embodiments of the disclosure have been shown and described in detail, other modifications, which are within the scope of this disclosure, will be readily apparent to those of skill in the art after reviewing the disclosure herein. It is also contemplated that various combinations or sub-combinations of the specific features and aspects of the embodiments may be made and still fall within the scope of the disclosure. For example, features described above in connection with one embodiment can be used with a different embodiment described herein and the combination still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this invention may comprise, additional to its essential features described herein, one or more features as described herein from each other embodiment of the invention disclosed herein.

Wakes for wakeboarding and wake surfing can have different characteristics. A wake extends behind a water-sports boat as the water-sports boat travels forward through water. For wakeboarding, a symmetrical wake is desirable—meaning that a starboard side of the wake and a port side of the wake are generally symmetrical, which can form a V like shape behind the water-sports boat. The starboard side of the wake can have a front face and a back face. The port side of the wake can have a front face and a back face. The back faces of each of the starboard side and port side of the wake generally face each other while the front faces of each of the starboard side and port side of the wake generally face away from each other. The front faces of each of the starboard side and port side of the wake can be used by a wake boarder to leap into the air, like a ramp, which can include leaping from the front face of the starboard side to the front face of the port side. The front faces can be linear to exponential in shape with an exponential shape providing additional pop as the wakeboarder launches off the front face into the air.

For wake surfing, an asymmetrical wake is desirable—meaning that the starboard side of the wake and the port side of the wake are not symmetrical. One of the starboard side of the wake or the port side of the wake has a front face that is smooth, called a wave, for surfing while the other front face of the other side is turbulent. The wave (e.g., the smooth front face) can have a linear to exponential shape. An exponential shape can be generally preferred as it propels the wake surfer with suitable speed.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate after reviewing the disclosure herein that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize, after reviewing the disclosure herein, that the disclosure may be embodied or carried out in a manner that achieves one advantage or a group of advantages as taught herein without necessarily achieving other advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The term "and/or" has similar meaning in that when used, for example, in a list of elements, the term "and/or" means one, some, or all of the elements in the list, but does not require any individual embodiment to have all elements.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

Values and ranges of values disclosed herein are examples and should not be construed as limiting. The values and ranges of values disclosed herein can be altered while gaining the advantages discussed herein. The listed ranges of values disclosed herein can include subsets of ranges or values which are part of this disclosure. Disclosed ranges of values or a single value for one feature can be implemented in combination with any other compatible disclosed range of values or value for another feature. For example, any specific value within a range of dimensions for one element can be paired with any specific value within a range of dimensions for another element. One of ordinary skill in the art will recognize from the disclosure herein that any disclosed length of a spar may be combined with any disclosed width of a foil, each having any disclosed shape.

Any methods disclosed herein need not be performed in the order recited. The methods disclosed herein include certain actions taken by a practitioner; however, they can also include any third-party instruction of those actions, either expressly or by implication. For example, actions such as "controlling a motor speed" include "instructing controlling of a motor speed."

All of the methods and tasks described herein may be performed and fully automated by a computer system. The computer system may, in some cases, include multiple distinct computers or computing devices (e.g., physical servers, workstations, storage arrays, cloud computing resources, etc.) that communicate and interoperate over a network to perform the described functions. Each such computing device typically includes a processor (or multiple processors) that executes program instructions or modules stored in a memory or other non-transitory computer-readable storage medium or device (e.g., solid state storage devices, disk drives, etc.). The various functions disclosed herein may be embodied in such program instructions, and/or may be implemented in application-specific circuitry (e.g., ASICs or FPGAs) of the computer system. Where the computer system includes multiple computing devices, these devices may, but need not, be co-located. The results of the disclosed methods and tasks may be persistently stored by transforming physical storage devices, such as solid state memory chips and/or magnetic disks, into a different state. In some embodiments, the computer system may be a cloud-based computing system whose processing resources are shared by multiple distinct business entities or other users.

The various illustrative logical blocks and modules described in connection with the embodiments disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can include electrical circuitry or digital logic circuitry configured to process computer-executable instructions. In another embodiment, a processor includes an FPGA or other programmable device that performs logic operations without processing computer-executable instructions. A processor can also be implemented as a combination of computing devices, e.g., a combination of a DSP and a microprocessor, a plurality of microprocessors, one or more microprocessors in conjunction with a DSP core, or any other such configuration. A computing environment can include any type of computer system, including, but not limited to, a computer system based on a microprocessor, a mainframe computer, a digital signal processor, a portable computing device, a device controller, or a computational engine within an appliance, to name a few.

The steps of a method, process, or algorithm described in connection with the embodiments disclosed herein can be embodied directly in hardware, in a software module stored in one or more memory devices and executed by one or more processors, or in a combination of the two. A software module can reside in RAM memory, flash memory, ROM memory, EPROM memory, EEPROM memory, registers, hard disk, a removable disk, a CD-ROM, or any other form of non-transitory computer-readable storage medium, media, or physical computer storage known in the art. An example storage medium can be coupled to the processor such that the processor can read information from, and write information to, the storage medium. In the alternative, the storage medium can be integral to the processor. The storage medium can be volatile or nonvolatile. The processor and the storage medium can reside in an ASIC.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Additionally, all publications, patents, and patent applications mentioned in this specification are herein incorporated by reference to the same extent as if each individual publication, patent, or patent application was specifically and individually indicated to be incorporated by reference.

What is claimed is:

1. A water sports boat including foils configured to be deployed in water, wherein movement of the boat with respect to water causes the foils in certain positions to exert a down force transmitted to a hull, the water sports boat comprising:

a cockpit portion including controls configured to provide a driver operation of the boat;

a propulsion system;

a hull configured to move through water propelled by the propulsion system responsive to ones of the controls operated by the driver, the hull configured to displace a quantity of water and create a wake in the water trailing the moving boat;

a forward foil assembly including a forward foil and a forward spar, the forward foil assembly positioning the forward foil, when deployed, forward of a transverse axis at a center of gravity of the boat, the forward foil, when deployed at a downforce angle of attack, also configured to exert a first down force through the forward spar to the hull of the boat as the hull moves through water;

a port aft foil assembly including a port aft foil and a port aft spar, the port aft foil assembly positioning the port aft foil, when deployed, port of a longitudinal axis of the boat and aft of the transverse axis, the port aft foil, when deployed at a downforce angle of attack, also configured to exert a second down force through the port aft spar to the hull of the boat as the hull moves through water;

a starboard aft foil assembly including a starboard aft foil and a starboard aft spar, the starboard aft foil assembly positioning the starboard aft foil, when deployed, starboard of the longitudinal axis and aft of the transverse axis, the starboard aft foil, when deployed at a downforce angle of attack, also configured to exert a third down force through the port aft spar to the hull of the boat as the hull moves through water, wherein any individual or combination of the first, second and third down forces draw the hull of the boat down into the water to increase the quantity of water displaced and increase a size of the wake; and one or more surf flaps, said one or more surf flaps and said forward foil, said port aft foil, and said starboard aft foil, collectively shape the wake to have one smooth wave face behind and to one side of the boat suited for wake surfing and one distorted wave face behind and to an opposite side of the boat.

2. A water sports boat including foils configured to be deployed in water, wherein movement of the boat with respect to water causes the foils in certain positions to exert a down force transmitted to a hull, the water sports boat comprising:

a cockpit portion including controls configured to provide a driver operation of the boat;

a propulsion system;

a hull configured to move through water propelled by the propulsion system responsive to ones of the controls operated by the driver, the hull configured to displace a quantity of water and create a wake in the water trailing the moving boat;

at least one forward foil assembly including a forward foil and a forward spar, the at least one forward foil assembly positioned forward of a transverse axis at a center of gravity of the boat and configured in a deployed position to have a downforce angle of attack to exert a first down force through the forward spar to the hull of the boat as the hull moves through water, and configured in a stowed position to be at least one of inoperative and not exerting the first down force through the forward spar;

at least one port aft foil assembly including a port aft foil and a port aft spar, the at least one port aft foil assembly positioned port of a longitudinal axis of the boat and aft of the transverse axis and configured in a deployed position to have a downforce angle of attack to exert a second down force through the port aft spar to the hull of the boat as the hull moves through water, and configured in a stowed position to be at least one of inoperative and not exerting the second down force through the port aft spar;

at least one starboard aft foil assembly including a starboard aft foil and a starboard aft spar, the at least one starboard aft foil assembly positioned starboard of the longitudinal axis and aft of the transverse axis and configured in a deployed position to have a downforce angle of attack to exert a third down force through the port aft spar to the hull of the boat as the hull moves through water, and configured in a stowed position to be at least one of inoperative and not exerting the third down force through the starboard aft spar; and one or more surf flaps configured to shape one transom facing side of the wake without regard to the other, thereby forming a surf wave.

3. The water sports boat of claim 2, wherein said port aft foil and said starboard aft foil are disposed forward of a trailing edge of the one or more surf flaps.

4. The water sports boat of claim 2, wherein said one or more surf flaps comprises a port surf flap and a starboard surf flap, and wherein said at least one port aft foil assembly and said at least one starboard aft foil assembly are disposed between said port surf flap and said starboard surf flap.

5. The water sports boat of claim 2, wherein said one or more surf flaps are disposed forward of the one or more surf flaps.

6. The water sports boat of claim 2, wherein said one or more surf flaps are configured to be actuated to shape the wake.

7. The water sports boat of claim 2, wherein the boat is configured to form said surf wave without filling one or more ballast tanks.

8. The water sports boat of claim 1, wherein the forward foil includes sections port and starboard of the forward spar that are asymmetrical front to aft, said sections interacting with said water to produce said first down force.

9. The water sports boat of claim 1, wherein the port aft foil assembly comprises a T shape foil assembly and wherein said port aft foil includes port aft sections port and starboard of the port aft spar that are asymmetrical front to aft, said port aft sections interacting with said water to produce said second down force, and wherein the starboard aft foil assembly comprises a T shape foil assembly and wherein said starboard aft foil includes starboard aft sections port and starboard of the starboard aft spar that are asymmetrical front to aft, said starboard aft sections interacting with said water to produce said third down force.

10. The water sports boat of claim 1, wherein at least one of the forward foil, the port aft foil, and the starboard aft foil comprise an Eppler 420 foil.

11. The water sports boat of claim 1, wherein at least one of the forward foil, the port aft foil, and the starboard aft foil are dihedral.

12. The water sports boat of claim 1, comprising:

a forward actuator configured to position the forward foil in the deployed position or in a stowed position;

a port aft actuator configured to position the port aft foil in the deployed position or in a stowed position; and a starboard aft actuator configured to position the starboard aft foil in the deployed position or in a stowed position, wherein said controls are further configured to actuate said forward actuator, said port aft actuator and said starboard aft actuator responsive to said driver operation.

13. The water sports boat of claim 1, wherein said forward foil, said port aft foil, and said starboard aft foil, collectively shape the wake to have a smooth wave face behind and to one side of the boat and a similarly smooth wave face behind and to an opposite side of the boat, said smooth and similarly smooth wave faces suited for wakeboarding.

14. A water sports boat including foils configured to be deployed in water, wherein movement of the boat with respect to water causes the foils in certain positions to exert a down force transmitted to a hull, the water sports boat comprising:

a cockpit portion including controls configured to provide a driver operation of the boat;

a propulsion system;

a hull configured to move through water propelled by the propulsion system responsive to ones of the controls operated by the driver, the hull configured to displace a quantity of water and create a wake in the water trailing the moving boat;

a forward foil assembly including a forward foil and a forward spar, the forward foil assembly positioning the forward foil, when deployed, forward of a transverse axis at a center of gravity of the boat, the forward foil, when deployed at a downforce angle of attack, also configured to exert a first down force through the forward spar to the hull of the boat as the hull moves through water, wherein the forward foil includes sections port and starboard of the forward spar that are asymmetrical front to aft, said sections interacting with said water to produce said first down force;

a port aft foil assembly including a port aft foil and a port aft spar, the port aft foil assembly positioning the port aft foil, when deployed, port of a longitudinal axis of the boat and aft of the transverse axis, the port aft foil, when deployed at a downforce angle of attack, also configured to exert a second down force through the port aft spar to the hull of the boat as the hull moves through water; and and a starboard aft foil assembly including a starboard aft foil and a starboard aft spar, the starboard aft foil assembly positioning the starboard aft foil, when deployed, starboard of the longitudinal axis and aft of the transverse axis, the starboard aft foil, when deployed at a downforce angle of attack, also configured to exert a third down force through the port aft spar to the hull of the boat as the hull moves through water, wherein any individual or combination of the first, second and third down forces draw the hull of the boat down into the water to increase the quantity of water displaced and increase a size of the wake.

15. A water sports boat including foils configured to be deployed in water, wherein movement of the boat with respect to water causes the foils in certain positions to exert a down force transmitted to a hull, the water sports boat comprising:

a cockpit portion including controls configured to provide a driver operation of the boat;

a propulsion system;

a hull configured to move through water propelled by the propulsion system responsive to ones of the controls operated by the driver, the hull configured to displace a quantity of water and create a wake in the water trailing the moving boat;

a forward foil assembly including a forward foil and a forward spar, the forward foil assembly positioning the forward foil, when deployed, forward of a transverse axis at a center of gravity of the boat, the forward foil, when deployed at a downforce angle of attack, also configured to exert a first down force through the forward spar to the hull of the boat as the hull moves through water;

a port aft foil assembly including a port aft foil and a port aft spar, the port aft foil assembly positioning the port aft foil, when deployed, port of a longitudinal axis of the boat and aft of the transverse axis, the port aft foil, when deployed at a downforce angle of attack, also configured to exert a second down force through the port aft spar to the hull of the boat as the hull moves through water; and a starboard aft foil assembly including a starboard aft foil and a starboard aft spar, the starboard aft foil assembly positioning the starboard aft foil, when deployed, starboard of the longitudinal axis and aft of the transverse axis, the starboard aft foil, when deployed at a downforce angle of attack, also configured to exert a third down force through the port aft spar to the hull of the boat as the hull moves through water, wherein any individual or combination of the first, second and third down forces draw the hull of the boat down into the water to increase the quantity of water displaced and increase a size of the wake;

wherein at least one of the forward foil, the port aft foil, and the starboard foil are dihedral.

16. A water sports boat including foils configured to be deployed in water, wherein movement of the boat with respect to water causes the foils in certain positions to exert a down force transmitted to a hull, the water sports boat comprising:

a cockpit portion including controls configured to provide a driver operation of the boat;

a propulsion system;

a hull configured to move through water propelled by the propulsion system responsive to ones of the controls operated by the driver, the hull configured to displace a quantity of water and create a wake in the water trailing the moving boat;

a forward foil assembly including a forward foil and a forward spar, the forward foil assembly positioning the forward foil, when deployed, forward of a transverse axis at a center of gravity of the boat, the forward foil, when deployed at a downforce angle of attack, also configured to exert a first down force through the forward spar to the hull of the boat as the hull moves through water;

a port aft foil assembly including a port aft foil and a port aft spar, the port aft foil assembly positioning the port aft foil, when deployed, port of a longitudinal axis of the boat and aft of the transverse axis, the port aft foil, when deployed at a downforce angle of attack, also configured to exert a second down force through the port aft spar to the hull of the boat as the hull moves through water;

a starboard aft foil assembly including a starboard aft foil and a starboard aft spar, the starboard aft foil assembly positioning the starboard aft foil, when deployed, starboard of the longitudinal axis and aft of the transverse axis, the starboard aft foil, when deployed at a downforce angle of attack, also configured to exert a third down force through the port aft spar to the hull of the boat as the hull moves through water, wherein any individual or combination of the first, second and third down forces draw the hull of the boat down into the water to increase the quantity of water displaced and increase a size of the wake;

a forward actuator configured to position the forward foil in the deployed position or in a stowed position;

a port aft actuator configured to position the port aft foil in the deployed position or in a stowed position; and a starboard aft actuator configured to position the starboard aft foil in the deployed position or in a stowed position, wherein said controls are further configured to actuate said forward actuator, said port aft actuator and said starboard aft actuator responsive to said driver operation.

17. The water sports boat of claim 16, wherein the forward foil includes sections port and starboard of the forward spar that are asymmetrical front to aft, said sections interacting with said water to produce said first down force.

18. The water sports boat of claim 16, wherein the port aft foil assembly comprises a T shape foil assembly and wherein said port aft foil includes port aft sections port and starboard of the port aft spar that are asymmetrical front to aft, said port aft sections interacting with said water to produce said second down force, and wherein the starboard aft foil assembly comprises a T shape foil assembly and wherein said starboard aft foil includes starboard aft sections port and starboard of the starboard aft spar that are asymmetrical front to aft, said starboard aft sections interacting with said water to produce said third down force.

19. The water sports boat of claim 16, wherein at least one of the forward foil, the port aft foil, and the starboard aft foil comprise an Eppler 420 foil.

20. The water sports boat of claim 16, wherein at least one of the forward foil, the port aft foil, and the starboard aft foil are dihedral.

21. The water sports boat of claim 16, wherein said forward foil, said port aft foil, and said starboard aft foil, collectively shape the wake to have a smooth wave face behind and to one side of the boat and a similarly smooth wave face behind and to an opposite side of the boat, said smooth and similarly smooth wave faces suited for wakeboarding.

22. The water sports boat of claim 16, comprising one or more surf flaps, said one or more surf flaps and said forward foil, said port aft foil, and said starboard aft foil, collectively shape the wake to have one smooth wave face behind and to one side of the boat suited for wake surfing and one distorted wave face behind and to an opposite side of the boat.

23. The water sports boat of claim 16, wherein the forward actuator is configured to change a forward angle of attack of said forward foil, the port aft actuator is configured to change a port aft angle of attack of said port aft foil, and the starboard aft actuator is configured to change a starboard aft angle of attack of said starboard aft foil.

24. The water sports boat of claim 23, wherein said port aft angle of attack is different from said starboard aft angle of attack.

25. The water sports boat of claim 23, wherein said forward angle of attack is between about -25 degrees and about 5 degrees.

26. The water sports boat of claim 23, wherein said port aft angle of attack is between about -20 and about 10 degrees, and said starboard aft angle of attack is between about -20 and about 10 degrees.

27. The water sports boat of claim 23, wherein said forward angle of attack, said port aft angle of attack, and said starboard aft angle of attack, collectively produce a collective neutral down force.

28. The water sports boat of claim 16, comprising a deck above the hull, wherein the stowed position of the forward foil comprises the forward foil vertically maneuvered toward the deck, the stowed position of the port aft foil comprises the port aft foil vertically maneuvered toward the deck, and the stowed position of the starboard aft foil comprises the starboard aft foil vertically maneuvered toward the deck.

29. The water sports boat of claim 28, wherein the stowed position of the forward foil comprises at least a portion of the forward foil vertically maneuvered above the hull and below the deck, the stowed position of the port aft foil comprises at least a portion of the port aft foil vertically maneuvered above the hull and below the deck, and the stowed position of the starboard aft foil comprises at least a portion of the starboard aft foil vertically maneuvered above the hull and below the deck.

30. The water sports boat of claim 16, comprising one or more surf flaps, said one or more surf flaps and said forward foil, said port aft foil, and said starboard aft foil, collectively shape the wake to have one smooth wave face behind and to one side of the boat suited for wake surfing and one distorted wave face behind and to an opposite side of the boat.

31. The water sports boat of claim 16, wherein said forward foil, said port aft foil, and said starboard aft foil, collectively shape the wake to have a smooth wave face behind and to one side of the boat and a similarly smooth wave face behind and to an opposite side of the boat, said smooth and similarly smooth wave faces suited for wake-boarding.

* * * * *